US010385759B2

(12) United States Patent
Hasegawa et al.

(10) Patent No.: US 10,385,759 B2
(45) Date of Patent: Aug. 20, 2019

(54) COOLING SYSTEM FOR INTERNAL COMBUSTION ENGINE

(71) Applicants: TOYOTA JIDOSHA KABUSHIKI KAISHA, Toyota-shi, Aichi-ken (JP); AISIN SEIKI KABUSHIKI KAISHA, Kariya-shi, Aichi-ken (JP)

(72) Inventors: Yoshio Hasegawa, Susono (JP); Tomohiro Shinagawa, Sunto-gun (JP); Kenichi Kubota, Toyota (JP); Ryo Michikawauchi, Numazu (JP); Yuji Miyoshi, Susono (JP); Yoshiharu Hirata, Susono (JP); Naoto Yumisashi, Nagoya (JP)

(73) Assignees: Toyota Jidosha Kabushiki Kaisha, Toyota-shi, Aichi-ken (JP); Aisin Seiki Kabushiki Kaisha, Kariya-shi, Aichi-ken (JP)

( * ) Notice: Subject to any disclaimer, the term of this patent is extended or adjusted under 35 U.S.C. 154(b) by 0 days.

(21) Appl. No.: 15/895,239

(22) Filed: Feb. 13, 2018

(65) Prior Publication Data

US 2018/0230892 A1 Aug. 16, 2018

(30) Foreign Application Priority Data

Feb. 14, 2017 (JP) ..... 2017-024617

(51) Int. Cl.
*F01P 7/16* (2006.01)
*F01P 3/02* (2006.01)
(Continued)

(52) U.S. Cl.
CPC ..... *F01P 7/16* (2013.01); *F01P 3/02* (2013.01); *F01P 3/18* (2013.01); *F01P 5/10* (2013.01);
(Continued)

(58) Field of Classification Search
CPC ..... F01P 7/16; F01P 3/02; F01P 3/18; F01P 5/10; F01P 2003/024; F01P 2003/021;
(Continued)

(56) References Cited

U.S. PATENT DOCUMENTS 4,669,427 A * 6/1987 Shimonosono ..... F01P 3/2285 123/41.27
5,074,254 A * 12/1991 Takamatsu ..... F01P 3/02 123/2
(Continued)

FOREIGN PATENT DOCUMENTS

EP 2 508 727 A1 10/2012
FR 2860833 A1 4/2005
(Continued)

*Primary Examiner* — Grant Moubry
(74) *Attorney, Agent, or Firm* — Finnegan, Henderson, Farabow, Garrett & Dunner, LLP

(57) ABSTRACT

A cooling system includes: a first coolant passage; a second coolant passage; a pump; a radiator; a third coolant passage; a connection switching mechanism that switches between a forward flow connection state and a reverse flow connection state; a fourth coolant passage; a fifth coolant passage; and a shutoff valve configured to open/shut off the fifth coolant passage. The radiator is disposed at a location at which coolant flowing from a second end of the first coolant passage into a fourth end of the second coolant passage is not cooled in the reverse flow connection state, and coolant flowing out from the second end of the first coolant passage and the fourth end of the second coolant passage is cooled in the forward flow connection state.

12 Claims, 35 Drawing Sheets

(51) Int. Cl.
*F01P 5/10* (2006.01)
*F01P 3/18* (2006.01)
*F01P 7/14* (2006.01)

(52) U.S. Cl.
CPC ... *F01P 2003/021* (2013.01); *F01P 2003/024* (2013.01); *F01P 2003/027* (2013.01); *F01P 2003/028* (2013.01); *F01P 2007/146* (2013.01); *F01P 2060/08* (2013.01); *F01P 2060/16* (2013.01)

(58) Field of Classification Search
CPC ..... F01P 2003/027; F01P 2003/028; F01P 2060/08; F01P 2060/16
See application file for complete search history.

(56) References Cited

U.S. PATENT DOCUMENTS 5,701,852 A * 12/1997 Suzuki ..... F01P 7/162 123/142.5 R
6,230,669 B1 * 5/2001 Evans ..... F01P 3/22 123/41.42
6,247,429 B1 * 6/2001 Hara ..... F01P 5/10 123/41.1
2003/0000487 A1 1/2003 Schmitt
2005/0028756 A1 * 2/2005 Santanam ..... F01P 7/165 123/41.1
2013/0167784 A1 * 7/2013 Quix ..... F02M 26/33 123/41.1
2013/0226380 A1 8/2013 Ando et al.

FOREIGN PATENT DOCUMENTS

GB 2540401 A 1/2017
JP 2004-308501 A 11/2004
JP 2009-293415 A 12/2009
JP 2011-236831 A 11/2011
JP 2012-184693 9/2012
JP 2013-160183 8/2013
JP 2013-177026 9/2013
JP 2015-59532 3/2015
WO WO 02/02917 A1 1/2002

* cited by examiner

FIG. 5

| | NO EGR COOLER COOLANT FLOW REQUEST NO HEATER CORE COOLANT FLOW REQUEST | EGR COOLER COOLANT FLOW REQUEST NO HEATER CORE COOLANT FLOW REQUEST | NO EGR COOLER COOLANT FLOW REQUEST HEATER CORE COOLANT FLOW REQUEST | EGR COOLER COOLANT FLOW REQUEST HEATER CORE COOLANT FLOW REQUEST |
|---|---|---|---|---|
| COLD STATE | OPERATION CONTROL A | OPERATION CONTROL B | OPERATION CONTROL C | OPERATION CONTROL D |
| FIRST HALF WARM-UP STATE | OPERATION CONTROL E | OPERATION CONTROL F | OPERATION CONTROL G | OPERATION CONTROL H |
| SECOND HALF WARM-UP STATE | OPERATION CONTROL E | OPERATION CONTROL I | OPERATION CONTROL J | OPERATION CONTROL K |
| WARM-UP COMPLETION STATE | OPERATION CONTROL L | OPERATION CONTROL M | OPERATION CONTROL N | OPERATION CONTROL O |

COOLING SYSTEM FOR INTERNAL COMBUSTION ENGINE

INCORPORATION BY REFERENCE

The disclosure of Japanese Patent Application No. 2017-024617 filed on Feb. 14, 2017 including the specification, drawings and abstract is incorporated herein by reference in its entirety.

BACKGROUND

1. Technical Field

The disclosure relates to a cooling system configured to cool an internal combustion engine with the use of coolant.

2. Description of Related Art

Generally, the amount of heat that a cylinder head of an internal combustion engine receives from combustion inside a cylinder is larger than the amount of heat that a cylinder block of the internal combustion engine receives from combustion inside the cylinder, and the heat capacity of the cylinder head is smaller than the heat capacity of the cylinder block. For this reason, the temperature of the cylinder head increases more easily than the temperature of the cylinder block.

A cooling system (hereinafter, referred to as existing cooling system) for an internal combustion engine, described in Japanese Unexamined Patent Application Publication No. 2012-184693 (JP 2012-184693 A), is configured to supply coolant to only a cylinder head and not to supply coolant to the cylinder block when the temperature of the internal combustion engine (hereinafter, referred to as engine temperature) is low. Thus, when the engine temperature is low, the temperature of the cylinder block is early increased.

SUMMARY

On the other hand, the existing cooling system is configured to, when the engine temperature is high, supply coolant to both the cylinder block and the cylinder head. At this time, coolant that has a high temperature as a result of passing through the cylinder head is directly supplied to the cylinder block without passing through a radiator. For this reason, the temperature of coolant that is supplied to the cylinder block is high, with the result that the temperature of the cylinder block may excessively increase.

The disclosure provides a cooling system for an internal combustion engine, which is able to early increase the temperature of a cylinder block when an engine temperature is low and also prevent an excessive increase in the temperature of the cylinder block when the engine temperature is high.

A first aspect of the disclosure provides a cooling system for an internal combustion engine. The cooling system is applied to the internal combustion engine including a cylinder head and a cylinder block. The cooling system is configured to cool the cylinder head and the cylinder block with the use of coolant. The cooling system includes a first coolant passage, a second coolant passage, a pump, a radiator, a third coolant passage, a connection switching mechanism, a fourth coolant passage, a fifth coolant passage, and a shutoff valve. The first coolant passage is provided in the cylinder head. The second coolant passage is provided in the cylinder block. The pump is configured to circulate the coolant. The radiator is configured to cool the coolant. The third coolant passage connects a first end of the first coolant passage to a first pump port. The first pump port is one of a pump outlet port and a pump inlet port. The pump outlet port is a coolant outlet port of the pump. The pump inlet port is a coolant inlet port of the pump. The connection switching mechanism is configured to switch a status of pump connection between a forward flow connection state and a reverse flow connection state. The status of pump connection is a status of connection of the pump to a first end of the second coolant passage. The forward flow connection state is a state where the first end of the second coolant passage is connected to the first pump port. The reverse flow connection state is a state where the first end of the second coolant passage is connected to a second pump port. The second pump port is the other one of the pump outlet port and the pump inlet port. The fourth coolant passage connects a second end of the first coolant passage to a second end of the second coolant passage. The fifth coolant passage connects the fourth coolant passage to the second pump port. The shutoff valve is configured to be set in a valve open position in which the fifth coolant passage is open when the forward flow connection state is established. The shutoff valve is configured to be set in a valve closed position in which the fifth coolant passage is shut off when the reverse flow connection state is established. When coolant flowing out from the second end of the first coolant passage flows into the fourth end of the second coolant passage via the fourth coolant passage at the time when the reverse flow connection state is established, the radiator is disposed at a location at which coolant that flows out from the second end of the first coolant passage and that flows into the fourth end of the second coolant passage via the fourth coolant passage is not cooled, and at a location at which coolant that flows out from the second end of the first coolant passage and the fourth end of the second coolant passage is cooled at the time when the forward flow connection state is established. When coolant flowing out from the first end of the first coolant passage flows into the third end of the second coolant passage via the connection switching mechanism at the time when the reverse flow connection state is established, the radiator is disposed at a location at which coolant that flows out from the first end of the first coolant passage and that flows into the third end of the second coolant passage via the connection switching mechanism is not cooled, and at a location at which coolant that flows out from the first end of the first coolant passage and the third end of the second coolant passage is cooled at the time when the forward flow connection state is established.

A second aspect of the disclosure provides a cooling system for an internal combustion engine. The cooling system is applied to the internal combustion engine including a cylinder head and a cylinder block. The cooling system is configured to cool the cylinder head and the cylinder block with the use of coolant. The cooling system includes a first coolant passage, a second coolant passage, a pump, a radiator, a third coolant passage, a connection switching mechanism, a fourth coolant passage, a fifth coolant passage, and a shutoff valve. The first coolant passage is provided in the cylinder head. The second coolant passage is provided in the cylinder block. The pump is configured to circulate the coolant. The radiator is configured to cool the coolant. The third coolant passage connects a third end of the second coolant passage to a first pump port. The first pump port is one of a pump outlet port and a pump inlet port. The pump outlet port is a coolant outlet port of the pump. The pump inlet port is a coolant inlet port of the pump. The connection switching mechanism is configured to switch a status of pump connection between a forward flow connection state and a reverse flow connection state. The status of pump connection is a status of connection of the pump to a first end of the first coolant passage. The forward flow connection state is a state where the first end of the first coolant passage is connected to the first pump port. The reverse flow connection state is a state where the first end of the first coolant passage is connected to a second pump port. The second pump port is the other one of the pump outlet port and the pump inlet port. The fourth coolant passage connects a second end of the first coolant passage to a fourth end of the second coolant passage. The fifth coolant passage connects the fourth coolant passage to the second pump port. The shutoff valve is configured to be set in a valve open position in which the fifth coolant passage is open when the forward flow connection state is established. The shutoff valve is configured to be set in a' valve closed position in which the fifth coolant passage is shut off when the reverse flow connection state is established. When coolant flowing out from the second end of the first coolant passage flows into the fourth end of the second coolant passage via the fourth coolant passage at the time when the reverse flow connection state is established, the radiator is disposed at a location at which coolant that flows out from the second end of the first coolant passage and that flows into the fourth end of the second coolant passage via the fourth coolant passage is not cooled, and at a location at which coolant that flows out from the first end of the first coolant passage and the third end of the second coolant passage is cooled at the time when the forward flow connection state is established. When coolant flowing out from the first end of the first coolant passage flows into the third end of the second coolant passage via the connection switching mechanism at the time when the reverse flow connection state is established, the radiator is disposed at a location at which coolant that flows out from the first end of the first coolant passage and that flows into the third end of the second coolant passage via the connection switching mechanism is not cooled, and at a location at which coolant that flows out from the second end of the first coolant passage and the fourth end of the second coolant passage is cooled at the time when the forward flow connection state is established.

In the cooling systems according to the first and second aspects, when the connection switching mechanism establishes the reverse flow connection state, coolant flowing out from the second end of the first coolant passage flows into the fourth end of the second coolant passage via the fourth coolant passage or coolant flowing out from the first end of the first coolant passage flows into the third end of the second coolant passage via the connection switching mechanism.

At this time, coolant directly flows from the second end of the first coolant passage to the fourth end of the second coolant passage without passing through the radiator or coolant directly flows from the first end of the first coolant passage into the third end of the second coolant passage without passing through the radiator.

For this reason, in the case where the temperature of the internal combustion engine is low and, therefore, it is desired to early increase the temperature of the cylinder block, when the connection switching mechanism establishes the reverse flow connection state, coolant cooled via the radiator and having a low temperature does not flow into the second coolant passage and coolant having a high temperature directly flows into the second coolant passage. Thus, it is possible to early increase the temperature of the cylinder block.

On the other hand, when the connection switching mechanism establishes the forward flow connection state, coolant that has passed through the radiator flows into the first coolant passage and the second coolant passage. For this reason, in the case where the temperature of the internal combustion engine is high and, therefore, it is desired to cool both the cylinder block and the cylinder head, when the connection switching mechanism establishes the forward flow connection state, coolant that has passed through the radiator and that has a low temperature flows into the first coolant passage and the second coolant passage. Thus, it is possible to cool both the cylinder block and the cylinder head. As a result, it is possible to prevent an excessive increase in the temperature of the cylinder block and the temperature of the cylinder head.

In the cooling system according to the first aspect, the connection switching mechanism may include a sixth coolant passage, a seventh coolant passage, and a selector valve. The sixth coolant passage may connect the third end of the second coolant passage to the first pump port. The seventh coolant passage may connect the third end of the second coolant passage to the second pump port. The selector valve may be configured to be selectively set in any one of a forward flow position and a reverse flow position. The forward flow position may be a position in which the third end of the second coolant passage is connected to the first pump port via the sixth coolant passage. The reverse flow position may be a position in which the third end of the second coolant passage is connected to the second pump port via the seventh coolant passage.

In this case, the connection switching mechanism may be configured to establish the forward flow connection state by setting the selector valve in the forward flow position; and the connection switching mechanism may be configured to establish the reverse flow connection state by setting the selector valve in the reverse flow position.

In the cooling system according to the second aspect, the connection switching mechanism may include a sixth coolant passage, a seventh coolant passage, and a selector valve. The sixth coolant passage may connect the first end of the first coolant passage to the first pump port. The seventh coolant passage may connect the first end of the first coolant passage to the second pump port. The selector valve may be configured to be selectively set in any one of a forward flow position and a reverse flow position. The forward flow position may be a position in which the first end of the first coolant passage is connected to the first pump port via the sixth coolant passage. The reverse flow position may be a position in which the first end of the first coolant passage is connected to the second pump port via the seventh coolant passage.

In this case as well, the connection switching mechanism may be configured to establish the forward flow connection state by setting the selector valve in the forward flow position; and the connection switching mechanism may be configured to establish the reverse flow connection state by setting the selector valve in the reverse flow position.

Since a general control system for an internal combustion engine includes a pump, a radiator and first to sixth coolant passages, the cooling systems according to the above aspects additionally include the seventh coolant passage, the selector valve, and the shutoff valve. Therefore, with the cooling systems according to the above aspects, by adding a small number of components, that is, the seventh coolant passage, the selector valve and the shutoff valve, it is possible to establish the reverse flow connection state in addition to the forward flow connection state.

In the cooling system, the connection switching mechanism may be configured to establish the reverse flow connection state when the temperature of the internal combustion engine is higher than or equal to a first threshold temperature and lower than a second threshold temperature. The first threshold temperature and the second threshold temperature may be set in advance. The first threshold temperature may be lower than a warm-up completion temperature set in advance as a temperature of the internal combustion engine, at or above which an electronic control unit determines that warm-up of the internal combustion engine is complete. The second threshold temperature may be lower than the warm-up completion temperature and higher than the first threshold temperature. The connection switching mechanism may be configured to, when the temperature of the internal combustion engine is higher than or equal to the first threshold temperature and lower than the second threshold temperature, establish the reverse flow connection state.

When the temperature of the internal combustion engine is higher than or equal to the first threshold temperature and lower than the second threshold temperature, the head temperature and the block temperature are required to increase at a high rate. When coolant is not supplied to the first coolant passage or the second coolant passage at this time, it is possible to increase the head temperature and the block temperature at a high rate. However, when coolant is not supplied to the first coolant passage or the second coolant passage, coolant in the first coolant passage and coolant in the second coolant passage do not flow, and stagnate. In this case, the temperature of coolant in the first coolant passage and the temperature of coolant in the second coolant passage partially extremely increase. As a result, a boil of coolant can occur in the first coolant passage or the second coolant passage or both.

With the cooling systems according to the above aspects, when the temperature of the internal combustion engine is higher than or equal to the first threshold temperature and lower than the second threshold temperature, the reverse flow connection state is established. As described above, in this case, coolant cooled via the radiator and having a low temperature does not flow into the first coolant passage or the second coolant passage, and coolant having a high temperature directly flows into the first coolant passage or the second coolant passage, so it is possible to early increase the temperature of the cylinder block or the temperature of the cylinder head.

In addition, since coolant flows through the first coolant passage and the second coolant passage, it is possible to prevent the temperature of coolant from becoming partially extremely high in the first coolant passage or the second coolant passage. As a result, it is possible to prevent a boil of coolant in the first coolant passage or the second coolant passage.

In the cooling system, the shutoff valve may be configured to be set in the valve closed position when the temperature of the internal combustion engine is higher than or equal to the first threshold temperature and lower than the second threshold temperature.

As described above, when the temperature of the internal combustion engine is higher than or equal to the first threshold temperature and lower than the second threshold temperature, the reverse flow connection state is established. With the cooling systems according to the above aspects, the shutoff valve is set in the valve closed position at this time. Thus, coolant tends to flow from the second end of the first coolant passage to the fourth end of the second coolant passage via the fourth coolant passage or coolant tends to flow from the first end of the first coolant passage to the third end of the second coolant passage via the connection switching mechanism.

In the cooling system, when the connection switching mechanism switches the status of pump connection from the reverse flow connection state to the forward flow connection state, the connection switching mechanism may be configured to switch the status of pump connection from the reverse flow connection state to the forward flow connection state after a set position of the shutoff valve is switched from the valve closed position to the valve open position.

When the status of pump connection is switched from the reverse flow connection state to the forward flow connection state before the set position of the shutoff valve is switched from the valve closed position to the valve open position, the coolant passage is shut off during a period from when the status of pump connection is switched to when the set position of the shutoff valve is switched. Alternatively, even when the status of pump connection is switched from the reverse flow connection state to the forward flow connection state at the same time as the set position of the shutoff valve is switched from the valve closed position to the valve open position, the coolant passage is momentarily shut off. As a result, the pump is in operation although coolant is not able to circulate through the coolant passage.

With the cooling systems according to the above aspects, the connection switching mechanism switches the status of pump connection from the reverse flow connection state to the forward flow connection state after the set position of the shutoff valve is switched from the valve closed position to the valve open position. For this reason, it is possible to prevent the coolant passage from being shut off. As a result, it is possible to prevent the pump from being in operation although coolant is not able to circulate through the coolant passage.

The internal combustion engine may include an ignition switch. When the internal combustion engine is stopped with an operation of the ignition switch, the connection switching mechanism may be actuated so as to establish the forward flow connection state, and the shutoff valve may be set in the valve open position.

In the case where the connection switching mechanism establishes the reverse flow connection state and the shutoff valve is set in the valve closed position while the internal combustion engine is stopped with an operation of the ignition switch, it is conceivable that the connection switching mechanism or the shutoff valve becomes inoperative in a period until the internal combustion engine is started next time. In this case, even when the internal combustion engine is started and the temperature of the internal combustion engine becomes high, since the connection switching mechanism establishes the reverse flow connection state and the shutoff valve is set in the valve closed position, it is not possible to sufficiently cool the internal combustion engine.

With the cooling systems according to the above aspects, when the internal combustion engine is stopped with an operation of the ignition switch, the connection switching mechanism establishes the forward flow connection state and the shutoff valve is set in the valve open position. Therefore, even if the connection switching mechanism or the shutoff valve becomes inoperative in a period until the internal combustion engine is started next time, it is possible to sufficiently cool the internal combustion engine when the temperature of the internal combustion engine is high after a start of the internal combustion engine.

BRIEF DESCRIPTION OF THE DRAWINGS

Features, advantages, and technical and industrial significance of exemplary embodiments will be described below with reference to the accompanying drawings, in which like numerals denote like elements, and wherein:

FIG. 5 is a table that shows operation controls that are executed by the cooling system;

DETAILED DESCRIPTION OF EMBODIMENTS

Hereinafter, a cooling system for an internal combustion engine according to an embodiment of the disclosure will be described with reference to the accompanying drawings. The cooling system according to the embodiment is applied to an internal combustion engine 10 (hereinafter, simply referred to as engine 10) shown in FIG. 1 to FIG. 3.

Figure 1:
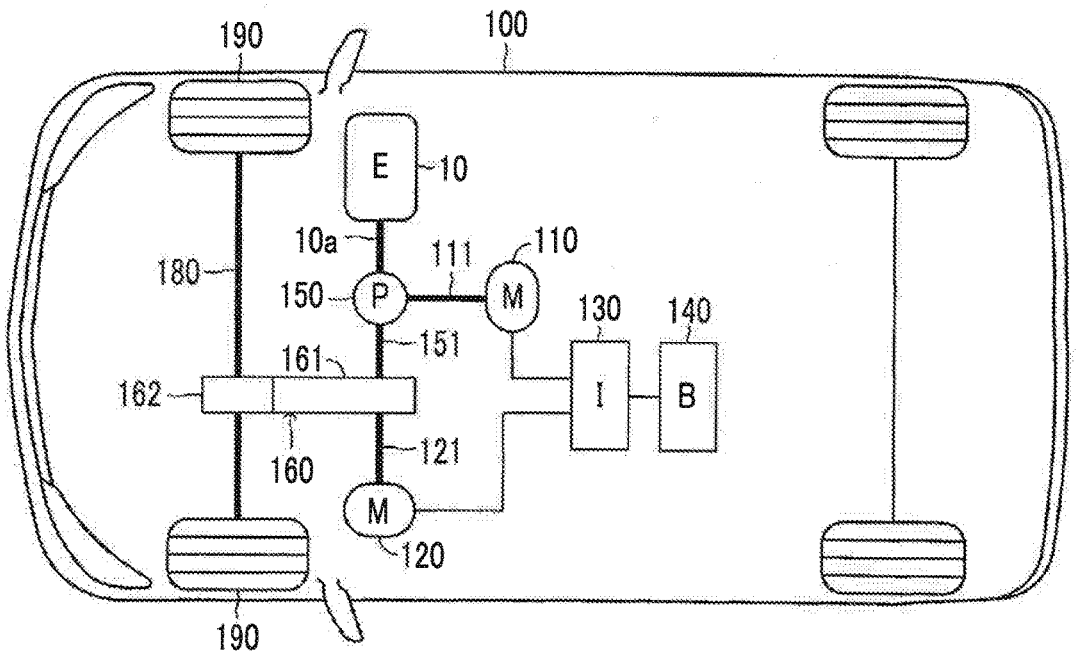
FIG. 1 is a diagram that shows a vehicle on which an internal combustion engine to which a cooling system according to an embodiment of the disclosure is applied is mounted.

As shown in FIG. 1, the engine 10 is mounted on a hybrid vehicle 100. The hybrid vehicle 100 (hereinafter, simply referred to as vehicle 100) includes the engine 10, a first motor generator 110, a second motor generator 120, an inverter 130, a battery (storage battery) 140, a power split device 150 and a power transmission device 160 as a driving apparatus.

The engine 10 is a multi-cylinder (in the present embodiment, in-line four-cylinder) four-cycle reciprocating diesel engine. However, the engine 10 may be a gasoline engine.

The power split device 150 distributes a torque that is, output from the engine 10 (hereinafter, referred to as engine torque) between a torque that rotates an output shaft 151 of the power split device 150 and a torque that drives the first motor generator 110 (hereinafter, referred to as first MG 110) as a generator in a predetermined ratio (predetermined distribution characteristic).

The power split device 150 is made up of a planetary gear train (not shown). The planetary gear train includes a sun gear, pinion gears, a planetary carrier and a ring gear (all of which are not shown).

The rotary shaft of the planetary carrier is connected to an output shaft 10*a* of the engine 10, and transmits engine torque to the sun gear and the ring gear via the pinion gears. The rotary shaft of the sun gear is connected to a rotary shaft 111 of the first MG 110, and transmits the engine torque, input to the sun gear, to the first MG 110. As the engine torque is transmitted from the sun gear to the first MG 110, the first MG 110 is rotated by the engine torque to generate electric power. The rotary shaft of the ring gear is connected to the output shaft 151 of the power split device 150. The engine torque input to the ring gear is transmitted from the power split device 150 to the power transmission device 160 via the output shaft 151.

The power transmission device 160 is connected to the output shaft 151 of the power split device 150 and a rotary shaft 121 of the second motor generator 120 (hereinafter, referred to as second MG 120). The power transmission device 160 includes a reduction gear train 161 and a differential gear 162.

The reduction gear train 161 is connected to a wheel drive shaft 180 via the differential gear 162. Therefore, the engine torque input from the output shaft 151 of the power split device 150 to the power transmission device 160 and the torque input from the rotary shaft 121 of the second MG 120 to the power transmission device 160 are transmitted to right and left front wheels 190 via the wheel drive shaft 180. The right and left front wheels 190 are drive wheels. However, the drive wheels may be right and left rear wheels or may be right and left front wheels and right and left rear wheels.

The power split device 150 and the power transmission device 160 are known (see, for example, Japanese Unexamined Patent Application Publication No. 2013-177026 (JP 2013-177026 A)).

Each of the first MG 110 and the second MG 120 is a permanent magnet synchronous motor, and is electrically connected to the inverter 130. When the inverter 130 causes the first MG 110 to operate as a motor, the inverter 130 converts direct-current power, which is supplied from the battery 140, to three-phase alternating-current power, and supplies the converted three-phase alternating-current power to the first MG 110. On the other hand, when the inverter 130 causes the second MG 120 to operate as a motor, the inverter 130 converts direct-current power, which is supplied from the battery 140, to three-phase alternating-current power, and supplies the converted three-phase alternating-current power to the second MG 120.

As the rotary shaft 111 of the first MG 110 is rotated by external force, such as the running energy of the vehicle and the engine torque, the first MG 110 operates as a generator to generate electric power. When the first MG 110 is operating as a generator, the inverter 130 converts three-phase alternating-current power, which is generated by the first MG 110, to direct-current power, and charges the battery 140 with the converted direct-current power.

When the running energy of the vehicle is input to the first MG 110 as external force via the drive wheels 190, the wheel drive shaft 180, the power transmission device 160 and the power split device 150, the first MG 110 is able to supply regenerative braking force (regenerative braking torque) to the drive wheels 190.

As a rotary shaft 121 of the second MG 120 is rotated by the external force, the second MG 120 operates as a generator to generate electric power. When the second MG 120 is operating as a generator, the inverter 130 converts three-phase alternating-current power, which is generated by the second MG 120, to direct-current power, and charges the battery 140 with the converted direct-current power.

When the running energy of the vehicle is input to the second MG 120 as external force via the drive wheels 190, the wheel drive shaft 180 and the power transmission device 160, the second MG 120 is able to supply regenerative braking force (regenerative braking torque) to the drive wheels 190.

Configuration of Internal Combustion Engine

Figure 2:
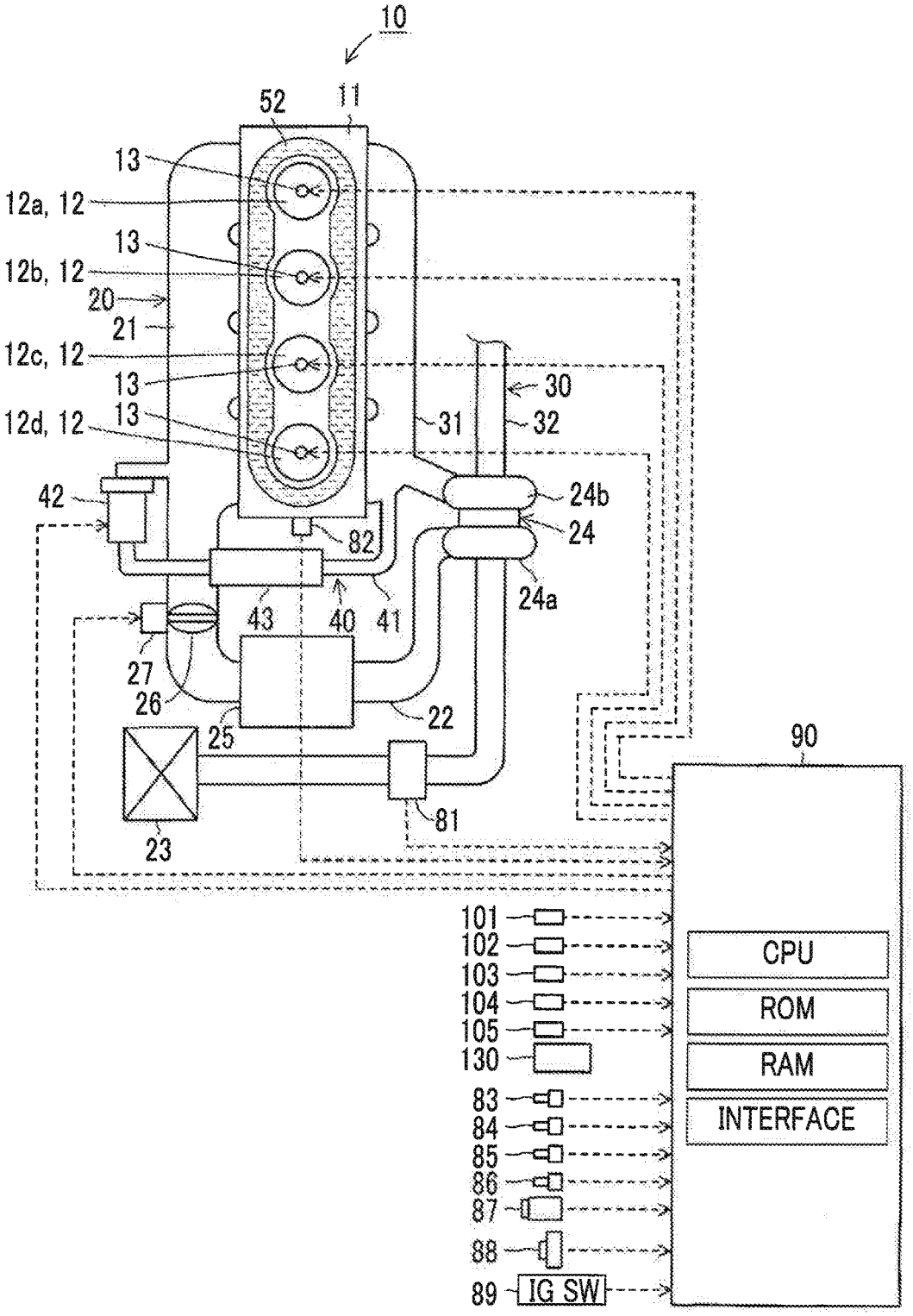
FIG. 2 is a diagram that shows the internal combustion engine shown in FIG. 1.

As shown in FIG. 2, the engine 10 includes an engine body 11, an intake system 20, an exhaust system 30, and an EGR system 40.

The engine body 11 includes a cylinder head 14 (see FIG. 3), a cylinder block (see FIG. 3), a crankcase, and the like. The engine body 11 has four cylinders (combustion chambers) 12*a*, 12*b*, 12*c*, 12*d*. A fuel injection valve (injector) 13 is disposed at the upper portion of each of the cylinders 12*a*, 12*b*, 12*c*, 12*d* (hereinafter, referred to as cylinders 12). Each fuel injection valve 13 is configured to open in response to a command from an electronic control unit (ECU) 90 (described later) and directly inject fuel into a corresponding one of the cylinders 12.

The intake system 20 includes an intake manifold 21, an intake pipe 22, an air cleaner 23, a compressor 24*a* of a turbocharger 24, an intercooler 25, a throttle valve 26, and a throttle valve actuator 27.

The intake manifold 21 includes branched portions and a collecting portion. The branched portions are connected to the cylinders 12, respectively. The collecting portion is a collection of the branched portions. The intake pipe 22 is connected to the collecting portion of the intake manifold 21. The intake manifold 21 and the intake pipe 22 define an intake passage. The air cleaner 23, the compressor 24*a*, the intercooler 25 and the throttle valve 26 are, arranged in the intake pipe 22 from the upstream of the flow of intake air toward the downstream of the flow in the stated order. The throttle valve actuator 27 is configured to change the opening degree of the throttle valve 26 in response to a command from the ECU 90.

The exhaust system 30 includes an exhaust manifold 31, an exhaust pipe 32, and turbine 24*b* of the turbocharger 24.

The exhaust manifold 31 includes branched portions and a collecting portion. The branched portions are connected to the cylinders 12, respectively. The collecting portion is a collection of the branched portions. The exhaust pipe 32 is connected to the collecting portion of the exhaust manifold 31. The exhaust manifold 31 and the exhaust pipe 32 define an exhaust passage. The turbine 24*b* is disposed in the exhaust pipe 32.

The EGR system 40 includes an exhaust gas recirculation pipe 41, an EGR control valve 42, and an EGR cooler 43.

The exhaust gas recirculation pipe 41 communicates the exhaust passage upstream of the turbine 24*b* (exhaust manifold 31) with the intake passage downstream of the throttle valve 26 (intake manifold 21). The exhaust gas recirculation pipe 41 defines an EGR gas passage.

The EGR control valve 42 is disposed in the exhaust gas recirculation pipe 41. The EGR control valve 42 changes the passage cross-sectional area of the EGR gas passage in response to a command from the ECU 90. Thus, the EGR control valve 42 is able to change the amount of exhaust gas (EGR gas) that is recirculated from the exhaust passage to the intake passage.

The EGR cooler 43 is disposed in the exhaust gas recirculation pipe 41. The EGR cooler 43 decreases the temperature of EGR gas passing through the exhaust gas recirculation pipe 41 with the use of coolant (described later).

Figure 3:
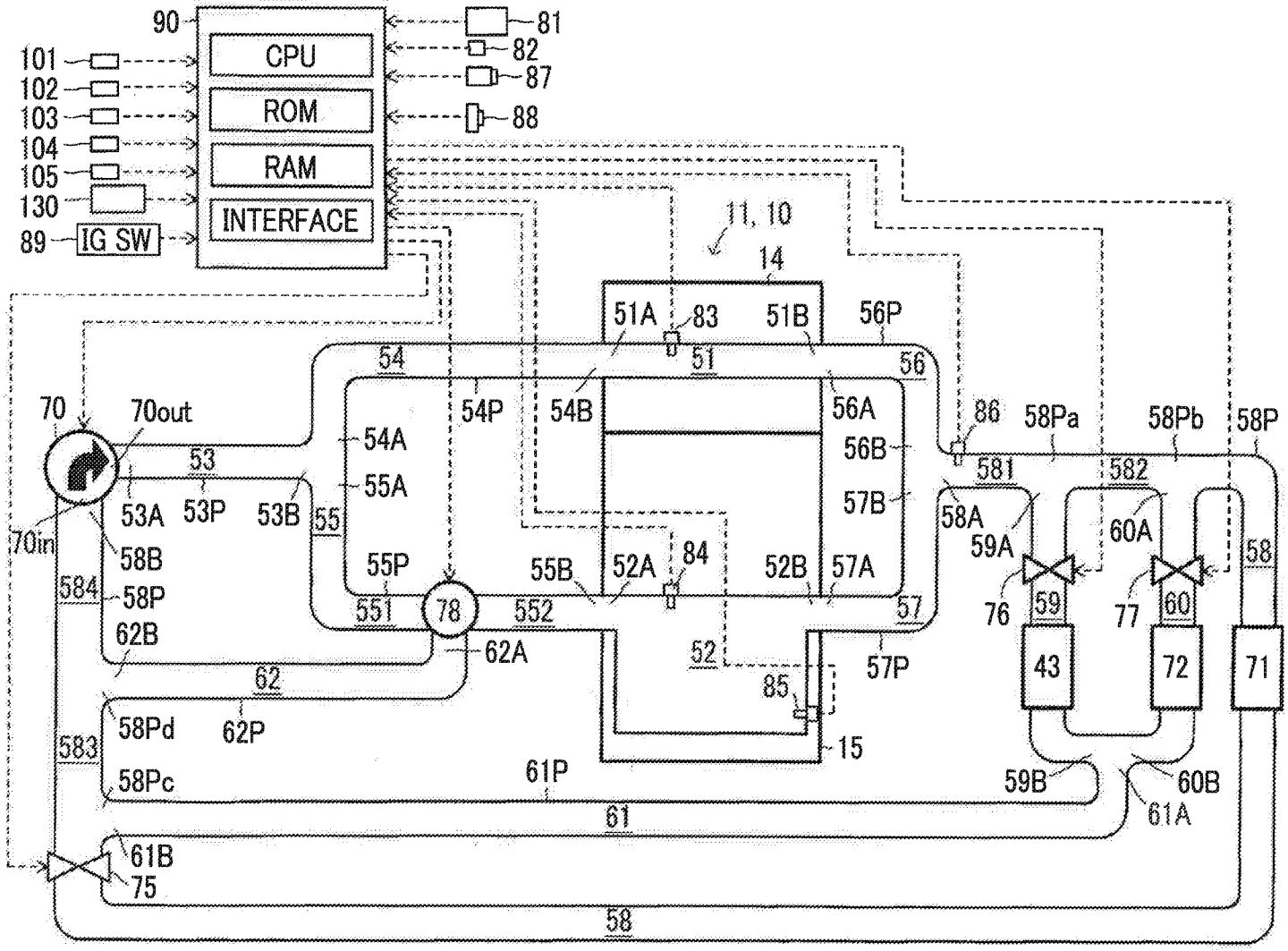
FIG. 3 is a diagram that shows the cooling system according to the embodiment.

As shown in FIG. 3, the engine body 11 of the internal combustion engine 10 includes the cylinder head 14 and the cylinder block 15. As is well known, the cylinder head 14 has a coolant passage 51 for passing coolant for cooling the cylinder head 14 (hereinafter, referred to as head coolant passage 51). The head coolant passage 51 is one of components of the cooling system. In the following description, coolant passages all mean passages for passing coolant.

As is well known, the cylinder block 15 has a coolant passage 52 for passing coolant for cooling the cylinder block 15 (hereinafter, referred to as block coolant passage 52). Particularly, the block coolant passage 52 runs from a location near the cylinder head 14 to a location remote from the cylinder head 14 so as to be able to cool cylinder bores that respectively define the cylinders 12. The block coolant passage 52 is one of the components of the cooling system.

The cooling system includes a pump 70. The pump 70 has an inlet port 70in for introducing coolant into the pump 70 (hereinafter, referred to as pump inlet port 70in) and an outlet port 70out for discharging introduced coolant from the pump 70 (hereinafter, referred to as pump outlet port 70out).

A coolant pipe 53P defines a coolant passage 53. A first end 53A of the coolant pipe 53P is connected to the pump outlet port 70out. Therefore, coolant discharged from the pump outlet port 70out flows into the coolant passage 53.

A coolant pipe 54P defines a coolant passage 54. A coolant pipe 55P defines a coolant passage 55. A first end 54A of the coolant pipe 54P and a first end 55A of the coolant pipe 55P are connected to a second end 53B of the coolant pipe 53P.

A second end 54B of the coolant pipe 54P is fixed to the cylinder head 14 such that the coolant passage 54 communicates with a first end 51A of the head coolant passage 51, A second end 55B of the coolant pipe 55P is fixed to the cylinder block 15 such that the coolant passage 55 communicates with a first end (an example of a third end) 52A of the block coolant passage 52.

A coolant pipe 56P defines a coolant passage 56. A first end 56A of the coolant pipe 56P is fixed to the cylinder head 14 such that the coolant passage 56 communicates with a second end 51B of the head coolant passage 51.

A coolant pipe 57P defines a coolant passage 57. A first end 57A of the coolant pipe 57P is fixed to the cylinder block 15 such that the coolant passage 57 communicates with a second end (an example of fourth end) 52B of the block coolant passage 52.

A coolant pipe 58P defines a coolant passage 58. A first end 58A of the coolant pipe 58P is connected to a second end 56B of the coolant pipe 56P and a second end 57B of the coolant pipe 57P. A second end 58B of the coolant pipe 58P is connected to the pump inlet port 70in. The coolant pipe 58P is disposed so as to pass through a radiator 71. Hereinafter, the coolant passage 58 is referred to as radiator coolant passage 58.

The radiator 71 exchanges heat between outside air and coolant passing through the radiator 71. Thus, the radiator 71 decreases the temperature of the coolant.

A shutoff valve 75 is disposed in the coolant pipe 58P between the radiator 71 and the pump 70. When the shutoff valve 75 is set in a valve open position, the shutoff valve 75 permits passage of coolant through the radiator coolant passage 58. When the shutoff valve 75 is set in a valve closed position, the shutoff valve 75 shuts off passage of coolant through the radiator coolant passage 58.

A coolant pipe 59P defines a coolant passage 59. A first end 59A of the coolant pipe 59P is connected to a portion 58Pa (hereinafter, referred to as first portion 58Pa) of the coolant pipe 58P between the first end 58A of the coolant pipe 58P and the radiator 71. The coolant pipe 59P is disposed so as to pass through the EGR cooler 43. Hereinafter, the coolant passage 59 is referred to as EGR cooler coolant passage 59.

A shutoff valve 76 is disposed in the coolant pipe 59P between the EGR cooler 43 and the first end 59A of the coolant pipe 59P. When the shutoff valve 76 is set in a valve open position, the shutoff valve 76 permits passage of coolant through the EGR cooler coolant passage 59. When the shutoff valve 76 is set in a valve closed position, the shutoff valve 76 shuts off passage of coolant through the EGR cooler coolant passage 59.

A coolant pipe 60P defines a coolant passage 60. A first end 60A of the coolant pipe 60P is connected to a portion 58Pb (hereinafter, referred to as second portion 58Pb) of the coolant pipe 58P between the first portion 58Pa of the coolant pipe 58P and the radiator 71. The coolant pipe 60P is disposed so as to pass through a heater core 72. Hereinafter, the coolant passage 60 is referred to as heater core coolant passage 60.

Hereinafter, a portion 581 of the radiator coolant passage 58 between the first end 58A of the coolant pipe 58P and the first portion 58Pa of the coolant pipe 58P is referred to as the first portion 581 of the radiator coolant passage 58, and a portion 582 of the radiator coolant passage 58 between the first portion 58Pa of the coolant pipe 58P and the second portion 58Pb of the coolant pipe 58P is referred to as the second portion 582 of the radiator coolant passage 58.

When the temperature of coolant that passes through the heater core 72 is higher than the temperature of the heater core 72, the heater core 72 is warmed by the coolant, and stores heat. The heat stored in the heater core 72 is utilized in order to heat the cabin of the vehicle 100 on which the engine 10 is mounted.

A shutoff valve 77 is disposed in the coolant pipe 60P between the heater core 72 and the first end 60A of the coolant pipe 60P. When the shutoff valve 77 is set in a valve open position, the shutoff valve 77 permits passage of coolant through the heater core coolant passage 60. When the shutoff valve 77 is set in a valve closed position, the shutoff valve 77 shuts off passage of coolant through the heater core coolant passage 60.

A coolant pipe 61P defines a coolant passage 61. A first end 61A of the coolant pipe 61P is connected to a second end 59B of the coolant pipe 59P and a second end 60B of the coolant pipe 60P. A second end 61B of the coolant pipe 61P is connected to a portion 58Pc (hereinafter, referred to as third portion 58Pc) of the coolant pipe 58P between the shutoff valve 75 and the pump inlet port 70in.

The coolant pipe 62P defines a coolant passage 62. A first end 62A of the coolant pipe 62P is connected to a selector valve 78. The selector valve 78 is disposed in the coolant pipe 55P. A second end 62B of the coolant pipe 62P is connected to a portion 58Pd (hereinafter, referred to as fourth portion 58Pd) of the coolant pipe 58P between the third portion 58Pc of the coolant pipe 58P and the pump inlet port 70in.

Hereinafter, a portion 551 of the coolant passage 55 between the selector valve 78 and the first end 55A of the coolant pipe 55P is referred to as the first portion 551 of the coolant passage 55, and a portion 552 of the coolant passage 55 between the selector valve 78 and the second end 55B of the coolant pipe 55P is referred to as the second portion 552 of the coolant passage 55. In addition, a portion 583 of the radiator coolant passage 58 between the third portion 58Pc of the coolant pipe 58P and the fourth portion 58Pd of the coolant pipe 58P is referred to as the third portion 583 of the radiator coolant passage 58, and a portion 584 of the radiator coolant passage 58 between the fourth portion 58Pd of the coolant pipe 58P and the pump inlet port 70in is referred to as the fourth portion 584 of the radiator coolant passage 58.

When the selector valve 78 is set in a first position (hereinafter, referred to as forward flow position), the selector valve 78 permits passage of coolant between the first portion 551 of the coolant passage 55 and the second portion 552 of the coolant passage 55, and shuts off passage of coolant between the first portion 551 and the coolant passage 62 and passage of coolant between the second portion 552 and the coolant passage 62.

On the other hand, when the selector valve 78 is set in a second position (hereinafter, referred to as reverse flow position), the selector valve 78 permits passage of coolant between the second portion 552 of the coolant passage 55 and the coolant passage 62, and shuts off passage of coolant between the first portion 551 of the coolant passage 55 and the coolant passage 62 and passage of coolant between the first portion 551 and the second portion 552.

Furthermore, when the selector valve 78 is set in a third position (hereinafter, referred to as shutoff position), the selector valve 78 shuts off passage of coolant between the first portion 551 and second portion 552 of the coolant passage 55, passage of coolant between the first portion 551 of the coolant passage 55 and the coolant passage 62 and passage of coolant between the second portion 552 of the coolant passage 55 and the coolant passage 62.

As described above, in the cooling system, the head coolant passage 51 is a first coolant passage provided in the cylinder head 14, and the block coolant passage 52 is a second coolant passage provided in the cylinder block 15. The coolant passage 53 and the coolant passage 54 constitute a third coolant passage that connects the first end 51A of the head coolant passage 51 (first coolant passage) to the pump outlet port 70out.

The coolant passage 53, the coolant passage 55, the coolant passage 62, the fourth portion 584 of the radiator coolant passage 58 and the selector valve 78 constitute a connection switching mechanism. The connection switching mechanism switches the status of pump connection between a forward flow connection state and a reverse flow connection state. The status of pump connection is the status of connection of the pump 70 to the first end 52A of the block coolant passage 52 (second coolant passage). In the forward flow connection state, the first end 52A of the block coolant passage 52 is connected to the pump outlet port 70out. In the reverse flow connection state, the first end 52A of the block coolant passage 52 is connected to the pump inlet port 70in.

The coolant passage 56 and the coolant passage 57 constitute a fourth coolant passage. The fourth coolant passage connects the second end 51B of the head coolant passage 51 (first coolant passage) to the second end 52B of the block coolant passage 52 (second coolant passage).

The radiator coolant passage 58 is a fifth coolant passage. The fifth coolant passage connects the coolant passage 56 and the coolant passage 57 (fourth coolant passage) to the pump inlet port 70in. The shutoff valve 75 shuts off or opens the radiator coolant passage 58 (fifth coolant passage).

The radiator 71 is disposed at a location at which coolant that flows out from the second end 51B of the head coolant passage 51 and that flows into the second end 52B of the block coolant passage 52 is not cooled, and at a location at which coolant that flows out from the second end 51B of the head coolant passage 51 and the second end 52B of the block coolant passage 52 is cooled.

Furthermore, the coolant passage 53 and the c plant passage 55 constitute a sixth coolant passage. The sixth coolant passage connects the first end 52A of the block coolant passage 52 (second coolant passage) to the pump outlet port 70out. The second portion 552 of the coolant passage 55, the coolant passage 62 and the fourth portion 584 of the radiator coolant passage 58 constitute a seventh coolant passage. The seventh coolant passage connects the first end 52A of the block coolant passage 52 (second coolant passage) to the pump inlet port 70in.

The selector valve 78 is selectively set in any one of the forward flow position and the reverse flow position. In the forward flow position, the selector valve 78 connects the first end 52A of the block coolant passage 52 (second coolant passage) to the pump outlet port 70out via the coolant passage 53 and the coolant passage 55 (sixth coolant passage). In the reverse flow position, the selector valve 78 connects the first end 52A of the block coolant passage 52 (second coolant passage) to the pump inlet port 70in via the second portion 552 of the coolant passage 55, the coolant passage 62 and the fourth portion 584 of the radiator coolant passage 58 (seventh coolant passage).

The cooling system includes the ECU 90. ECU is an abbreviation of electronic control unit. The ECU 90 is an electronic control circuit having a microcomputer as a main component. The microcomputer includes a CPU, a ROM, a RAM, an interface, and the like. The CPU implements various functions (described later) by executing instructions (routines) stored in a memory (ROM).

As shown in FIG. 2 and FIG. 3, the ECU 90 is connected to an air flow meter 81, a crank angle sensor 82, coolant temperature sensors 83, 84, 85, 86, an outside air temperature; sensor 87, a heater switch 88, and an ignition switch 89.

The air flow meter 81 is disposed in the intake pipe 22 upstream of the compressor 24*a* in an intake air flow direction. The air flow meter 81 measures a mass flow rate Ga of air that passes through the air flow meter 81, and transmits a signal indicating the mass flow rate Ga (hereinafter, referred to as intake air amount Ga) to the 5. ECU 90. The ECU 90 acquires the intake air amount Ga based on the signal. In addition, the ECU 90 acquires the amount ΣGa of air introduced into the cylinders 12*a*, 12*b*, 12*c*, 12*d* from a start of the engine 10 for the first time after the ignition switch 89 (described later) is set in an on position (hereinafter, referred to as post-start accumulated air amount ΣGa) based on the intake air amount Ga.

The crank angle sensor 82 is disposed in the engine body 11 in proximity to a crankshaft (not shown) of the engine 10. The crank angle sensor 82 is configured to output a pulse signal each time the crankshaft rotates a certain angle (in the present embodiment, 10°). The ECU 90 acquires a crank angle (absolute crank angle) of the engine 10 with reference to a compression top dead center of a predetermined one of the cylinders based on the pulse signal and a signal from a cam position sensor (not shown). In addition, the ECU 90 acquires an engine rotation speed NE based on the pulse signal from the crank angle sensor 82.

The coolant temperature sensor 83 is disposed in the cylinder head 14 so as to be able to detect the temperature TWhd of coolant in the head coolant passage 51. The coolant temperature sensor 83 detects the temperature TWhd of coolant, and transmits a signal indicating the temperature TWhd (hereinafter, referred to as head coolant temperature TWhd) to the ECU 90. The ECU 90 acquires the head coolant temperature TWhd based on the signal.

The coolant temperature sensor 84 is disposed in the cylinder block 15 so as to be able to detect the temperature TWbr_up of coolant in a region inside the block coolant passage 52 and near the cylinder head 14. The coolant temperature sensor 84 transmits a signal indicating the detected temperature TWbr_up of coolant (hereinafter, referred to as upper block coolant temperature TWbr_up) to the ECU 90. The ECU 90 acquires the upper block coolant temperature TWbr_up based on the signal.

The coolant temperature sensor 85 is disposed in the cylinder block 15 so as to be able to detect the temperature of coolant TWbr_low in a region inside the block coolant passage 52 and remote from the cylinder head 14. The coolant temperature sensor 85 transmits a signal indicating the detected temperature TWbr_low of coolant (hereinafter, referred to as lower block coolant temperature TWbr_low) to the ECU 90. The ECU 90 acquires the lower block coolant temperature TWbr_low based on the signal. In addition, the ECU 90 acquires a difference ΔTWbr (=TWbr_up−TWbr_low) between the upper block coolant temperature TWbr_up and the lower block coolant temperature TWbr_low.

The coolant temperature sensor 86 is disposed at a portion of the coolant pipe 58P, which defines the first portion 581 of the radiator coolant passage 58. The coolant temperature sensor 86 detects the temperature TWeng of coolant in the first portion 581 of the radiator coolant passage 58, and, transmits a signal indicating the temperature TWeng (hereinafter, referred to as engine coolant temperature TWeng) to the ECU 90. The ECU 90 acquires the engine coolant temperature TWeng based on the signal.

The outside air temperature sensor 87 detects the temperature Ta of outside air, and transmits a signal indicating the temperature Ta (hereinafter, referred to as outside air temperature Ta) to the ECU 90. The ECU 90 acquires the outside air temperature Ta based on the signal.

The heater switch 88 is operated by a driver of the vehicle 100 on which the engine 10 is mounted. As the heater switch 88 is set in an on position by the driver, the ECU 90 releases the heat of the heater core 72 into the cabin of the vehicle 100. On the other hand, as the heater switch 88 is set in an off position by the driver, the ECU 90 stops release of heat from the heater core 72 into the cabin of the vehicle 100.

The ignition switch 89 is operated by the driver of the vehicle 100. When an operation to set the ignition switch 89 in the on position (hereinafter, referred to as ignition on operation) has been performed by the driver, the engine 10 is allowed to be started. On the other hand, when the operation of the engine 10 (hereinafter, engine operation) is being performed at the time when an operation to set the ignition switch 89 in an off position (hereinafter, referred to as ignition off operation) has been performed by the driver, the engine operation is stopped.

The ECU 90 is connected to the throttle valve actuator 27, the EGR control valve 42, the pump 70, the shutoff valves 75, 76, 77, and the selector valve 78.

The ECU 90 sets a target value of the opening degree of the throttle valve 26 in response to an engine operation status that is determined based on an engine load KL and an engine rotation speed NE, and controls the operation of the throttle valve actuator 27 such that the opening degree of the throttle valve 26 coincides with the target value.

The ECU 90 sets a target value EGRtgt of the opening degree of the EGR control valve 42 (hereinafter, referred to as target EGR control valve opening degree EGRtgt) in response to the engine operation status, and controls the operation of the EGR control valve 42 such that the opening degree of the EGR control valve 42 coincides with the target EGR control valve opening degree EGRtgt.

Figure 4:
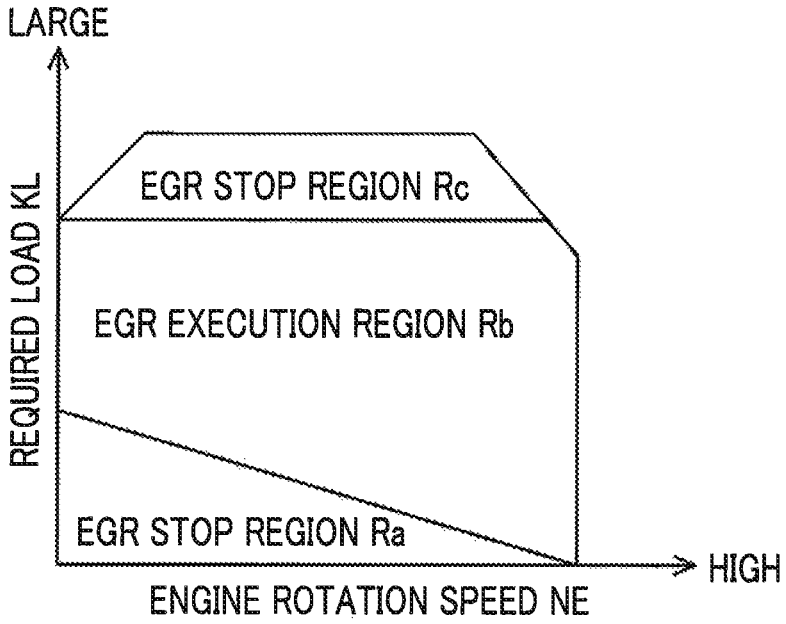
FIG. 4 is a map that is used in control over an EGR control valve shown in FIG. 2.

The ECU 90 stores a map shown in FIG. 4. When the engine operation status falls within an EGR stop region Ra or an EGR stop region Rc, the ECU 90 sets the target EGR control valve opening degree EGRtgt to zero. In this case, no EGR gas is supplied to the cylinders 12.

On the other hand, when the engine operation status falls within an EGR execution region Rb shown in FIG. 4, the ECU 90 sets the target EGR control valve opening degree EGRtgt to a value larger than zero in response to the engine operation status. In this case, EGR gas is supplied to the cylinders 12.

As will be described later, the ECU 90 controls the operations of the pump 70, shutoff valves 75, 76, 77 and selector valve 78 in response to the temperature Teng of the engine 10 (hereinafter, referred to as engine temperature Teng).

The ECU 90 is connected to an accelerator operation amount sensor 101, a vehicle speed sensor 102, a battery sensor 103, a first rotation angle sensor 104, and a second rotation angle sensor 105.

The accelerator operation amount sensor 101 detects an operation amount AP of an accelerator pedal (not shown), and transmits a signal indicating the operation amount AP (hereinafter, referred to as accelerator pedal operation amount AP) to the ECU 90. The ECU 90 acquires the accelerator pedal operation amount AP based on the signal.

The vehicle speed sensor 102 detects a speed V of the vehicle 100, and transmits a signal indicating the speed V (hereinafter, referred to as vehicle speed V) to the ECU 90. The ECU 90 acquires the vehicle speed V based on the signal.

The battery sensor 103 includes a current sensor, a voltage sensor, and a temperature sensor. The current sensor of the battery sensor 103 detects a current that flows into the battery 140 or a current that flows out from the battery 140, and transmits a signal indicating the current to the ECU 90. The voltage sensor of the battery sensor 103 detects the voltage of the battery 140, and transmits a signal indicating the voltage to the ECU 90. The temperature sensor of the battery sensor 103 detects the temperature of the battery 140, and transmits a signal indicating the temperature to the ECU 90.

The ECU 90 acquires the amount of electric power SOC charged in the battery 140 (hereinafter, referred to as battery state of charge SOC) with a known technique based on the signals transmitted from the current sensor, the voltage sensor and the temperature sensor.

The first rotation angle sensor 104 detects the rotation angle of the first MG 110, and transmits a signal indicating the rotation angle to the ECU 90. The ECU 90 acquires a rotation speed NM1 of the first MG 110 (hereinafter, referred to as first MG rotation speed NM1) based on the signal.

The second rotation angle sensor 105 detects the rotation angle of the second MG 120, and transmits a signal indicating the rotation angle to the ECU 90. The ECU 90 acquires a rotation angle NM2 of the second MG 120 (hereinafter, referred to as second MG rotation speed NM2) based on the signal.

The ECU 90 is connected to the inverter 130. The ECU 90 controls the operations of the first MG 110 and second MG 120 by controlling the inverter 130.

Outline of Operation of Cooling System

Next, the outline of the operation of the cooling system will be described. The cooling system executes any one of operation controls A, B, C, D, E, F, G, H, I, J, K, L, M, N, O (described later) in response to a warm-up status of the engine 10 (hereinafter, referred to as engine warm-up status), whether there is an EGR cooler coolant flow request (described later), and whether there is a heater core coolant flow request (described later).

Initially, a determination as to the engine warm-up status will be described. When an engine cycle number Cig after a start of the engine 10 (hereinafter, referred to as post-start engine cycle number Cig) is smaller than or equal to a predetermined post-start engine cycle number Cig_th, the cooling system determines whether the engine warm-up status is a cold state, a first half warm-up state, a second half warm-up state, or a warm-up completion state (hereinafter, these states are collectively referred to as cold state, and the like) based on the engine coolant temperature TWeng that correlates with the engine temperature Teng as will be described below. In the present embodiment, the predetermined post-start engine cycle number Cig_th is two to three cycles that correspond to a situation that the number of times of the expansion stroke in the engine 10 is eight to twelve.

The cold state is a state where the temperature Teng of the engine 10 (hereinafter, referred to as engine temperature Teng) is estimated to be lower than a predetermined threshold temperature Teng1 (hereinafter, referred to as first engine temperature Teng1).

The first half warm-up state is a state where the engine temperature Teng is estimated to be higher than or equal to the first engine temperature Teng1 and lower than a predetermined threshold temperature Teng2 (hereinafter, referred to as second engine temperature Teng2). The second engine temperature Teng2 is set to a temperature higher than the first engine temperature Teng1.

The second half warm-up state is a state where the engine temperature Teng is estimated to be higher than or equal to the second engine temperature Teng2 and lower than a predetermined threshold temperature Teng3 (hereinafter, referred to as third engine temperature Teng3). The third engine temperature Teng3 is set to a temperature higher than the second engine temperature Teng2.

The warm-up completion state is a state where the engine temperature Teng is estimated to be higher than or equal to the third engine temperature Teng3.

When the engine coolant temperature TWeng is lower than a predetermined threshold coolant temperature TWeng1 (hereinafter, referred to as first engine coolant temperature TWeng1), the cooling system determines that the engine warm-up status is the cold state.

On the other hand, when the engine coolant temperature TWeng is higher than or equal to the first engine coolant temperature TWeng1 and lower than a predetermined threshold coolant temperature TWeng2 (hereinafter, referred to as second engine coolant temperature TWeng2), the cooling system determines that the engine warm-up status is the first half warm-up state. The second engine coolant temperature TWeng2 is set to a temperature higher than the first engine coolant temperature TWeng1.

When the engine coolant temperature TWeng is higher than or equal to the second engine coolant temperature TWeng2 and lower than a predetermined threshold coolant temperature TWeng3 (hereinafter, referred to as third engine coolant temperature TWeng3), the cooling system determines that the engine warm-up status is the second half warm-up state. The third engine coolant temperature TWeng3 is set to a temperature higher than the second engine coolant temperature TWeng2.

In addition, when the engine coolant temperature TWeng is higher than or equal to the third engine coolant temperature TWeng3, the cooling system determines that the engine warm-up status is the warm-up completion state.

On the other hand, when the post-start engine cycle number Cig is larger than the predetermined post-start engine cycle number Cig_th, the cooling system determines which one of the cold state, and the like, the engine warm-up status is, based on at least four of the upper block coolant temperature TWbr_up that correlates with the engine temperature Teng, the head coolant temperature TWhd, the block coolant temperature difference ΔTWbr, the post-start accumulated air amount Ga and the engine coolant temperature TWeng, as will be described below.

Cold Condition

More specifically, when at least one of conditions C1, C2, C3, C4 described below is satisfied, the cooling system determines that the engine warm-up status is the cold state.

The condition C1 is a condition that the upper block coolant temperature TWbr_up is lower than or equal to a predetermined threshold coolant temperature TWbr_up1 (hereinafter, referred to as first upper block coolant temperature TWbr_up1). The upper block coolant temperature TWbr_up is a parameter that correlates with the engine temperature Teng. Therefore, by appropriately setting the first upper block coolant temperature TWbr_up1 and threshold coolant temperatures (described later), it is possible to determine which one of the cold state, and the like, the engine warm-up status is, based on the upper block coolant temperature TWbr_up.

The condition C2 is a condition that the head coolant temperature TWhd is lower than or equal to a predetermined threshold coolant temperature TWhd1 (hereinafter, referred to as first head coolant temperature TWhd1). The head coolant temperature TWhd is also a parameter that correlates with the engine temperature Teng. Therefore, by appropriately setting the first head coolant temperature TWhd1 and threshold coolant temperatures (described later), it is possible to determine which one of the cold state, and the like, the engine warm-up status is, based on the head coolant temperature TWhd.

The condition C3 is a condition that the post-start accumulated air amount ΣGa is smaller than or equal to a predetermined threshold air amount ΣGa1 (hereinafter, referred to as first air amount ΣGa1). As described above, the post-start accumulated air amount ΣGa is the amount of air introduced into the cylinders 12*a*, 12*b*, 12*c*, 12*d* from a start of the engine 10 for the first time after the ignition switch 89 is set in the on position. As the total amount of air introduced into the cylinders 12*a*, 12*b*, 12*c*, 12*d* increases, the total amount of fuel supplied from the fuel injection valves 13 to the cylinders 12*a*, 12*b*, 12*c*, 12*d* also increases. As a result, the total amount of heat generated in the cylinders 12*a*, 12*b*, 12*c*, 12*d* also increases. For this reason, before the post-start accumulated air amount ΣGa reaches a certain amount, the engine temperature Teng increases as the post-start accumulated air amount ΣGa increases. For this reason, the post-start accumulated air amount ΣGa is a parameter that correlates with the engine temperature Teng. Therefore, by appropriately setting the first air amount ΣGa1 and threshold air amounts (described later), it is possible to determine which one of the cold state, and the like, the engine warm-up status is, based on the post-start accumulated air amount ΣGa.

The condition C4 is a condition that the engine coolant temperature TWeng is lower than or equal to a predetermined threshold coolant temperature TWeng4 (hereinafter, referred to as fourth engine coolant temperature TWeng4). The engine coolant temperature TWeng is a parameter that correlates with the engine temperature Teng. Therefore, by appropriately setting the fourth engine coolant temperature TWeng4 and threshold coolant temperatures (described later), it is possible to determine which one of the cold state, and the like, the engine warm-up status is, based on the engine coolant temperature TWeng.

The cooling system may also be configured to, when at least two or three or all of the conditions C1, C2, C3, C4 are satisfied, determine that the engine warm-up status is the cold state.

First Half Warm-Up Condition

When at least one of conditions C5, C6, C7, C8, C9 described below is satisfied, the cooling system determines that the engine warm-up status is the first half warm-up state.

The condition C5 is a condition that the upper block coolant temperature TWbr_up is higher than the first upper block coolant temperature TWbr_up1 and lower than or equal to a predetermined threshold coolant temperature TWbr_up2 (hereinafter, referred to as second upper block coolant temperature TWbr_up2). The second upper block coolant temperature TWbr_up2 is set to a temperature higher than the first upper block coolant temperature TWbr_up1.

The condition C6 is a condition that the head coolant temperature TWhd is higher than the first head coolant temperature TWhd1 and lower than or equal to a predetermined threshold coolant temperature TWhd2 (hereinafter, referred to as second head coolant temperature TWhd2). The second head coolant temperature TWhd2 is set to a temperature higher than the first head coolant temperature TWhd1.

The condition C7 is a condition that the block coolant temperature difference ΔTWbr (=TWbr_up−Twbr_low) that is a difference between the upper block coolant temperature TWbr_up and the lower block coolant temperature TWbr_low is larger than a predetermined threshold ΔTWbrth. In the cold state just after the engine 10 has been started with the ignition on operation, the block coolant temperature difference ΔTWbr is not so large. In process in which the engine temperature Teng increases, as the engine warm-up status becomes the first half warm-up state, the block coolant temperature difference ΔTWbr temporarily increases, and, as the engine warm-up status becomes the second half warm-up state, the block coolant temperature difference ΔTWbr reduces. For this reason, the block coolant temperature difference ΔTWbr is a parameter that correlates with the engine temperature Teng, and is particularly a parameter that correlates with the engine temperature Teng at the time when the engine warm-up status is the first half warm-up state. Therefore, by appropriately setting the predetermined threshold ΔTWbrth, it is possible to determine whether the engine warm-up status is the first half warm-up state based on the block coolant temperature difference ΔTWbr.

The condition C8 is a condition that the post-start accumulated air amount Ga is larger than the first air amount ΣGa1 and smaller than or equal to a predetermined threshold air amount ΣGa2 (hereinafter, referred to as second air amount ΣGa2). The second air amount ΣGa2 is set to a value larger than the first air amount ΣGa1.

The condition C9 is a condition that the engine coolant temperature TWeng is higher than the fourth engine Coolant temperature TWeng4 and lower than or equal to a predetermined threshold coolant temperature TWeng5 (hereinafter, referred to as fifth engine coolant temperature TWeng5). The fifth engine coolant temperature TWeng5 is set to a temperature higher than the fourth engine coolant temperature TWeng4.

The cooling system may also be configured to, when at least two or three or four or all of the conditions C5, C6, C7, C8, C9 are satisfied, determine that the engine warm-up status is the first half warm-up state.

Second Half Warm-Up Condition

When at least one of conditions C10, C11, C12, C13 described below is satisfied, the cooling system determines that the engine warm-up status is the second half warm-up state.

The condition C10 is a condition that the upper block coolant temperature TWbr_up is higher than the second upper block coolant temperature TWbr_up2 and lower than or equal to a predetermined threshold coolant temperature TWbr_up3 (hereinafter, referred to as third upper block coolant temperature TWbr_up3). The third upper block coolant temperature TWbr_up3 is set to a temperature higher than the second upper block coolant temperature TWbr_up2.

The condition C11 is a condition that the head coolant temperature TWhd is higher than the second head coolant temperature TWhd2 and lower than or equal to a predetermined threshold coolant temperature TWhd3 (hereinafter, referred to as third head coolant temperature TWhd3). The third head coolant temperature TWhd3 is set to a temperature higher than the second head coolant temperature TWhd2.

The condition C12 is a condition that the post-start accumulated air amount ΣGa is larger than the second air amount ΣGa2 and smaller than or equal to a predetermined threshold air amount ΣGa3 (hereinafter, referred to as third air amount ΣGa3). The third air amount ΣGa3 is set to a value larger than the second air amount ΣGa2.

The condition C13 is a condition that the engine coolant temperature TWeng is higher than the fifth engine coolant temperature TWeng5 and lower than or equal to a predetermined threshold coolant temperature TWeng6 (hereinafter, referred to as sixth engine coolant temperature TWeng6). The sixth engine coolant temperature TWeng6 is set to a temperature higher than the fifth engine coolant temperature TWeng5.

The cooling system may also be configured to, when at least two or three or all of the conditions C10, C11, C12, C13 are satisfied, determine that the engine warm-up status is the second half warm-up state.

Warm-Up Completion Condition

When at least one of conditions C14, C15, C16, C17 described below is satisfied, the cooling system determines that the engine warm-up status is the warm-up completion state.

The condition C14 is a condition that the upper block coolant temperature TWbr_up is higher than the third upper block coolant temperature TWbr_up3. The condition C15 is a condition that the head coolant temperature TWhd is higher than the third head coolant temperature TWhd3. The condition C16 is a condition that the post-start accumulated air amount ΣGa is larger than the third air amount ΣGa3. The condition C17 is a condition that the engine coolant temperature TWeng is higher than the sixth engine coolant temperature TWeng6.

The cooling system may also be configured to, when at least two or three or all of the conditions C14, C15, C16, C17 are satisfied, determine that the engine warm-up status is the warm-up completion state.

EGR Cooler Coolant Flow Request

As described above, when the engine operation status falls within the EGR execution region Rb shown in FIG. 4, EGR gas is supplied to the cylinders 12. When EGR gas is supplied to the cylinders 12, it is desirable to supply coolant to the EGR cooler coolant passage 59 and cool EGR gas in the EGR cooler 43 with the use of the coolant.

Incidentally, when the temperature of coolant that passes through the EGR cooler 43 is too low, moisture in EGR gas can condense inside the exhaust gas recirculation pipe 41 and condensed water can be produced at the time when the EGR gas is cooled by the coolant. The condensed water can be a cause of corrosion of the exhaust gas recirculation pipe 41. Therefore, when the temperature of coolant is low, it is not desirable to supply coolant to the EGR cooler coolant passage 59.

When the engine coolant temperature TWeng is higher than a predetermined threshold coolant temperature TWeng7 (in the present embodiment, 60° C.; hereinafter, referred to as seventh engine coolant temperature TWeng7) while the engine operation status falls within the EGR execution region Rb, the cooling system determines that there is a request to supply coolant to the EGR cooler coolant passage 59 (hereinafter, referred to as EGR cooler coolant flow request).

Even when the engine coolant temperature TWeng is lower than or equal to the seventh engine coolant temperature TWeng7, but when the engine load KL is relatively large, the engine temperature Teng immediately increases. As a result, it is expected that the engine coolant temperature TWeng immediately becomes higher than the seventh engine coolant temperature TWeng7. Therefore, even when coolant is supplied to the EGR cooler coolant passage 59, the amount of condensed water produced is small, so it is presumable that there is a low possibility of corrosion of the exhaust gas recirculation pipe 41.

Even when the engine coolant temperature TWeng is lower than or equal to the seventh engine coolant temperature TWeng7 while the engine operation status falls within the EGR execution region Rb, but when the engine load KL is larger than or equal to a predetermined threshold load KLth, the cooling system determines that there is an EGR cooler coolant flow request. Therefore, when the engine coolant temperature TWeng is lower than or equal to the seventh engine coolant temperature TWeng7 while the engine operation status falls within the EGR execution region Rb and when the engine load KL is smaller than the threshold load KLth, the cooling system determines that there is no EGR cooler coolant flow request.

On the other hand, when the engine operation status falls within the EGR stop region Ra shown FIG. 4 or the EGR stop region Rc shown in FIG. 4, no EGR gas is supplied to the cylinders 12, so coolant does not need to be supplied to the EGR cooler coolant passage 59. When the engine operation status falls within the EGR stop region Ra shown in FIG. 4 or the EGR stop region Rc shown in FIG. 4, the cooling system determines that there is no EGR cooler coolant flow request.

Heater Core Coolant Flow Request

When coolant is passed through the heater core coolant passage 60, the heat of the coolant is drawn by the heater core 72, and the temperature of the coolant decreases. As a result, completion of warm-up of the engine 10 delays. On the other hand, when the outside air temperature Ta is relatively low, the temperature of the cabin of the vehicle 100 is also relatively low, so there is a high possibility that heating of the cabin is requested by occupants of the vehicle, including the driver (hereinafter, referred to as driver, and the like). Therefore, when the outside air temperature Ta is relatively low, even when completion of warm-up of the engine 10 delays, it is desirable to preliminarily increase the amount of heat stored in the heater core 72 by passing coolant through the heater core coolant passage 60 in preparation for the case where heating of the cabin is requested.

When the outside air temperature Ta is relatively low, even when the engine temperature Teng is relatively low, the cooling system determines that there is a request to supply coolant to the heater core coolant passage 60 (hereinafter, referred to as heater core coolant flow request) irrespective of the status of setting of the heater switch 88. However, when the engine temperature Teng is extremely low, even when the outside air temperature Ta is relatively low, the cooling system determines that there is no heater core coolant flow request.

More specifically, when the outside air temperature Ta is lower than or equal to a predetermined threshold temperature Tath (hereinafter, referred to as threshold temperature Tath), and when the engine coolant temperature TWeng is higher than a predetermined threshold coolant temperature TWeng8 (in the present embodiment, 10° C.; hereinafter, referred to as eighth engine coolant temperature TWeng8), the cooling system determines that there is a heater core coolant flow request.

On the other hand, when the engine coolant temperature TWeng is lower than or equal to the eighth engine coolant temperature TWeng8 while the outside air temperature Ta is lower than or equal to the threshold temperature Tath, the cooling system determines that there is no heater core coolant flow request.

When the outside air temperature Ta is relatively high, the temperature of the cabin is also relatively high, so there is a low possibility that heating of the cabin is requested by the driver, and the like. Therefore, when the outside air temperature Ta is relatively high, it is sufficient to preliminarily warm the heater core 2 by passing coolant through the heater core coolant passage 60 only when the engine temperature Teng is relatively high and the heater switch 88 is set in the on position.

When the engine temperature Teng is relatively high and the heater switch 88 is set in the on position while the outside air temperature Ta is relatively high, the cooling system determines that there is a heater core coolant flow request. On the other hand, when the engine temperature Teng is relatively low or the heater switch 88 is set in the off position while the outside air temperature Ta is relatively high, the cooling system determines that there is no heater core coolant flow request.

More specifically, when the heater switch 88 is set in the on position and the engine coolant temperature TWeng is higher than a predetermined threshold coolant temperature TWeng9 (in the present embodiment, 30° C.; hereinafter, referred to as ninth engine coolant temperature TWeng9) while the outside air temperature Ta is higher than the threshold temperature Tath, the cooling system determines that there is a heater core coolant flow request. The ninth engine coolant temperature TWeng9 is set to a temperature higher than the eighth engine coolant temperature TWeng8.

On the other hand, even when the outside air temperature Ta is higher than the threshold temperature Tath, but when the heater switch 88 is set in the off position or when the engine coolant temperature TWeng is lower than or equal to the ninth engine coolant temperature TWeng9, the cooling system determines that there is no heater core coolant flow request.

Next, operation controls that are executed by the cooling system over the pump 70, the shutoff valves 75, 76, 77 and the selector valve 78 (hereinafter, these are collectively referred to as pump 70, and the like) will be described. The cooling system executes any one of operation controls A, B, C, D, E, F, G, H, I, J, K, L, M, N, O as shown in FIG. 5 in response to which one of the cold state, and the like, the engine warm-up status is, whether there is an EGR cooler coolant flow request, and whether there is a heater core coolant flow request.

Cold Control

Initially, the operation controls over the pump 70, and the like, in the case where it is determined that the engine warm-up status is the cold state (cold control) will be described.

Operation Control A

As coolant is supplied to the head coolant passage 51 and the block coolant passage 52, the cylinder head 14 and the cylinder block 15 are cooled accordingly. Therefore, as in the case where the engine warm-up status is the cold state, when the temperature of the cylinder head 14 (hereinafter, referred to as head temperature Thd) and the temperature of the cylinder block 15 (hereinafter, referred to as block temperature Thr) are intended to increase, it is desirable not to supply coolant to the head coolant passage 51 or the block coolant passage 52. In addition, when there is neither EGR cooler coolant flow request nor heater core coolant flow request, coolant does not need to be supplied to any of the EGR cooler coolant passage 59 and the heater core coolant passage 60.

The cooling system executes the operation control A. In the operation control A, the pump 70 is not operated when there is neither EGR cooler coolant flow request nor heater core coolant flow request while the engine warm-up status is the cold state, or the operation of the pump 70 is stopped when the pump 70 is in operation. In this case, the set position of each of the shutoff valves 75, 76, 77 may be any of the valve open position and the valve closed position, and the set position of the selector valve 78 may be any of the forward flow position, the reverse flow position and the shutoff position.

With the operation control A, no coolant is supplied to the head coolant passage 51 or the block coolant passage 52. Therefore, in comparison with the case where coolant cooled by the radiator 71 is supplied to the head coolant passage 51 and the block coolant passage 52, it is possible to increase the head temperature Thd and the block temperature Tbr at a high rate.

Operation Control B

Figure 6:
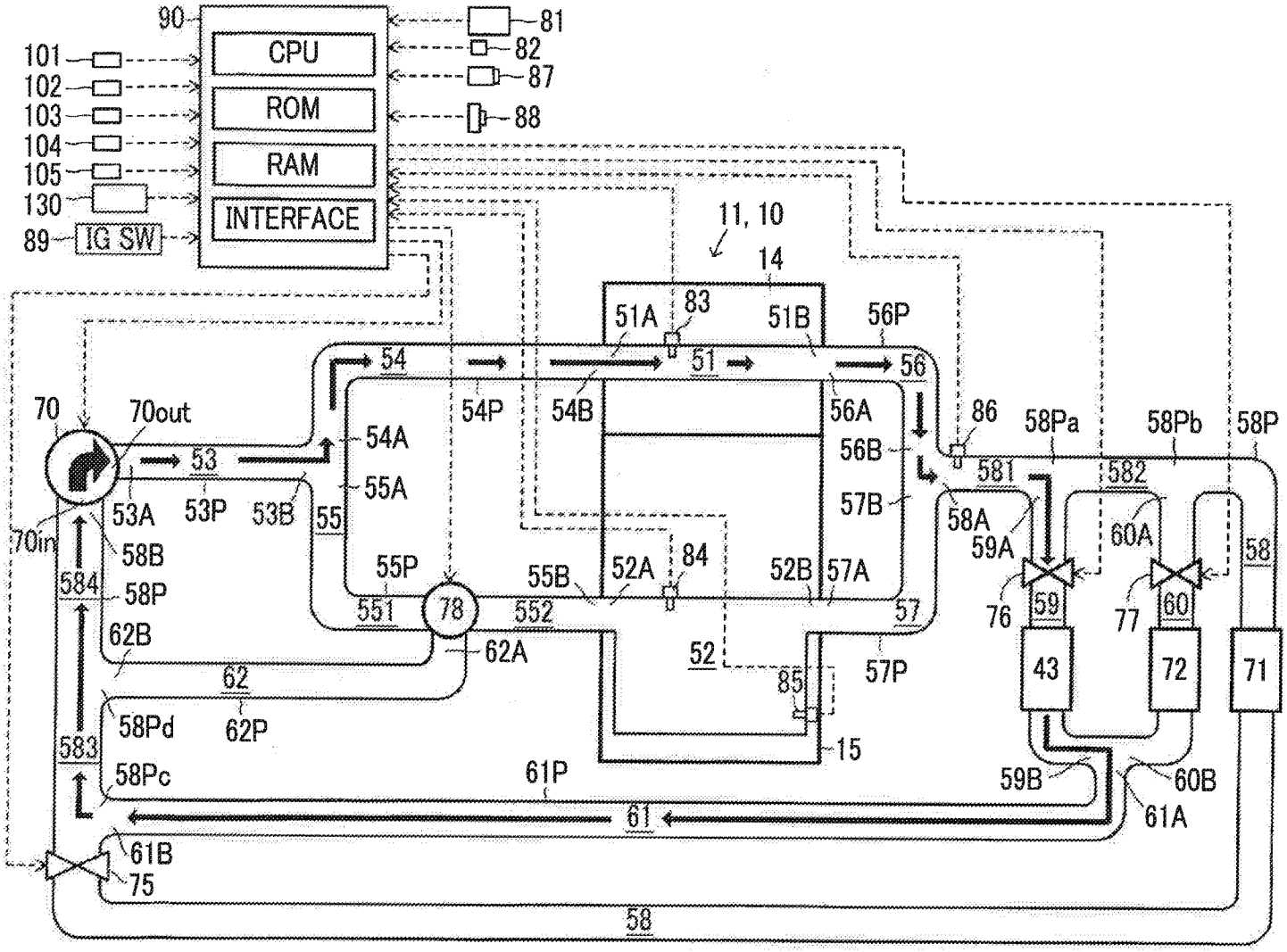
FIG. 6 is a diagram similar to that of FIG. 3 and is a diagram that shows a flow of coolant when the cooling system executes operation control B.

On the other hand, when there is an EGR cooler coolant flow request, it is desired to supply coolant to the EGR cooler 43. When there is an EGR cooler coolant flow request and there is no heater core coolant flow request while the engine warm-up status is the cold state, the cooling system executes the operation control B. In the operation control B, the pump 70 is operated, and the shutoff valves 75, 77 each are set in the valve closed position, the shutoff valve 76 is set in the valve open position and the selector valve 78 is set in the shutoff position such that coolant circulates as indicated by the arrows in FIG. 6.

Thus, coolant discharged from the pump outlet port 70out to the coolant passage 53 flows into the head coolant passage 51 via the coolant passage 54. The coolant flows through the head coolant passage 51, and then flows into the EGR cooler coolant passage 59 via the coolant passage 56 and the radiator coolant passage 58. The coolant passes through the EGR cooler 43, then flows through the coolant passage 61 and the third portion 583 and fourth portion 584 of the radiator coolant passage 58 sequentially, and is introduced into the pump 70 from the pump inlet port 70in.

With the operation control B, no coolant is supplied to the block coolant passage 52. On the other hand, coolant is supplied to the head coolant passage 51, but the coolant is not cooled by the radiator 71. Therefore, in comparison with the case where coolant cooled by the radiator 71 is supplied to the head coolant passage 51 and the block coolant passage 52, it is possible to increase the head temperature Thd and the block temperature Tbr at a high rate.

In addition, since coolant is supplied to the EGR cooler coolant passage 59, it is possible to achieve supply of coolant in response to the EGR cooler coolant flow request.

Operation Control C

Figure 7:
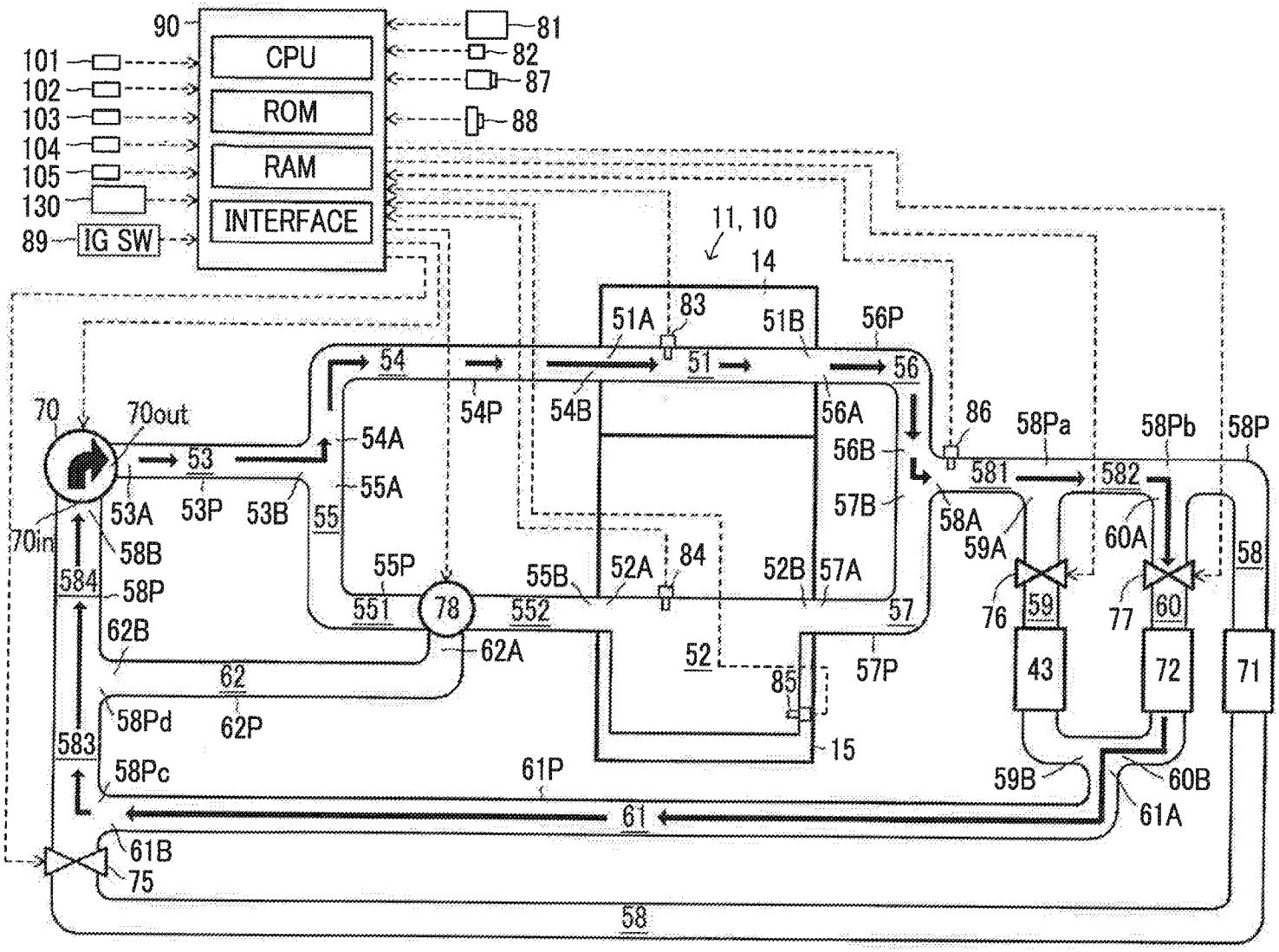
FIG. 7 is a diagram similar to that of FIG. 3 and is a diagram that shows a flow of coolant when the cooling system executes operation control C.

Similarly, when there is a heater core coolant flow request, it is desired to supply coolant to the heater core 72. When there is no EGR cooler coolant flow request and there is a heater core coolant flow request while the engine warm-up status is the cold state, the cooling system executes the operation control C. In the operation control C, the pump 70 is operated, and the shutoff valves 75, 76 each are set in the valve closed position, the shutoff valve 77 is set in the valve open position and the selector valve 78 is set in the shutoff position such that coolant circulates as indicated by the arrows in FIG. 7.

Thus, coolant discharged from the pump outlet port 70out to the coolant passage 53 flows into the head coolant passage 51 via the coolant passage 54. The coolant flows through the head coolant passage 51, and then flows into the heater core coolant passage 60 via the coolant passage 56 and the radiator coolant passage 58. The coolant passes through the heater core 72, then flows through the coolant passage 61 and the third portion 583 and fourth portion 584 of the radiator coolant passage 58 sequentially, and is introduced into the pump 70 from the pump inlet port 70in.

With the operation control C, as well as the operation control B, no coolant is supplied to the block coolant passage 52, while coolant is supplied to the head coolant passage 51, but the coolant is not cooled by the radiator 71. Therefore, as in the case of the operation control B, it is possible to increase the head temperature Thd and the block temperature Tbr at a high rate.

In addition, since coolant is supplied to the heater core coolant passage 60, it is possible to achieve supply of coolant in response to the heater core coolant flow request.

Operation Control D

Figure 8:
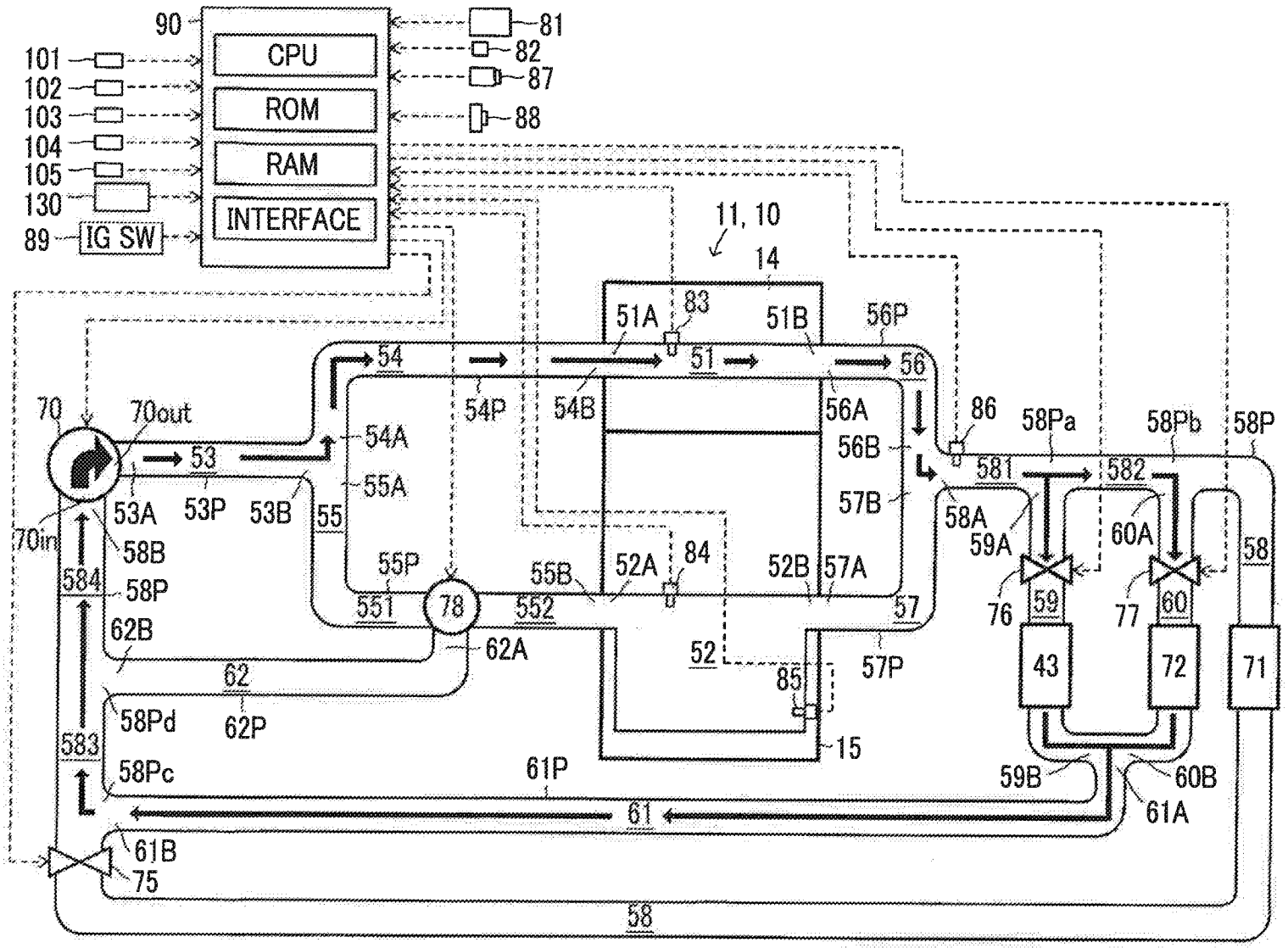
FIG. 8 is a diagram similar to that of FIG. 3 and is a diagram that shows a flow of coolant when the cooling system executes operation control D.

When there are both EGR cooler coolant flow request and heater core coolant flow request while the engine warm-up status is the cold state, the cooling system executes the operation control D. In the operation control D, the pump 70 is operated, and the shutoff valve 75 is set in the valve closed position, the shutoff valves 76, 77 each are set in the valve open position and the selector valve 78 is set in the shutoff position such that coolant circulates as indicated by the arrows in FIG. 8.

Thus, coolant discharged from the pump outlet port 70out to the coolant passage 53 flows into the head coolant passage 51 via the coolant passage 54. The coolant flows through the head coolant passage 51 and then flows into the EGR cooler coolant passage 59 and the heater core coolant passage 60 via the coolant passage 56 and the radiator coolant passage 58.

Coolant flowing into the EGR cooler coolant passage 59 passes through the EGR cooler 43, then flows through the coolant passage 61 and the third portion 583 and fourth portion 584 of the radiator coolant passage 58 sequentially, and is then introduced into the pump 70 from the pump inlet port 70in. On the other hand, coolant flowing into the heater core coolant passage 60 passes through the heater core 72, then flows through the coolant passage 61 and the third portion 583 and fourth portion 584 of the radiator coolant passage 58 sequentially, and is introduced into the pump 70 from the pump inlet port 70in.

With the operation control D, similar advantageous effects to the advantageous effects described in connection with the operation control B and the operation control C are obtained.

First Warm-Up Pre-Completion Control

Next, the operation controls over the pump 70, and the like, in the case where it is determined that the engine warm-up status is the first half warm-up state (first warm-up pre-completion control) will be described.

Operation Control E

When the engine warm-up status is the first half warm-up state, there is a request to increase the head temperature Thd and the block temperature Tbr at a high rate. When there is neither EGR cooler coolant flow request nor heater core coolant flow request at this time, and when the cooling system responds to only the above request, the cooling system just needs to execute the operation control A as in the case where the engine warm-up status is the cold state.

However, the head temperature Thd and the block temperature Tbr in the case where the engine warm-up status is the first half warm-up state are respectively higher than the head temperature Thd and the block temperature Tbr in the case where the engine warm-up status is the cold state. Therefore, when the cooling system executes the operation control A, coolant in the head coolant passage 51 and the block coolant passage 52 do not flow, and stagnate. As a result, the temperature of coolant in the head coolant passage 51 and the block coolant passage 52 can be partially extremely high. For this reason, a boil of coolant can occur in the head coolant passage 51 and the block coolant passage 52.

When there is neither EGR cooler coolant flow request nor heater core coolant flow request while the engine warm-up status is the first half warm-up state, the cooling system executes the operation control E. In the operation control E, the pump 70 is operated, and the shutoff valves 75, 76, 77 are set in the valve closed position and the selector valve 78 is set in the reverse flow position such that coolant circulates as indicated by the arrows in FIG. 9.

Thus, coolant discharged from the pump outlet port 70out to the coolant passage 53 flows into the head coolant passage 51 via the coolant passage 54. The coolant flows through the head coolant passage 51 and then flows into the block coolant passage 52 via the coolant passage 56 and the coolant passage 57. The coolant flows through the block coolant passage 52, then flows through the second portion 552 of the coolant passage 55, the coolant passage 62 and the fourth portion 584 of the radiator coolant passage 58 sequentially, and is introduced into the pump 70 from the pump inlet port 70in.

With the operation control E, coolant flowing through the head coolant passage 51 and having a high temperature is directly supplied to the block coolant passage 52 without passing through any of the radiator 71, the EGR cooler 43 and the heater core 72 (hereinafter, these are collectively referred to as radiator 71, and the like). For this reason, in comparison with the case where coolant that has passed through any of the radiator 71, and the like, is supplied to the block coolant passage 52, it is possible to increase the block temperature Tbr at a high rate.

Since coolant that has not passed through any of the radiator 71, and the like, is also supplied to the head coolant passage 51, in comparison with the case where coolant that has passed through any of the radiator 71, and the like, is supplied to the head coolant passage 51, it is possible to increase the head temperature Thd at a high rate.

In addition, since coolant flows through the head coolant passage 51 and the block coolant passage 52, it is possible to prevent the temperature of coolant from becoming partially extremely high in the head coolant passage 51 or the block coolant passage 52. As a result, it is possible to prevent a boil of coolant in the head coolant passage 51 or the block coolant passage 52.

Operation Control F

Figure 10:
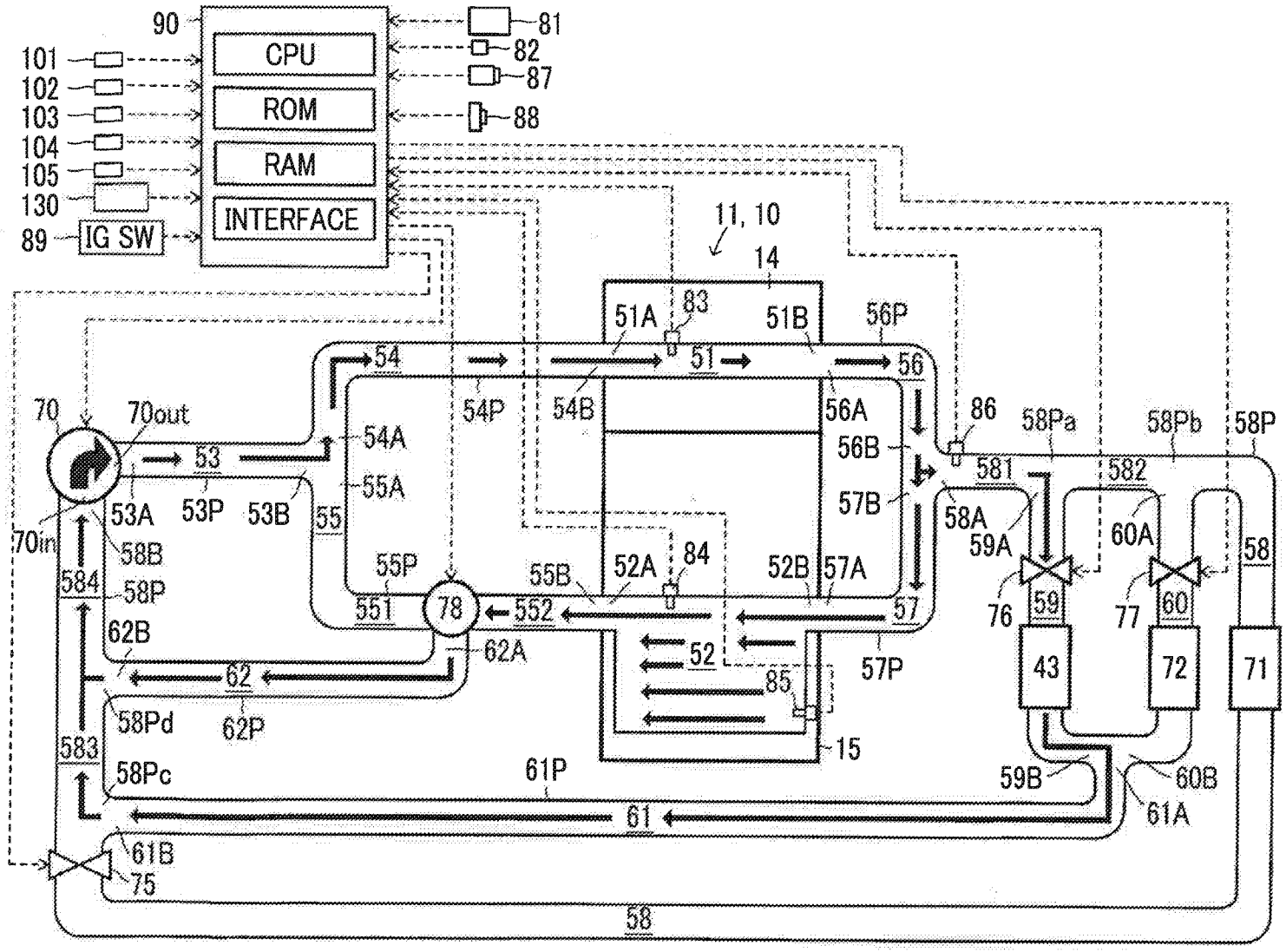
FIG. 10 is a diagram similar to that of FIG. 3 and is a diagram that shows a flow of coolant when the cooling system executes operation control F.

On the other hand, when there is an EGR cooler coolant flow request and there is no heater core coolant flow request while the engine warm-up status is the first half warm-up state, the cooling system executes the operation control F. In the operation control F, the pump 70 is operated, and the shutoff valves 75, 77 each are set in the valve closed position, the shutoff valve 76 is set in the valve open position and the selector valve 78 is set in the reverse flow position such that coolant circulates as indicated by the arrows in FIG. 10.

Thus, coolant discharged from the pump outlet port 70out to the coolant passage 53 flows into the head coolant passage 51 via the coolant passage 54.

Part of coolant flowing into the head coolant passage 51 flows through the head coolant passage 51, and then flows into the block coolant passage 52 via the coolant passage 56 and the coolant passage 57. The coolant flows through the block coolant passage 52, then flows through the second portion 552 of the coolant passage 55, the coolant passage 62 and the fourth portion 584 of the radiator coolant passage 58, and is introduced into the pump 70 from the pump inlet port 70in.

On the other hand, the remaining part of coolant flowing into the head coolant passage 51 flows into the EGR cooler coolant passage 59 via the coolant passage 56 and the radiator coolant passage 58. The coolant passes through the EGR cooler 43, then flows through the coolant passage 61 and the third portion 583 and fourth portion 584 of the radiator coolant passage 58 sequentially, and is introduced into the pump 70 from the pump inlet port 70in.

With the operation control F, coolant flowing through the head coolant passage 51 and having a high temperature is directly supplied to the block coolant passage 52 without passing through the radiator 71. For this reason, in comparison with the case where coolant that has passed through the radiator 71 is supplied to the block coolant passage 52, it is possible to increase the block temperature Tbr at a high rate.

Since coolant that has not passed through the radiator 71 is also supplied to the head coolant passage 51, in comparison with the case where coolant that has passed through the radiator 71 is supplied to the head coolant passage 51, it is possible to increase the head temperature Thd at a high rate.

In addition, since coolant is supplied to the EGR cooler coolant passage 59, it is also possible to achieve supply of coolant in response to the EGR cooler coolant flow request.

Since coolant flows through the head coolant passage 51 and the block coolant passage 52, it is possible to prevent a boil of coolant in the head coolant passage 51 or the block coolant passage 52 as in the case of the operation control E.

Operation Control G

Figure 11:
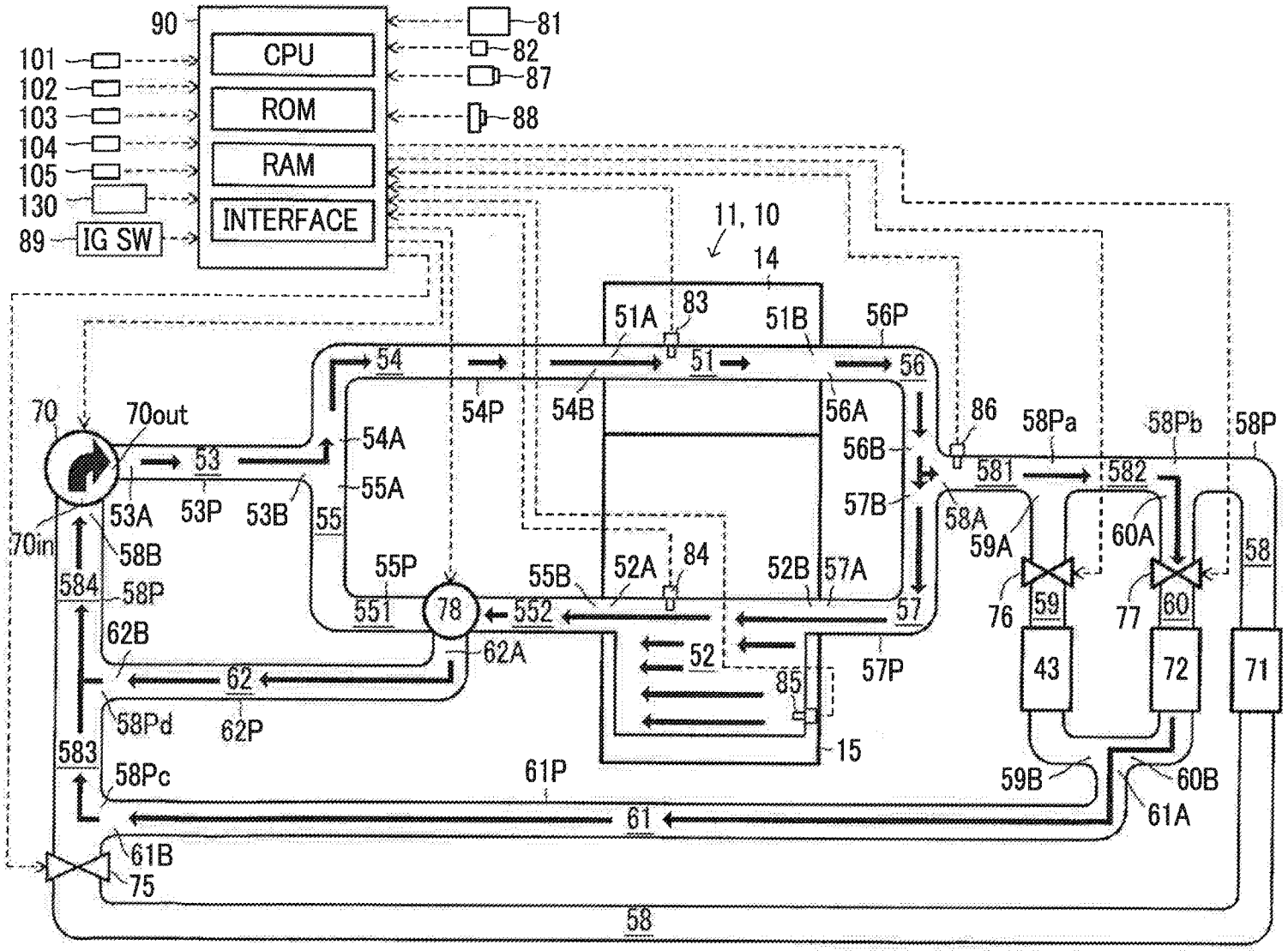
FIG. 11 is a diagram similar to that of FIG. 3 and is a diagram that shows a flow of coolant when the cooling system executes operation control G.

When there is no EGR cooler coolant flow request and there is a heater core coolant flow request while the engine warm-up status is the first half warm-up state, the cooling system executes the operation control G in the operation control the pump 70 is operated, and the shutoff valves 75, 76 each are set in the valve closed position, the shutoff valve 77 is set in the valve open position and the selector valve 78 is set in the reverse flow position such that coolant circulates as indicated by the arrows in FIG. 11.

Thus, coolant discharged from the pump outlet port 70out to the coolant passage 53 flows into the head coolant passage 51 via the coolant passage 54.

Part of coolant flowing into the head coolant passage 51 flows through the head coolant passage 51, and then directly flows into the block coolant passage 52 via the coolant passage 56 and the coolant passage 57. The coolant flows through the block coolant passage 52, then flows through the second portion 552 of the coolant passage 55, the coolant passage 62 and the fourth portion 584 of the radiator coolant passage 58 sequentially, and is introduced into the pump 70 from the pump inlet port 70in.

On the other hand, the remaining part of coolant flowing into the head coolant passage 51 flows into the heater core coolant passage 60 via the coolant passage 56 and the radiator coolant passage 58. The coolant passes through the heater core 72, flows through the coolant passage 61 and the third portion 583 and fourth portion 584 of the radiator coolant passage 58 sequentially, and is introduced into the pump 70 from the pump inlet port 70in.

With the operation control G coolant flowing through the head coolant passage 51 and having a high temperature is directly supplied to the block coolant passage 52 without passing through the radiator 71. For this reason, as in the case of the operation control F, it is possible to increase the block temperature Tbr at a high rate. Since coolant that has not passed through the radiator 71 is also supplied to the head coolant passage 51, it is possible to increase the head temperature Thd at a high rate as in the case of the operation control F. In addition, since coolant is supplied to the heater core coolant passage 60, it is possible to achieve supply of coolant in response to the heater core coolant flow request.

Since coolant flows through the head coolant passage 51 and the block coolant passage 52, it is possible to prevent a boil of coolant in the head coolant passage 51 or the block coolant passage 52 as in the case of the operation control E.

Operation Control H

Figure 12:
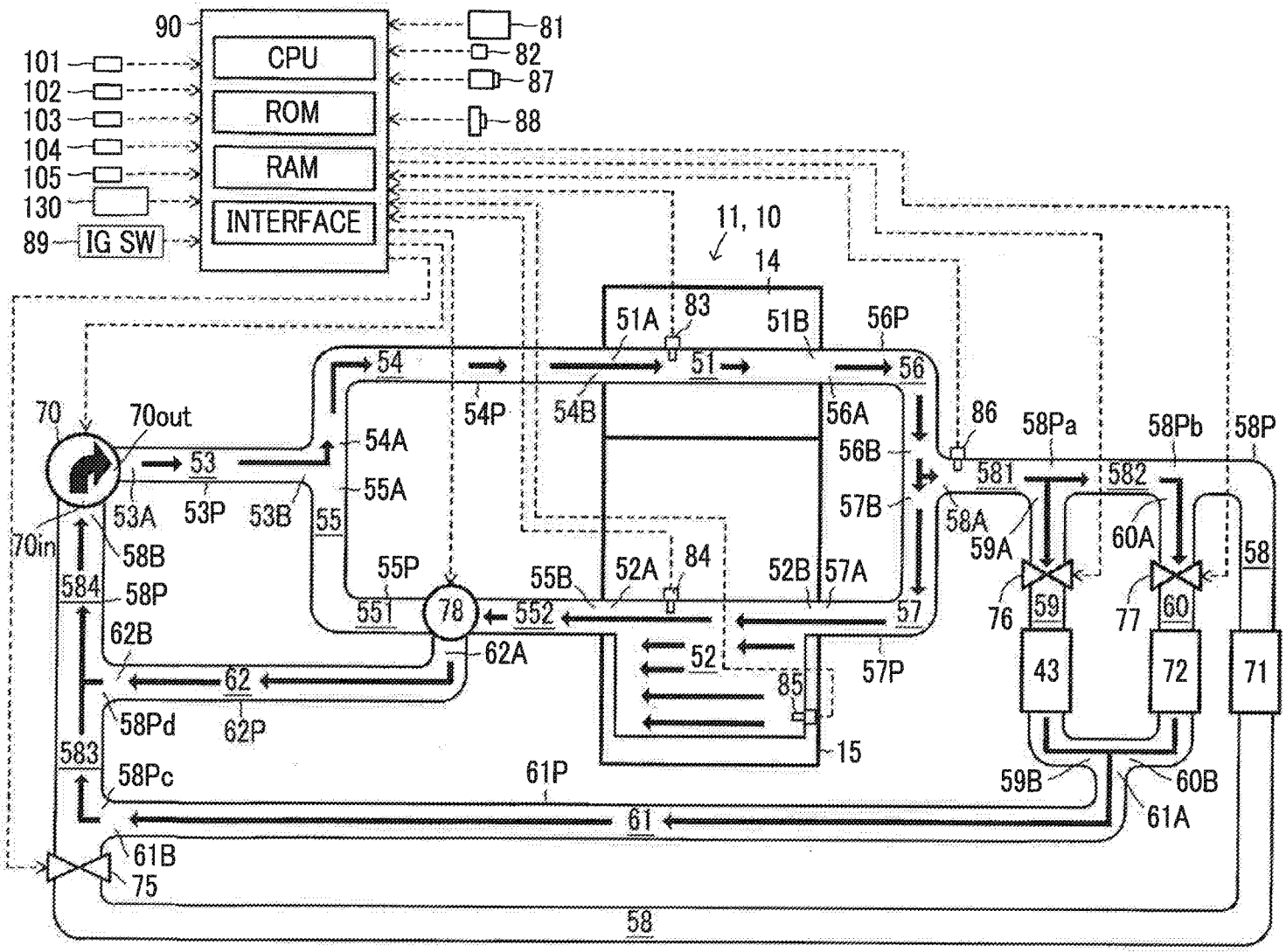
FIG. 12 is a diagram similar to that of FIG. 3 and is a diagram that shows a flow of coolant when the cooling system executes operation control H.

In addition, when there are both EGR cooler coolant flow request and heater core coolant flow request while the engine warm-up status is the first half warm-up state, the cooling system executes the operation control H. In the operation control the pump 70 is operated, and the shutoff valve 75 is set in the valve closed position, the shutoff valves 76, 77 each are set in the valve open position and the selector valve 78 is set in the reverse flow position such that coolant circulates as indicated by the arrows in FIG. 12.

Thus, coolant discharged from the pump outlet port 70out to the coolant passage 53 flows into the head coolant passage 51 via the coolant passage 54.

Part of coolant flowing into the head coolant passage 51 flows through the head coolant passage 51, and then directly flows into the block coolant passage 52 via the coolant passage 56 and the coolant passage 57. The coolant flows through the block coolant passage 52, then flows through the second portion 552 of the coolant passage 55, the coolant passage 62 and the fourth portion 584 of the radiator coolant passage 58 sequentially, and is introduced into the pump 70 from the pump inlet port 70in.

On the other hand, the remaining part of coolant flowing into the head coolant passage 51 flows into the EGR cooler coolant passage 59 or the heater core coolant passage 60 via the coolant passage 56 and the radiator coolant passage 58. Coolant flowing into the EGR cooler coolant passage 59 passes through the EGR cooler 43, flows through the coolant passage 61 and the third portion 583 and fourth portion 584 of the radiator coolant passage 58 sequentially, and is introduced into the pump 70 from the pump inlet port 70in. On the other hand, coolant flowing into the heater core coolant passage 60 passes through the heater core 72, then flows through the coolant passage 61 and the third portion 583 and fourth portion 584 of the radiator coolant passage 58, and is introduced into the pump 70 from the pump inlet port 70in.

With the operation control H, similar advantageous effects to the advantageous effects described in connection with the operation control F and the operation control G are obtained.

Second Warm-Up Pre-Completion Control

Next, the operation controls over the pump 70, and the like, in the case where it is determined that the engine warm-up status is the second half warm-up state (second warm-up pre-completion control) will be described.

Operation Control E

When the engine warm-up status is the second half warm-up state, there is a request to increase the head temperature Thd and the block temperature Tbr. When there is neither EGR cooler coolant flow request nor heater core coolant flow request, and when the cooling system responds to only the above request, the cooling system just needs to execute the operation control A as in the case where the engine warm-up status is the cold state.

However, the block temperature Tbr in the case where the engine warm-up status is the second half warm-up state is higher than the block temperature Thr in the case where the engine warm-up status is the cold state. Therefore, when the cooling system executes the operation control A, coolant in the head coolant passage 51 and coolant in the block coolant passage 52 do not flow, and stagnate. As a result, the temperature of coolant in the head coolant passage 51 or the block coolant passage 52 can be partially extremely high. For this reason, a boil of coolant can occur in the head coolant passage 51 or the block coolant passage 52.

Figure 9:
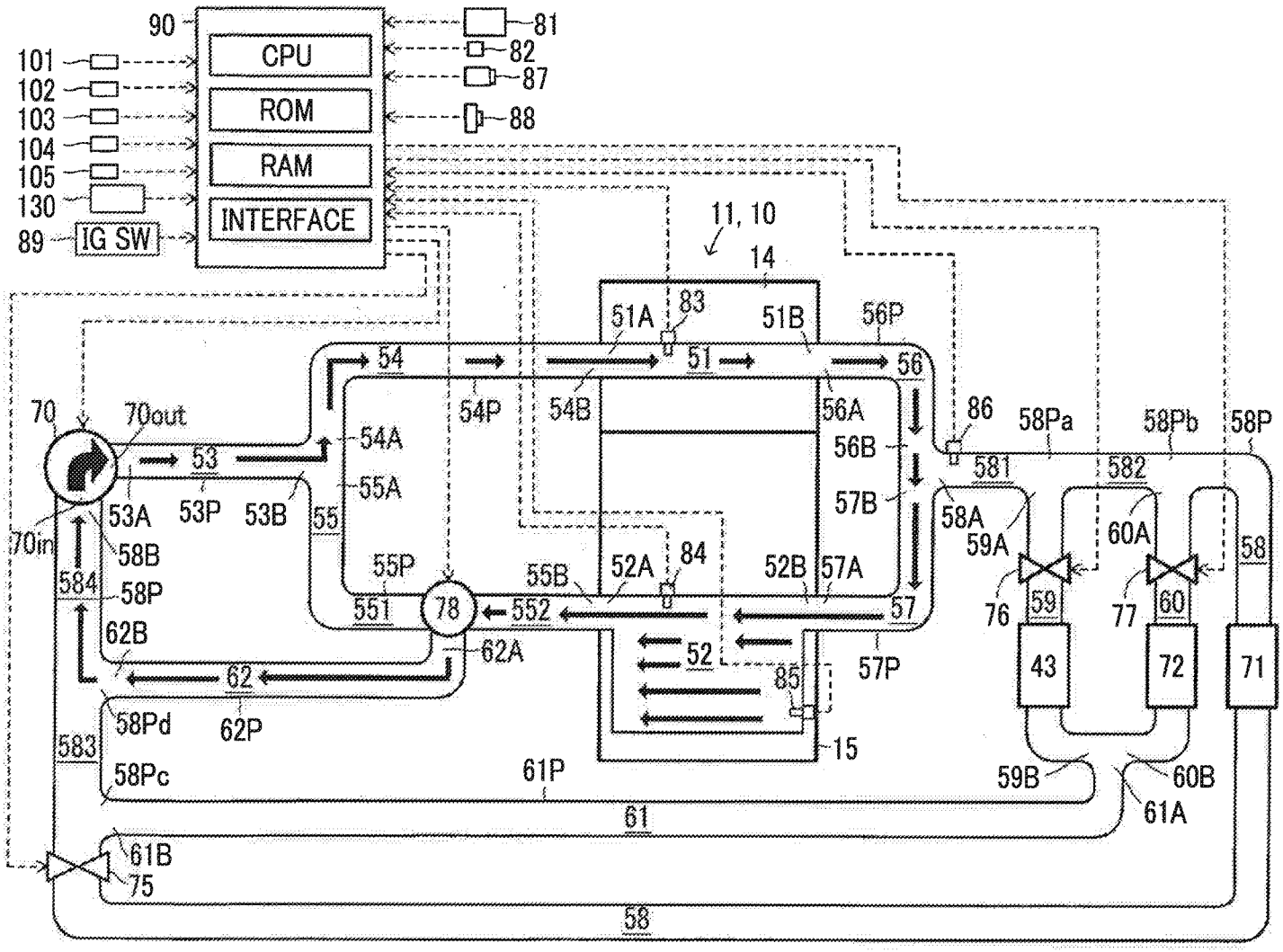
FIG. 9 is a diagram similar to that of FIG. 3 and is a diagram that shows a flow of coolant when the cooling system executes operation control E.

When there is neither EGR cooler coolant flow request nor heater core coolant flow request while the engine warm-up status is the second half warm-up state, the cooling system executes the operation control F (see FIG. 9).

With this configuration, as described in connection with the operation control E above, it is possible to increase the block temperature Tbr and the head temperature Thd at a high rate.

Since coolant flows through the head coolant passage 51 and the block coolant passage 52, it is possible to prevent the temperature of coolant from becoming partially extremely high in the head coolant passage 51 or the block coolant passage 52. As a result, it is possible to prevent a boil of coolant in the head coolant passage 51 or the block coolant passage 52.

Operation Control I

Figure 13:
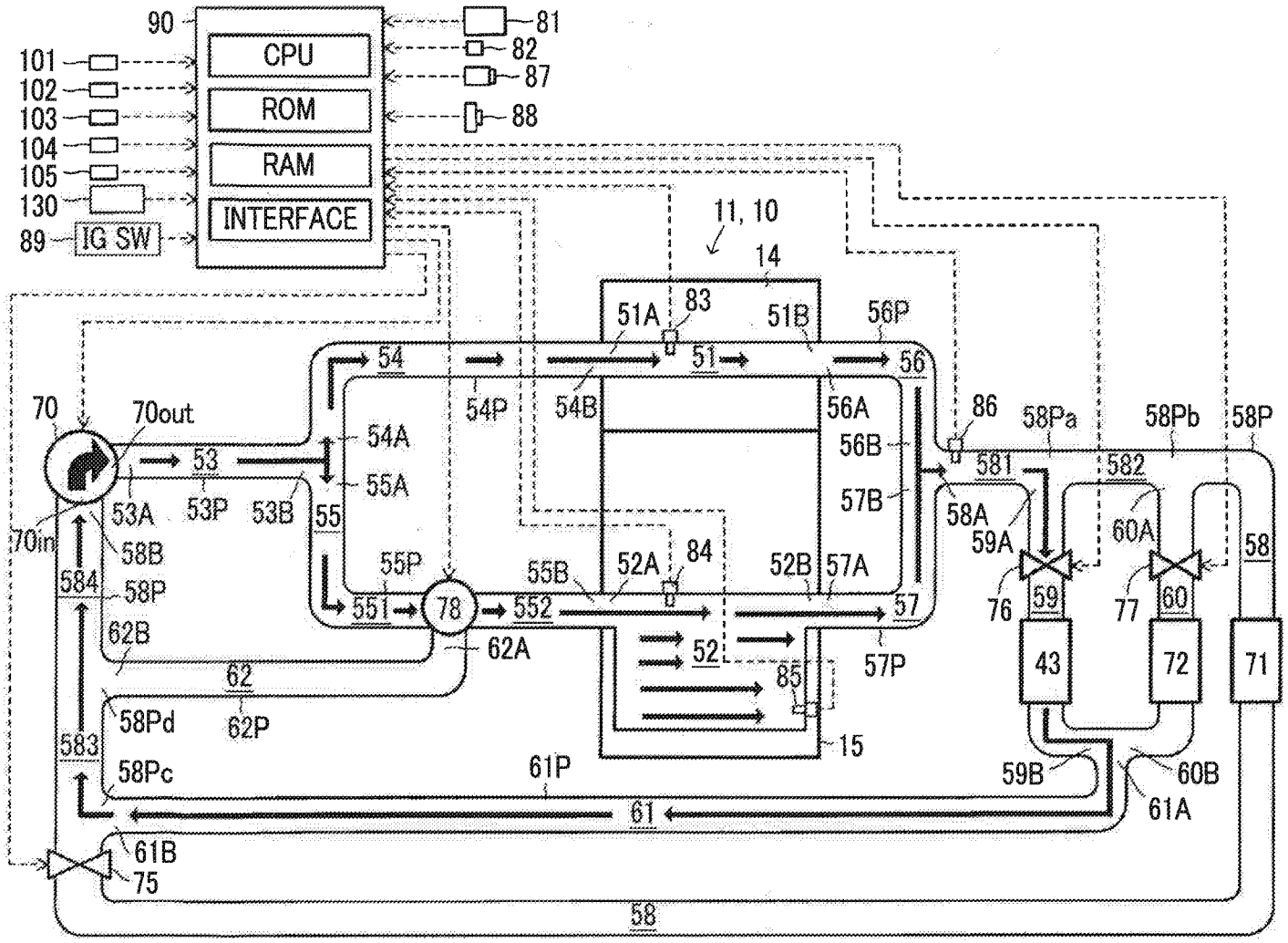
FIG. 13 is a diagram similar to that of FIG. 3 and is a diagram that shows a flow of coolant when the cooling system executes operation control I.

On the other hand, when there is an EGR cooler coolant flow request and there is no heater core coolant flow request while the engine warm-up status is the second half warm-up state, the cooling system executes the operation control I. In the operation control I, the pump 70 is operated, and the shutoff valves 75, 77 each are set in the valve closed position, the shutoff valve 76 is set in the valve open position and the selector valve 78 is set in the forward flow position such that coolant circulates as indicated by the arrows in FIG. 13.

Thus, part of coolant discharged from the pump outlet port 70out to the coolant passage 53 flows into the head coolant passage 51 via the coolant passage 54, and the remaining part of coolant discharged to the coolant passage 53 flows into the block coolant passage 52 via the coolant passage 55.

Coolant flowing into the head coolant passage 51 flows through the head coolant passage 51 and then flows into the radiator coolant passage 58 via the coolant passage 56. Coolant flowing into the block coolant passage 52 flows through the block coolant passage 52 and then flows into the radiator coolant passage 58 via the coolant passage 57.

Coolant flowing into the radiator coolant passage 58 flows into the EGR cooler coolant passage 59. Coolant flowing into the EGR cooler coolant passage 59 passes through the EGR cooler 43, flows through the coolant passage 61 and the third portion 583 and fourth portion 584 of the radiator coolant passage 58 sequentially, and is introduced into the pump 70 from the pump inlet port 70in.

With the operation control I, coolant that has not passed through the radiator 71 is supplied to the head coolant passage 51 and the block coolant passage 52. Therefore, in comparison with the case where coolant that has passed through the radiator. 71 is supplied to the head coolant passage 51 and the block coolant passage 52, it is possible to increase the head temperature Thd and the block temperature Tbr at a high rate. In addition, since coolant is supplied to the EGR cooler coolant passage 59, it is also possible to achieve supply of coolant in response to the EGR cooler coolant flow request.

The block temperature Tbr in the case where the engine warm-up status is the second half warm-up state is relatively higher than the block temperature Tbr in the case where the engine warm-up status is the first half warm-up state. Therefore, from the viewpoint of preventing overheating of the cylinder block 15, the rate of increase in the block temperature Tbr is desirably lower than the rate of increase in the block temperature Tbr in the case where the engine warm-up status is the first half warm-up state. In addition, from the viewpoint of preventing a boil of coolant in the block coolant passage 52, it is desirable that coolant flows through the block coolant passage 52.

With the operation control I, coolant flowing out from the head coolant passage 51 does not directly flow into the block coolant passage 52, and coolant that has passed through the EGR cooler 43 flows into the block coolant passage 52. For this reason, the rate of increase in the block temperature Tbr is lower than the rate of increase in the block temperature Tbr in the case where coolant flowing out from the head coolant passage 51 directly flows into the block coolant passage 52, that is, the case where the engine warm-up status is the first half warm-up state. In addition, coolant flows through the block coolant passage 52. For this reason, it is possible to prevent both overheating of the cylinder block 15 and a boil of coolant in the block coolant passage 52.

Operation Control J

Figure 14:
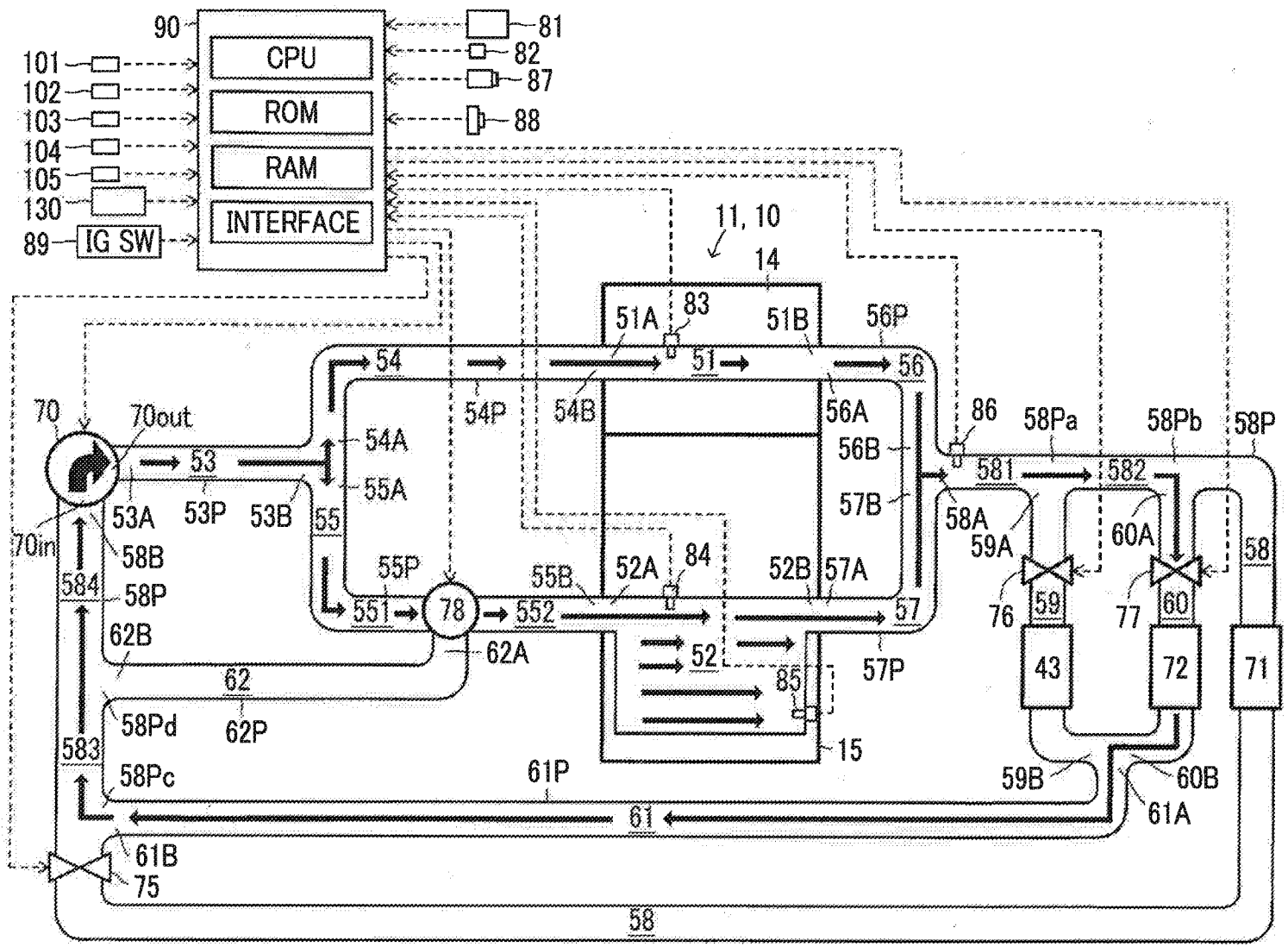
FIG. 14 is a diagram similar to that of FIG. 3 and is a diagram that shows a flow of coolant when the cooling system executes operation control J.

When there is no EGR cooler coolant flow request and there is a heater core coolant flow request while the engine warm-up status is the second half warm-up state, the cooling system executes the operation control J. In the operation control J, the pump 70 is operated, and the shutoff valves 75, 77 each are set in the valve closed position, the shutoff valve 76 is set in the valve open position and the selector valve 78 is set in the forward flow position such that coolant circulates as indicated by the arrows in FIG. 14.

Thus, part of coolant discharged from the pump outlet port 70out to the coolant passage 53 flows into the head coolant passage 51 via the coolant passage 54, and the remaining part of coolant discharged to the coolant passage 53 flows into the block coolant passage 52 via the coolant passage 55.

Coolant flowing into the head coolant passage 51 flows through the head coolant passage 51 and then flows into the heater core coolant passage 60 via the coolant passage 56 and the radiator coolant passage 58 sequentially. Coolant flowing into the block coolant passage 52 flows through the block coolant passage 52 and then flows into the heater core coolant passage 60 via the coolant passage 57 and the radiator coolant passage 58 sequentially.

Coolant flowing into the heater core coolant passage 60 passes through the heater core 72, then flows through the coolant passage 61 and the third portion 583 and fourth portion 584 of the radiator coolant passage 58 sequentially, and is introduced into the pump 70 from the pump inlet port 70in.

With the operation control J, coolant that has not passed through the radiator 71 is supplied to the head coolant passage 51 and the block coolant passage 52. Therefore, as in the case of the operation control I, it is possible to increase the head temperature Thd and the block temperature Tbr at a high rate. In addition, since coolant is supplied to the heater core coolant passage 60, it is possible to achieve supply of coolant in response to the heater core coolant flow request.

As described in connection with the operation control I, the rate of increase in the block temperature Tbr in the case where the engine warm-up status is the second half warm-up state is desirably lower than the rate of increase in the block temperature Tbr in the case where the engine warm-up status is the first half warm-up state, and it is desirable that coolant flows through the block coolant passage 52.

With the operation control J, as well as the operation control I, coolant flowing out from the head coolant passage 51 does not directly flow into the block coolant passage 52, and coolant that has passed through the EGR cooler 43 flows into the block coolant passage 52. For this reason, the rate of increase in the block temperature Tbr is lower than the rate of increase in the block temperature Thr in the case where coolant flowing out from the head coolant passage 51 directly flows into the block coolant passage 52, that is, the case where the engine warm-up status is the first half warm-up state. In addition, coolant flows through the block coolant passage 52. For this reason, it is possible to prevent both overheating of the cylinder block. 15 and a boil of coolant in the block coolant passage 52.

Operation Control K

Figure 15:
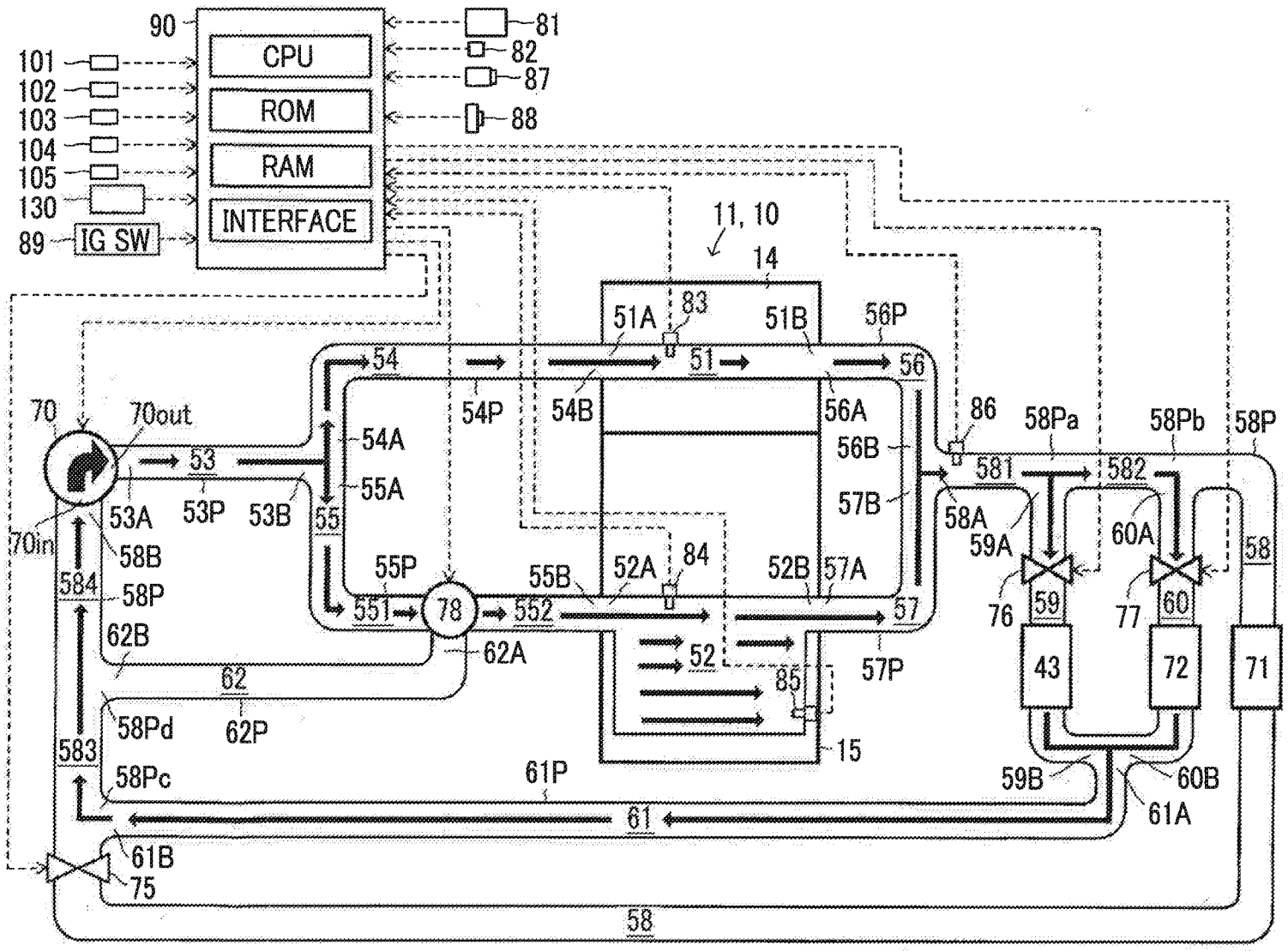
FIG. 15 is a diagram similar to that of FIG. 3 and is a diagram that shows a flow of coolant when the cooling system executes operation control K.

When there are both EGR cooler coolant flow request and heater core coolant flow request while the engine warm-up status is the second half warm-up state, the cooling system executes the operation control K. In the operation control K, the pump 70 is operated, and the shutoff valve 75 is set in the valve closed position, the shutoff valves 76, 77 each are set in the valve open position and the selector valve 78 is set in the forward flow position such that coolant circulates as indicated by the arrows in FIG. 15.

Thus, part of coolant discharged from the pump outlet port 70out to the coolant passage 53 flows into the head coolant passage 51 via the coolant passage 54, and the remaining part of coolant discharged to the coolant passage 53 flows into the block coolant passage 52 via the coolant passage 55.

Coolant flowing into the head coolant passage 51 flows through the head coolant passage 51 and then flows into the radiator coolant passage 58 via the coolant passage 56. On the other hand, coolant flowing into the block coolant passage 52 flows through the block coolant passage 52 and then flows into the radiator coolant passage 58 via the coolant passage 57.

Coolant flowing into the radiator coolant passage 58 flows into the EGR cooler coolant passage 59 or the heater core coolant passage 60.

Coolant flowing into the EGR cooler coolant passage 59 passes through the EGR cooler 43, then flows through the coolant passage 61 and the third portion 583 and fourth portion 584 of the radiator coolant passage 58 sequentially, and is introduced into the pump 70 from the pump inlet port 70in. On the other hand, coolant flowing into the heater core coolant passage 60 passes through the heater core 72, flows through the coolant passage 61 and the third portion 583 and fourth portion 584 of the radiator coolant passage 58 sequentially, and is introduced into the pump 70 from the pump inlet port 70in.

With the operation control K, similar advantageous effects to the advantageous effects described in connection with the operation control I and the operation control J are obtained.

Warm-Up Post-Completion Control

Next, the operation controls over the pump 70, and the like, in the case where it is determined that the engine warm-up status is the warm-up completion state (warm-up post-completion control) will be described.

When the engine warm-up status is the warm-up completion state, both the cylinder head 14 and the cylinder block 15 need to be cooled. When the engine warm-up status is the warm-up completion state, the cooling system cools the cylinder head 14 and the cylinder block 15 with the use of coolant cooled by the radiator 71.

Operation Control L

Figure 16:
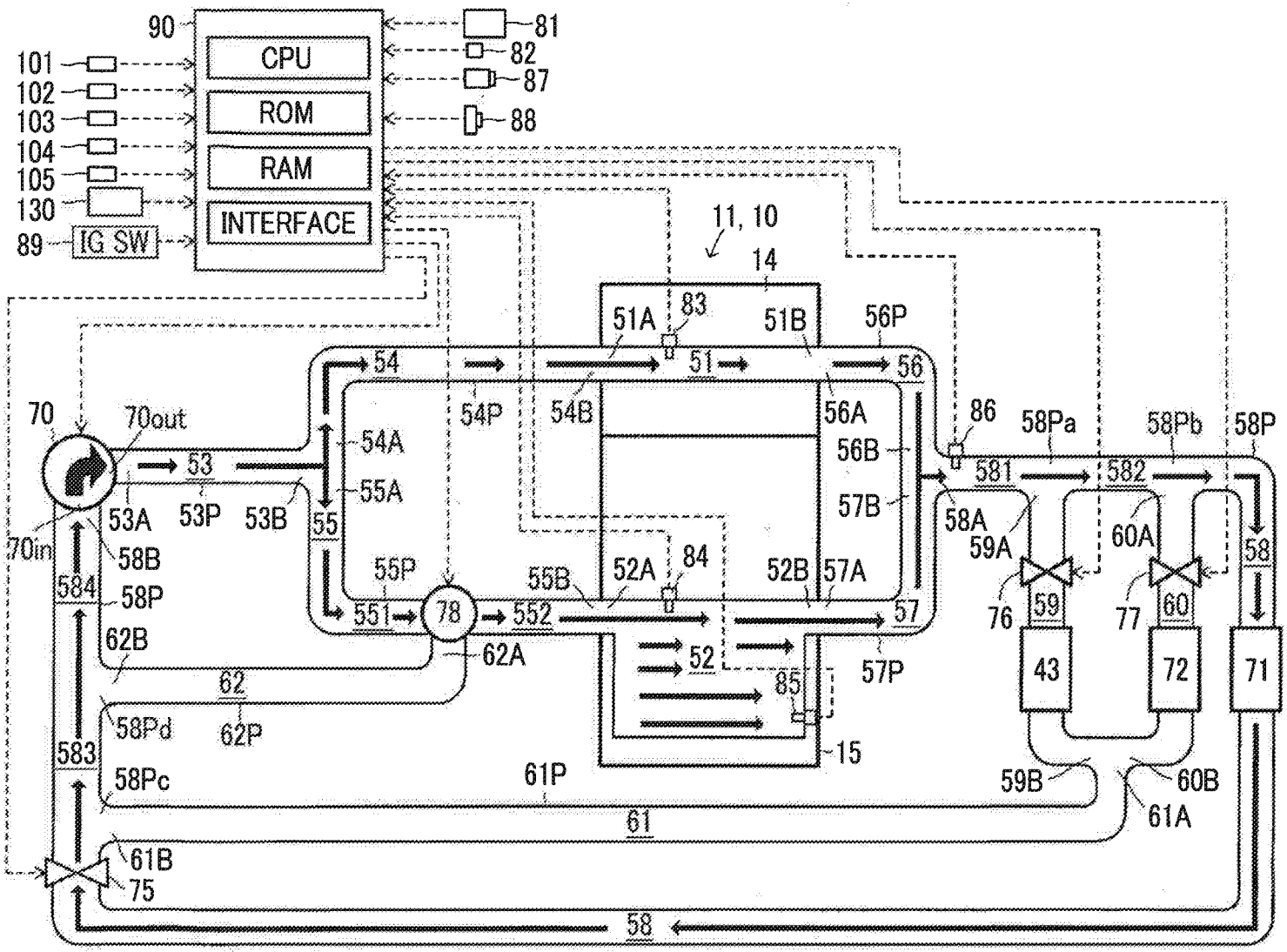
FIG. 16 is a diagram similar to that of FIG. 3 and is a diagram that shows a flow of coolant when the cooling system executes operation control L.

More specifically, when there is neither EGR cooler coolant flow request nor heater core coolant flow request while the engine warm-up status is the warm-up completion state, the cooling system executes the operation control L. In the operation control L, the pump 70 is operated, and the shutoff valves 76, 77 each are set in the valve closed position, the shutoff valve 75 is set in the valve open position and the selector valve 78 is set in the forward flow position such that coolant circulates as indicated by the arrows in FIG. 16.

Thus, part of coolant discharged from the pump outlet port 70out to the coolant passage 53 flows into the head coolant passage 51 via the coolant passage 54. On the other hand, the remaining part of coolant discharged to the coolant passage 53 flows into the block coolant passage 52 via the coolant passage 55.

Coolant flowing into the head coolant passage 51 flows through the head coolant passage 51 and then flows into the radiator coolant passage 58 via the coolant passage 56. On the other hand, coolant flowing into the block coolant passage 52 flows through the block coolant passage 52 and then flows into the radiator coolant passage 58 via the coolant passage 57. Coolant flowing into the radiator coolant passage 58 passes through the radiator 71, and is then introduced into the pump 70 from the pump inlet port 70in.

With the operation control L, since coolant that has passed through the radiator 71 is supplied to the head coolant passage 51 and the block coolant passage 52, it is possible to cool the cylinder head 14 and the cylinder block 15 with the use of coolant having a low temperature.

Operation Control M

Figure 17:
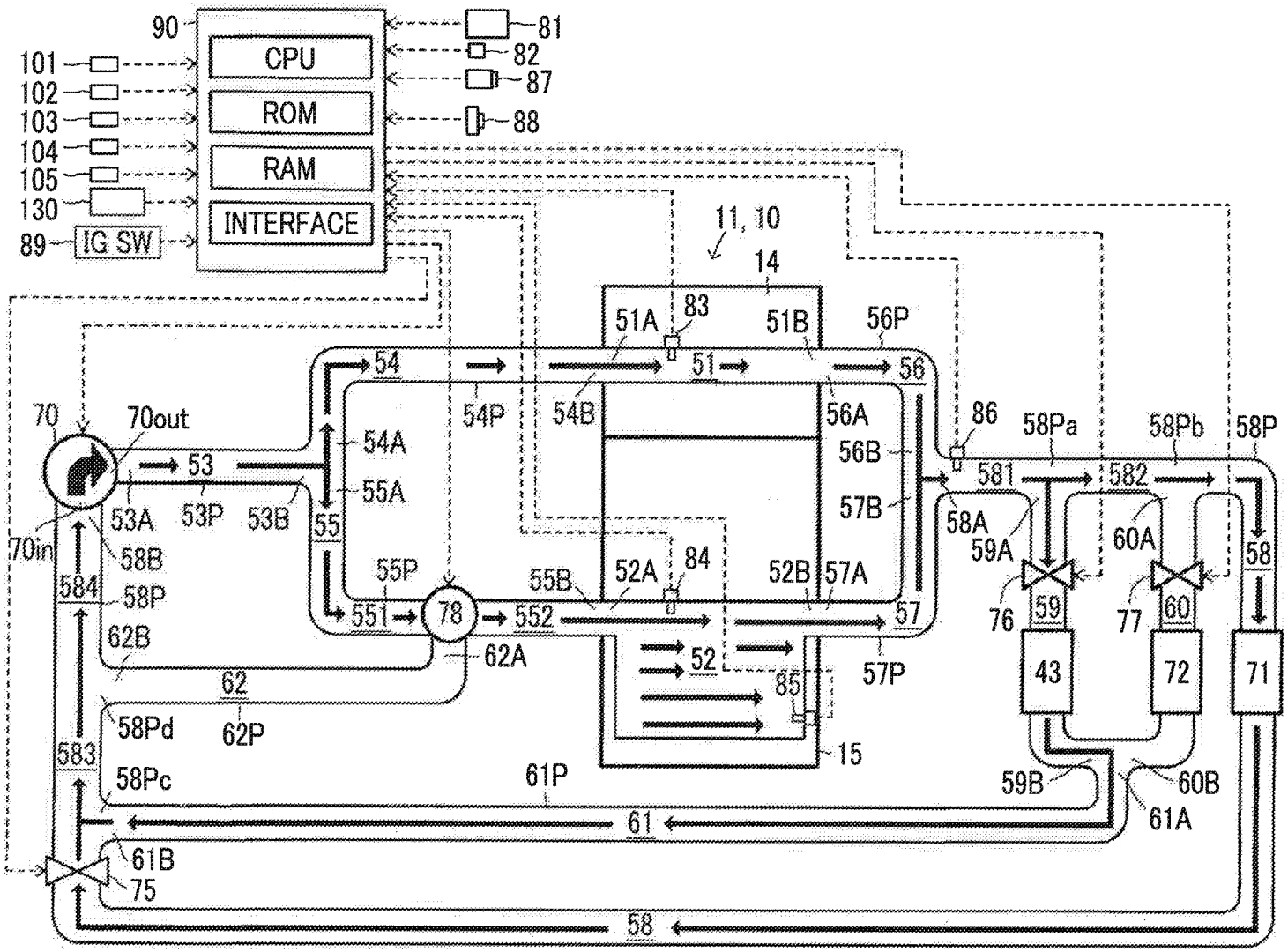
FIG. 17 is a diagram similar to that of FIG. 3 and is a diagram that shows a flow of coolant when the cooling system executes operation control M.

On the other hand, when there is an EGR cooler coolant flow request and there is no heater core coolant flow request while the engine warm-up status is the warm-up completion state, the cooling system executes the operation control M. In the operation control M, the pump 70 is operated, and the shutoff valve 77 is set in the valve closed position, the shutoff valves 75, 76 each are set in the valve open position and the selector valve 78 is set in the forward flow position such that coolant circulates as indicated by the arrows in FIG. 17.

Thus, part of coolant discharged from the pump outlet port 70out to the coolant passage 53 flows into the head coolant passage 51 via the coolant passage 54. On the other hand, the remaining part of coolant discharged to the coolant passage 53 flows into the block coolant passage 52 via the coolant passage 55.

Coolant flowing into the head coolant passage 51 flows through the head coolant passage 51 and then flows into the radiator coolant passage 58 via the coolant passage 56. On the other hand, coolant flowing into the block coolant passage 52 flows through the block coolant passage 52 and then flows into the radiator coolant passage 58 via the coolant passage 57.

Part of coolant flowing into the radiator coolant passage 58 directly flows through the radiator coolant passage 58, passes through the radiator 71, and is then introduced into the pump 70 from the pump inlet port 70in.

On the other hand, the remaining part of coolant flowing into the radiator coolant passage 58 flows into the EGR cooler coolant passage 59. The coolant passes through the EGR cooler 43, then flows through the coolant passage 61 and the third portion 583 and fourth portion 584 of the radiator coolant passage 58 sequentially, and is introduced into the pump 70 from the pump inlet port 70in.

With the operation control M, coolant is supplied to the EGR cooler coolant passage 59. In addition, coolant that has passed through the radiator 71 is supplied to the head coolant passage 51 and the block coolant passage 52. Therefore, it is possible to achieve supply of coolant in response to the EGR cooler coolant flow request and also cool the cylinder head 14 and the cylinder block 15 with the use of coolant having a low temperature.

Operation Control N

Figure 18:
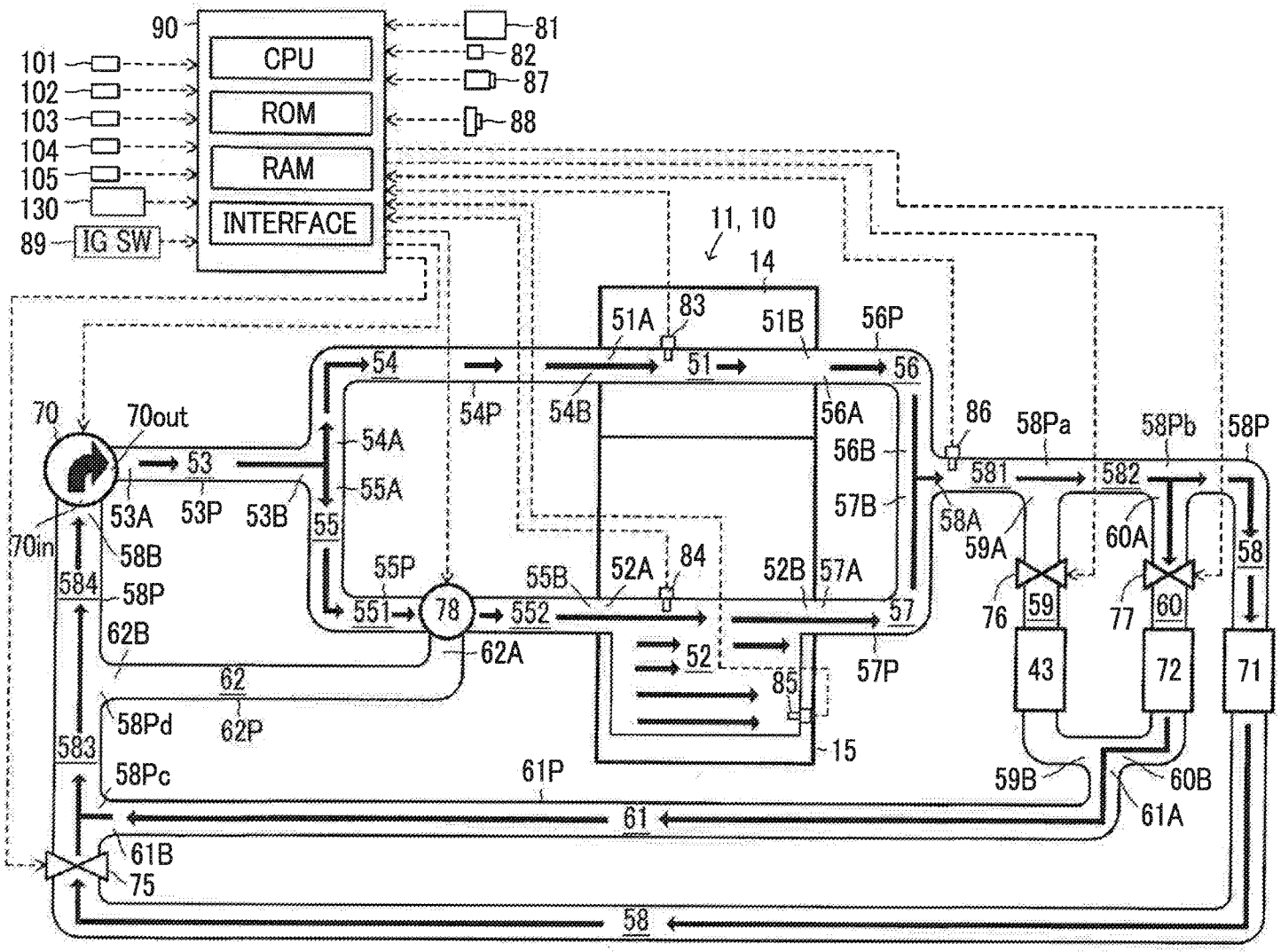
FIG. 18 is a diagram similar to that of FIG. 3 and is a diagram that shows a flow of coolant when the cooling system executes operation control N.

When there is no EGR cooler coolant flow request and there is a heater core coolant flow request while the engine warm-up status is the warm-up completion state, the cooling system executes the operation control N. In the operation control N, the pump 70 is operated, and the shutoff valve 76 is set in the valve closed position, the shutoff valves 75, 77 each are set in the valve open position and the selector valve 78 is set in the forward flow position such that coolant circulates as indicated by the arrows in FIG. 18.

Thus, part of coolant discharged from the pump outlet port 70out to the coolant passage 53 flows into the head coolant passage 51 via the coolant passage 54. On the other hand, the remaining part of coolant discharged to the coolant passage 53 flows into the block coolant passage 52 via the coolant passage 55.

Coolant flowing into the head coolant passage 51 flows through the head coolant passage 51 and then flows into the radiator coolant passage 58 via the coolant passage 56. On the other hand, coolant flowing into the block coolant passage 52 flows through the block coolant passage 52 and then flows into the radiator coolant passage 58 via the coolant passage 57.

Part of coolant flowing into the radiator coolant passage 58 directly flows through the radiator coolant passage 58, passes through the radiator 71, and is then introduced into the pump 70 from the pump inlet port 70in.

On the other hand, the remaining part of coolant flowing into the radiator coolant passage 58 flows into the heater core coolant passage 60. The coolant passes through the heater core 72, flows through the coolant passage 61 and the third portion 583 and fourth portion 584 of the radiator coolant passage 58 sequentially; and is introduced into the pump 70 from the pump inlet port 70in.

With the operation control N, coolant is supplied to the heater core coolant passage 60. In addition, coolant that has passed through the radiator 71 is supplied to the head coolant passage 51 and the block coolant passage 52. Therefore, it is possible to achieve supply of coolant in response to the heater core coolant flow request and cool the cylinder head 14 and the cylinder block 15 with the use of coolant having a low temperature.

Operation Control O

Figure 19:
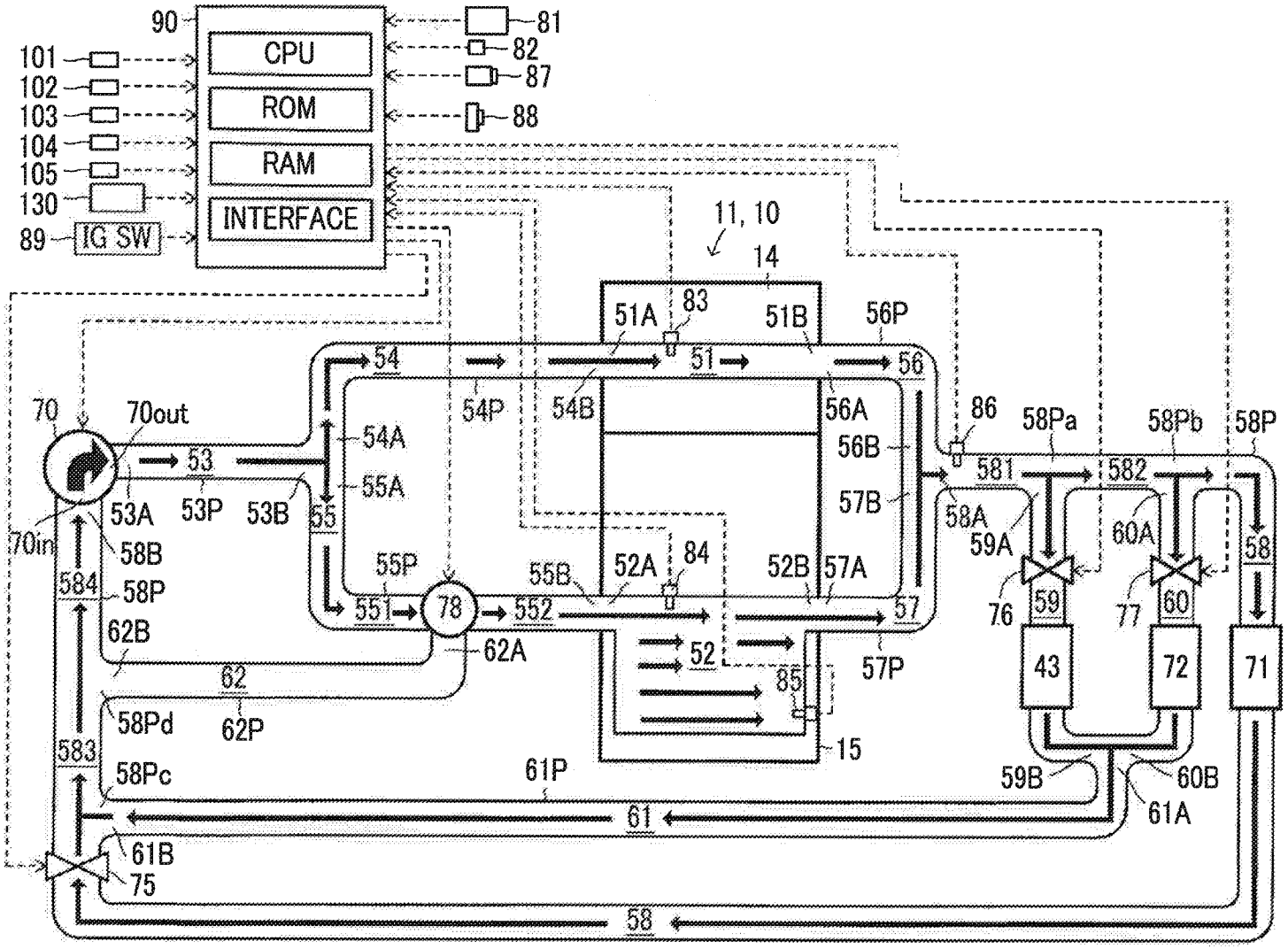
FIG. 19 is a diagram similar to that of FIG. 3 and is a diagram that shows a flow of coolant when the cooling system executes operation control O.

When there are both EGR cooler coolant flow request and heater core coolant flow request while the engine warm-up status is the warm-up completion state, the cooling system executes the operation control O. In the operation control O, the pump 70 is operated, and the shutoff valves 75, 76, 77 each are set in the valve open position and the selector valve 78 is set in the forward flow position such that coolant circulates as indicated by the arrows in FIG. 19.

Thus, part of coolant discharged from the pump outlet port 70out to the coolant passage 53 flows into the head coolant passage 51 via the coolant passage 54. On the other hand, the remaining part of coolant discharged to the coolant passage 53 flows into the block coolant passage 52 via the coolant passage 55. Coolant flowing into the head coolant passage 51 flows through the head coolant passage 51 and then flows into the radiator coolant passage 58 via the coolant passage 56. Coolant flowing into the block coolant passage 52 flows through the block coolant passage 52 and then flows into the radiator coolant passage 58 via the coolant passage 57.

Part of coolant flowing into the radiator coolant passage 58 directly flows through the radiator coolant passage 58, passes through the radiator 71, and is then introduced into the pump 70 from the pump inlet port 70in.

On the other hand, the remaining part of coolant flowing into the radiator coolant passage 58 flows into the EGR cooler coolant passage 59 and the heater core coolant passage 60. Coolant flowing into the EGR cooler coolant passage 59 passes through the EGR cooler 43, flows through the coolant passage 61 and the third portion 583 and fourth portion 584 of the radiator coolant passage 58 sequentially, and is introduced into the pump 70 from the pump inlet port 70in. On the other hand, coolant flowing into the heater core coolant passage 60 passes through the heater core 72, then flows through the coolant passage 61 and the third portion 583 and fourth portion 584 of the radiator coolant passage 58 sequentially, and is introduced into the pump 70 from the pump inlet port 70in.

With the operation control O, similar advantageous effects to the advantageous effects described in connection with the operation controls L, M, N are obtained.

As described above, with the cooling system, when the engine temperature Teng is low (when the engine warm-up status is the first half warm-up state or the second half warm-up state), both an early increase in the head temperature Thd and the block temperature Tbr and prevention of a boil of coolant in the head coolant passage 51 or the block coolant passage 52 are achieved with a low manufacturing cost manner in which the coolant passage 62, the selector valve 78 and the shutoff valve 75 are added to a general cooling system.

Switching of Operation Control

Incidentally, in order to switch the operation control from any one of the operation controls E, F, G, H to any one of the operation controls I, J, K, L, M, N, O, the cooling system needs to switch the set position of at least one of the shutoff valves 75, 76, 77 (hereinafter, referred to as shutoff valve 75, and the like) from the valve closed position to the valve open position and switch the set position of the selector valve 78 from the reverse flow position to the forward flow position.

In this respect, when the set position of the selector valve 78 is switched from the reverse flow position to the forward flow position before the set position of any of the shutoff valve 75, and the like, is switched from the valve closed position to the valve open position, the coolant passages are shut off during a period from when the set position of the selector valve 78 is switched to when the set position of the any of the shutoff valve 75, and the like, is switched. Alternatively, even when the set position of the selector valve 78 is switched from the reverse flow position to the forward flow position at the same time as the set position of any of the shutoff valve 75, and the like, is switched from the valve closed position to the valve open position, the coolant passages are momentarily shut off.

When the coolant passages are shut off, the pump 70 is in operation although coolant is not able to circulate through the coolant passages.

When the cooling system switches the operation control from any one of the operation controls E, F, G, H to any one of the operation controls I, J, k, L, M, N, O, the cooling system initially switches the set position of the shutoff valve to be switched from the valve closed position to the valve open position among the shutoff valve 75, and the like, from the valve closed position to the valve open position and, after that, switches the set position of the selector valve 78 from the reverse flow position to the forward flow position.

With this configuration, when the operation control is switched from any one of the operation controls E, F, G, H to any one of the operation controls I, J, K, L, M, N, O, it is possible to prevent the pump 70 from being in operation although the coolant passages are shut off and coolant does not circulate.

Hybrid Control

Next, control that is executed by the ECU 90 over the engine 10, the first MG 110 and the second MG 120 will be described. The ECU 90 acquires a required torque TQreq based on the accelerator pedal operation amount AP and the vehicle speed V. The required torque TQreq is a torque that is required by the driver as a driving torque that is supplied to the drive wheels 190 in order to drive the drive wheels 190.

The ECU 90 calculates an output power Pdrv to be input to the drive wheels 190 (hereinafter, referred to as required driving output power Pdrv) by multiplying the required torque TQreq by the second MG rotation speed NM2.

The ECU 90 acquires an output power Pchg to be input to the first MG 110 (hereinafter, referred to as required charging output power Pchg) in order to bring the battery state of charge SOC close to a target value SOCtgt of the battery state of charge SOC (hereinafter, referred to as target state of charge SOCtgt) based on a difference ΔSOC (=SOCtgt−SOC) between the target state of charge SOCtgt and the current battery state of charge SOC.

The ECU 90 calculates the sum of the required driving output power Pdrv and the required charging output power Pchg as an output power Peng to be output from the engine 10 (hereinafter, referred to as required engine output power Peng).

The ECU 90 determines whether the required engine output power Peng is smaller than a lower limit of an optimal operation output power of the engine 10. The lower limit of the optimal operation output power of the engine 10 is the minimum value of output power at or above which the engine 10 is able to operate at an efficiency higher than a predetermined efficiency. The optimal operation output power is determined by a combination of an optimal engine torque TQeop and an optimal engine rotation speed NEeop.

When the required engine output power Peng is smaller than the lower limit of the optimal operation output power of the engine 10, the ECU 90 determines that an engine operation condition is not satisfied. When the ECU 90 determines that the engine operation condition is not satisfied, the ECU 90 sets both a target value TQeng_tgt of the engine torque (hereinafter, referred to as target engine torque TQeng_tgt) and a target value NEtgt of the engine rotation speed (hereinafter, referred to target engine rotation speed NEtgt) to zero.

The ECU 90 calculates a target value TQmg2_*tgt* of torque to be output from the second MG 120 (hereinafter, referred to as target second MG torque TQmg2_*tgt*) in order to input the required driving output power Pdrv to the drive wheels 190 based on the second MG rotation speed NM2.

On the other hand, when the required engine output power Peng is larger than or equal to the lower limit of the optimal operation output power of the engine 10, the ECU 90 determines that the engine operation condition is satisfied. When the ECU 90 determines that the engine operation condition is satisfied, the ECU 90 determines a target value of the optimal engine torque TQeop and a target value of the optimal engine rotation speed NEeop for outputting the required engine output power Peng from the engine 10 as the target engine torque TQeng_tgt and the target engine rotation speed NEtgt. In this case, the target engine torque TQeng_tgt and the target engine rotation speed NEtgt each are set to a value larger than zero.

The ECU 90 calculates a target first MG rotation speed NM1*tgt* based on the target engine rotation speed NEtgt and the second MG rotation speed NM2.

The ECU 90 calculates a target first MG torque TQmg1_*tgt* based on the target engine torque TQeng_tgt, the target first MG rotation speed NM1*tgt*, the first MG rotation speed NM1 and the engine torque distribution characteristic (hereinafter, referred to as torque distribution characteristic) of the power split device 150.

In addition, the ECU 90 calculates a target second MG torque TQmg2_*tgt* based on the required torque TQreq, the target engine torque TQeng_tgt and the torque distribution characteristic.

The ECU 90 controls the engine operation such that the target engine torque TQeng_tgt and the target engine rotation speed NEtgt are achieved. When both the target engine torque TQeng_tgt and the target engine rotation speed NEtgt are larger than zero, that is, when the engine operation condition is satisfied, the ECU 90 causes the engine 10 to operate. On the other hand, when both the target engine torque TQeng_tgt and the target engine rotation speed NEtgt are zero, that is, when the engine operation condition is not satisfied, the ECU 90 stops the engine operation.

On the other hand, the ECU 90 controls the operations of the first MG 110 and second MG 120 by controlling the inverter 130 such that the target first MG rotation speed NM tgt, the target first MG torque TQmg1_*tgt* and the target second MG torque TQmg2_*tgt* are achieved. At this time, when the first MG 110 is generating electric power, the second MG 120 can be driven by electric power that is being generated by the first MG 110 in addition to electric power that is supplied from the battery 140.

A method of calculating the target engine torque TQeng_tgt, the target engine rotation speed NEtgt, the target first MG torque TQmg1_*tgt*, the target first MG rotation speed NM1*tgt* and the target second MG torque TQmg2_*tgt* in the hybrid vehicle 100 is publicly known (see, for example, JP 2013-177026 A).

Restart Control

As described above, the ECU 90 executes control for stopping or restarting the engine operation (hereinafter, referred to as intermittent operation control) in response to the required engine output power Peng. When the ECU 90 has stopped the engine operation through the intermittent operation control, the ECU 90 also stops the operation of the pump 70. Therefore, during a stop of the engine operation, coolant is not circulating through the coolant passages, so the engine temperature Teng can continue to be high. For this reason, the temperature of coolant in the head coolant passage 51 or the block coolant passage 52 or both can become locally high due to, for example, heat convection in the cylinder head 14 and the cylinder block 15. At this time, when any one of the operation controls E, F, G, H is executed in the case where a first half warm-up condition is satisfied at the time of a restart of the engine operation, coolant that has passed through the head coolant passage 51 and having a high temperature directly flows into the block coolant passage 52, and coolant that has not passed through the radiator 71, and the like, flows into the head coolant passage 51. As a result, a boil of coolant can occur in the head coolant passage 51 or the block coolant passage 52 or both.

While a cycle number Crst after a restart of the engine operation (hereinafter, referred to as post-restart engine cycle number Crst) is smaller than or equal to a predetermined cycle number Crst_th (hereinafter, referred to as predetermined post-restart engine cycle number Crst_th), when the first half warm-up condition is satisfied, the cooling system executes restart control for controlling the operations of the pump 70, and the like, as in the case of the operation control D.

On the other hand, when the cold condition or the second half warm-up condition or the warm-up completion condition is satisfied while the post-restart engine cycle number Crst is smaller than or equal to the predetermined post-restart engine cycle number Crst_th, the cooling system executes any one of the operation controls A, B, C, D, E, F, G, H, I, J, K, L, M, N, O as described above in response to the engine warm-up status, whether there is an EGR cooler coolant flow request, and whether there is a heater core coolant flow request.

When the post-restart engine cycle number Crst is larger than the predetermined post-restart engine cycle number Crst_th, the cooling system executes any one of the operation controls A, B, C, D, E, F, G, H, I, J, K, L, M, N, O as described above in response to the engine warm-up status, whether there is an EGR cooler coolant flow request, and whether there is a heater core coolant flow request.

With this configuration, when the first half warm-up condition is satisfied while the post-restart engine cycle number Crst is smaller than or equal to the predetermined post-restart engine cycle number Crst_th, coolant that has passed through the head coolant passage 51 is not directly supplied to the block coolant passage 52, and coolant circulates through the head coolant passage 51. For this reason, a boil of coolant in the head coolant passage 51 or the block coolant passage 52 is prevented.

Operation Control During Engine Stop

Next, the operation controls over the pump 70, and the like, in the case where the ignition off operation has been performed will be described. As described above, when the ignition off operation has been performed, the cooling system stops the engine operation. After that, when the ignition on operation has been performed and the engine operation condition is satisfied, the cooling system starts the engine 10. At this time, when the shutoff valve 75 is stuck (becomes inoperative) while being set in the valve closed position and the selector valve 78 is stuck (becomes inoperative) while being set in the reverse flow position during a stop of the engine operation, coolant cooled by the radiator 71 is not able to be supplied to the head coolant passage 51 and the block coolant passage 52 after a start of the engine 10. In this case, there is a possibility that it is not possible to prevent overheating of the engine 10 after completion of warm-up of the engine 10.

When the ignition off operation has been performed, the cooling system executes control during engine strop. In the control during engine stop, the operation of the pump 70 is stopped, and the selector valve 78 is set in the forward flow position when the selector valve 78 is set in the reverse flow position at this time, and the shutoff valve 75 is set in the valve open position when the shutoff valve 75 is set in the valve closed position. With this configuration, during a stop of the engine operation, the shutoff valve 75 is set in the valve open position, and the selector valve 78 is set in the forward flow position. Therefore, even when the shutoff valve 75 and the selector valve 78 are stuck during a stop of the engine operation, since the shutoff valve 75 is set in the valve open position and the selector valve 78 is set in the forward flow position, it is possible to supply coolant cooled by the radiator 71 to the head coolant passage 51 and the block coolant passage 52 after a start of the engine. For this reason, it is possible to prevent overheating of the engine 10 after completion of warm-up of the engine 10.

Specific Operation of Cooling System

Next, the specific operation of the cooling system will be described. The CPU of the ECU 90 of the cooling system is configured to execute a routine shown by the flowchart in FIG. 20 at predetermined time intervals.

Figure 20:
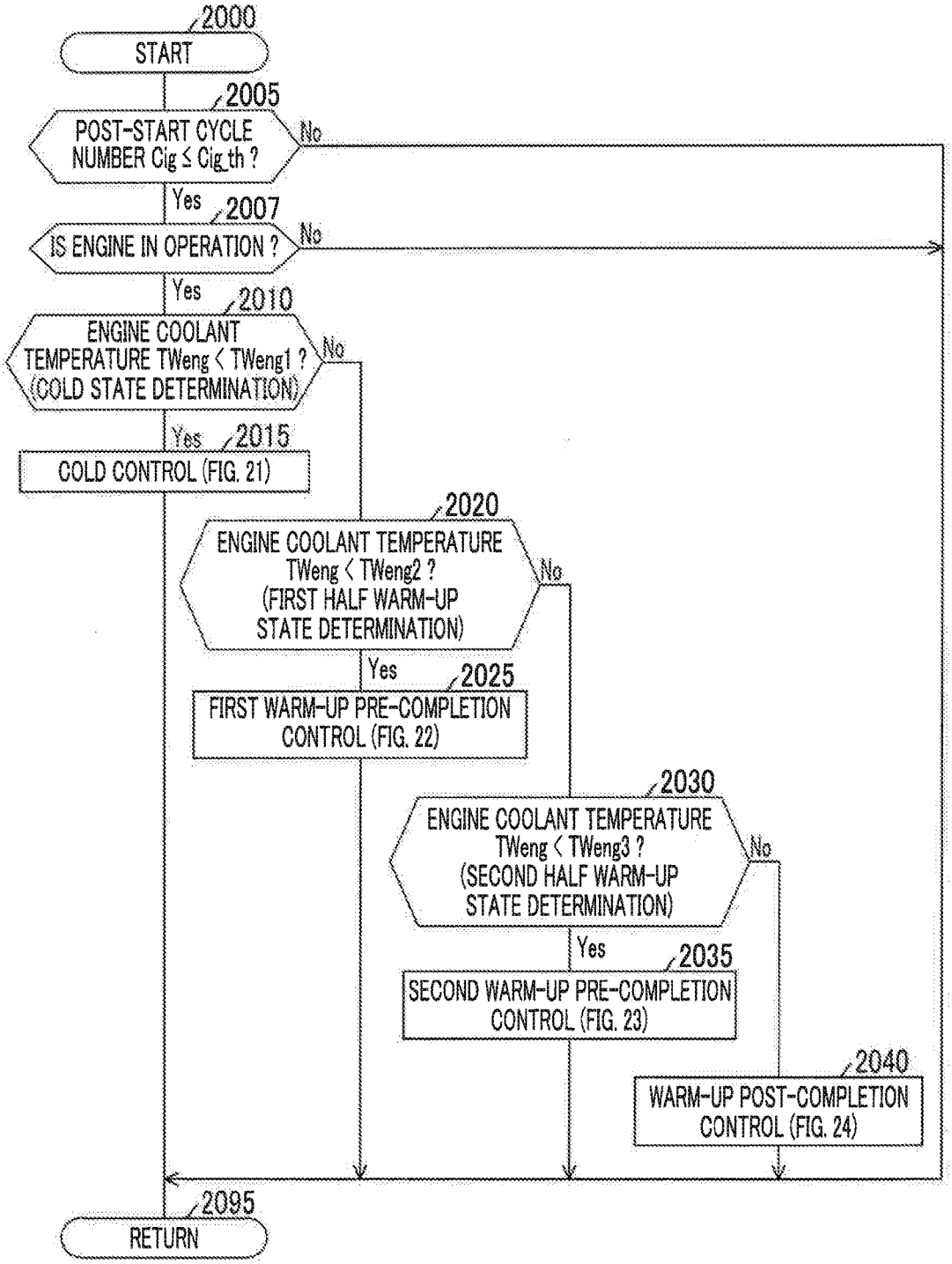
FIG. 20 is a flowchart that shows a routine that is executed by a CPU of an ECU (hereinafter, simply referred to as CPU) shown in FIG. 2 and FIG. 3.

Therefore, as predetermined timing comes, the CPU starts a process from step 2000 of FIG. 20, and proceeds to step 2005. In step 2005, the CPU determines whether the cycle number (post-start engine cycle number) Cig after a start of the engine 10 is smaller than or equal to the predetermined post-start engine cycle number Cig_th. When the post-start engine cycle number Cig is larger than the predetermined post-start engine cycle number Cig_th, the CPU makes negative determination in step 2005, and proceeds to step 2095. In step 2095, the CPU once ends the routine.

In contrast, when the post-start engine cycle number Cig is smaller than or equal to the predetermined post-start engine cycle number Cig_th, the CPU makes affirmative determination in step 2005, and proceeds to step 2007. In step 2007, the CPU determines whether the engine is in operation. When the engine is not in operation, the CPU makes negative determination in step 2007, and proceeds to step 2095. In step 2095, the CPU once ends the routine.

In contrast, when the engine is in operation, the CPU makes affirmative determination in step 2007, and proceeds to step 2010. In step 2010, the CPU determines whether the engine coolant temperature TWeng is lower than the first engine coolant temperature TWeng1.

When the engine coolant temperature TWeng is lower than the first engine coolant temperature TWeng1, the CPU makes affirmative determination in step 2010, and proceeds to step 2015. In step 2015, the CPU executes a cold control routine shown by the flowchart in FIG. 21.

Figure 21:
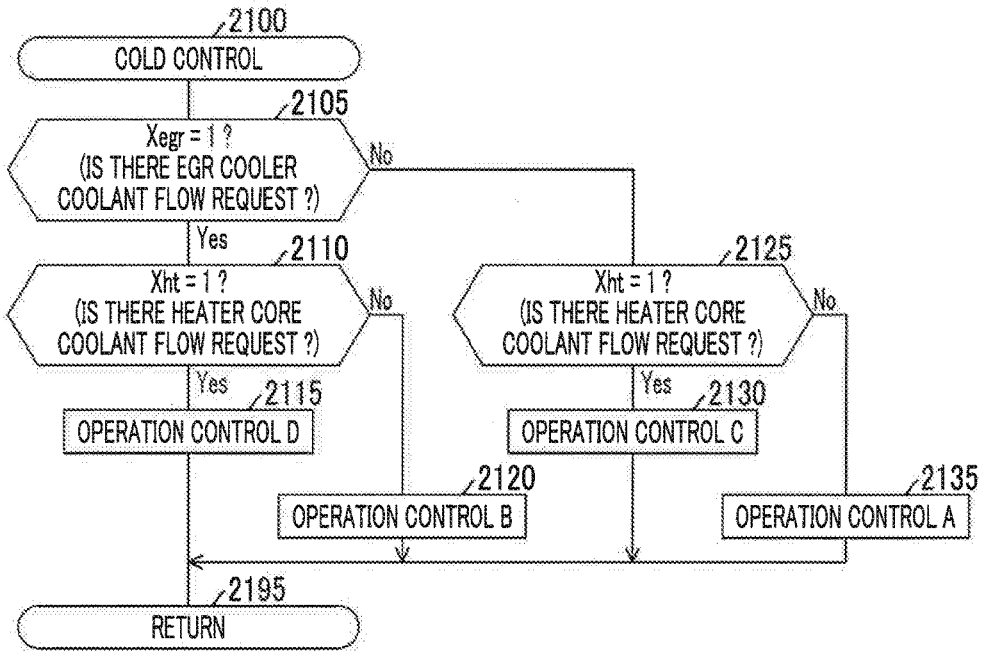
FIG. 21 is a flowchart that shows a routine that is executed by the CPU.

Therefore, as the CPU proceeds to step 2015, the CPU starts a process from step 2100 of FIG. 21, and proceeds to step 2105. In step 2105, the CPU determines whether an EGR cooler coolant flow request flag Xegr that is set in the routine of FIG. 26 (described later) is "1", that is, whether there is an EGR cooler coolant flow request.

When the EGR cooler coolant flow request flag Xegr is "1", the CPU makes affirmative determination in step 2105, and proceeds to step 2110. In step 2110, a heater core coolant flow request flag Xht that is set in the routine of FIG. 27 (described later) is "1", that is, whether there is a heater core coolant flow request.

When the heater core coolant flow request flag Xht is "1", the CPU makes affirmative determination in step 2110, and proceeds to step 2115. In step 2115, the CPU controls the operation statuses of the pump 70, and the like, by executing the operation control D (see FIG. 8). After that, the CPU proceeds to step 2095 of FIG. 20 by way of step 2195. In step 2095, the CPU once ends the routine.

In contrast, when the heater core coolant flow request flag Xht is "0" at the time when the CPU executes the process of step 2110, the CPU makes negative determination in step 2110, and proceeds to step 2120. In step 2120, the CPU controls the operation statuses of the pump 70, and the like, by executing the operation control B (see FIG. 6). After that, the CPU proceeds to step 2095 of FIG. 20 by way of step 2195. In step 2095, the CPU once ends the routine.

On the other hand, when the EGR cooler coolant flow request flag Xegr is "0" at the time when the CPU executes the process of step 2105, the CPU makes negative determination in step 2105, and proceeds to step 2125. In step 2125, the CPU determines whether the heater core coolant flow request flag Xht is "1".

When the heater core coolant flow request flag Xht is "1", the CPU makes affirmative determination in step 2125, and proceeds to step 2130. In step 2130, the CPU controls the operation statuses of the pump 70, and the like, by executing the operation control C (see FIG. 7) After that, the CPU proceeds to step 2095 of FIG. 20 by way of step 2195. In step 2095, the CPU once ends the routine.

In contrast, when the heater core coolant flow request flag Xht is "0" at the time when the CPU executes the process of step 2125, the CPU makes negative determination in step 2125, and proceeds to step 2135. In step 2135, the CPU controls the operation statuses of the pump 70, and the like, by executing the operation control A. After that, the CPU proceeds to step 2095 of FIG. 20 by way of step 2195. In step 2095, the CPU once ends the routine.

When the engine coolant temperature TWeng is higher than or equal to the first engine coolant temperature TWeng1 at the time when the CPU executes the process of step 2010 of FIG. 20, the CPU makes negative determination in step 2010, and proceeds to step 2020. In step 2020, the CPU determines whether the engine coolant temperature TWeng is lower than the second engine coolant temperature TWeng2.

When the engine coolant temperature TWeng is lower than the second engine coolant temperature TWeng2, the CPU makes affirmative determination in step 2020, and proceeds to step 2025. In step 2025, the CPU executes a first warm-up pre-completion control routine shown by the flowchart in FIG. 22.

Figure 22:
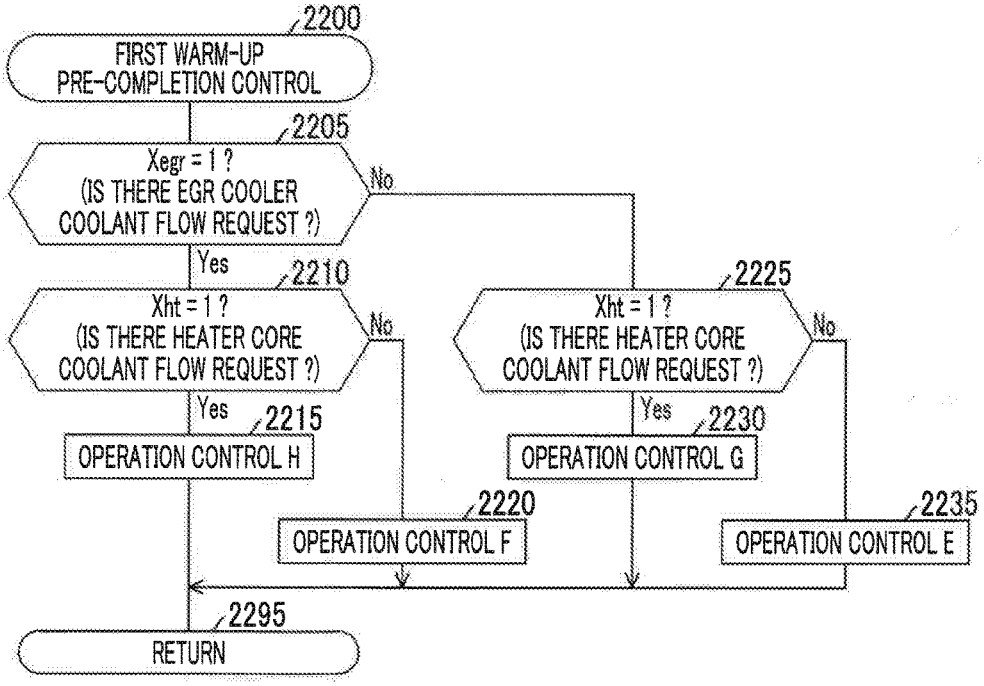
FIG. 22 is a flowchart that shows a routine that is executed by the CPU.

Therefore, as the CPU proceeds to step 2025, the CPU starts a process from step 2200 of FIG. 22, and proceeds to step 2205. In step 2205, the CPU determines whether the EGR cooler coolant flow request flag Xegr is "1", that is, whether there is an EGR cooler coolant flow request.

When the EGR cooler coolant flow request flag Xegr is "1", the CPU makes affirmative determination in step 2205, and proceeds to step 2210. In step 2210, the CPU determines whether the heater core coolant flow request flag Xht is "1", that is, whether there is a heater core coolant flow request.

When the heater core coolant flow request flag Xht is "1", the CPU makes affirmative determination in step 2210, and proceeds to step 2215. In step 2215, the CPU controls the operation statuses of the pump 70, and the like, by executing the operation control H (see FIG. 12). After that, the CPU proceeds to step 2095 of FIG. 20 by way of step 2295. In step 2295, the CPU once ends the routine.

In contrast, when the heater core coolant flow request flag Xht is "0" at the time when the CPU executes the process of step 2210, the CPU makes negative determination in step 2210, and proceeds to step 2220. In step 2220, the CPU controls the operation statuses of the pump 70, and the like, by executing the operation control F (see FIG. 10). After that, the CPU proceeds to step 2095 of FIG. 20 by way of step 2295. In step 2095, the CPU once ends the routine.

On the other hand, when the EGR cooler coolant flow request flag Xegr is "0" at the time when the CPU executes the process of step 2205, the CPU makes negative determination in step 2205 and proceeds to step 2225. In step 2225, the CPU determines whether the heater core coolant flow request flag Xht is "1".

When the heater core coolant flow request flag Xht is "1", the CPU makes affirmative determination in step 2225, and proceeds to step 2230. In step 2230, the CPU controls the operation statuses of the pump 70, and the like, by executing the operation control G (see FIG. 11). After that, the CPU proceeds to step 2095 of FIG. 20 by way of step 2295. In step 2295, the CPU once ends the routine.

In contrast, when the heater core coolant flow request flag Xht is "0" at the time when the CPU executes the process of step 2225, the CPU makes negative determination in step 2225, and proceeds to step 2235. In step 2235, the CPU controls the operation statuses of the pump 70, and the like, by executing the operation control E (see FIG. 9). After that, the CPU proceeds to step 2095 of 20 by way of step 2295. In step 2095, the CPU once ends the routine.

When the engine coolant temperature TWeng is higher than or equal to the second engine coolant temperature TWeng2 at the time when the CPU executes the process of step 2020 of FIG. 20, the CPU makes negative determination in step 2020, and proceeds to step 2030. In step 2030, the CPU determines whether the engine coolant temperature TWeng is lower than the third engine coolant temperature TWeng3.

When the engine coolant temperature TWeng is lower than the third engine coolant temperature TWeng3, the CPU makes affirmative determination in step 2030, and proceeds to step 2035. In step 2035, the CPU executes a second warm-up pre-completion control routine shown by the flowchart in FIG. 23.

Figure 23:
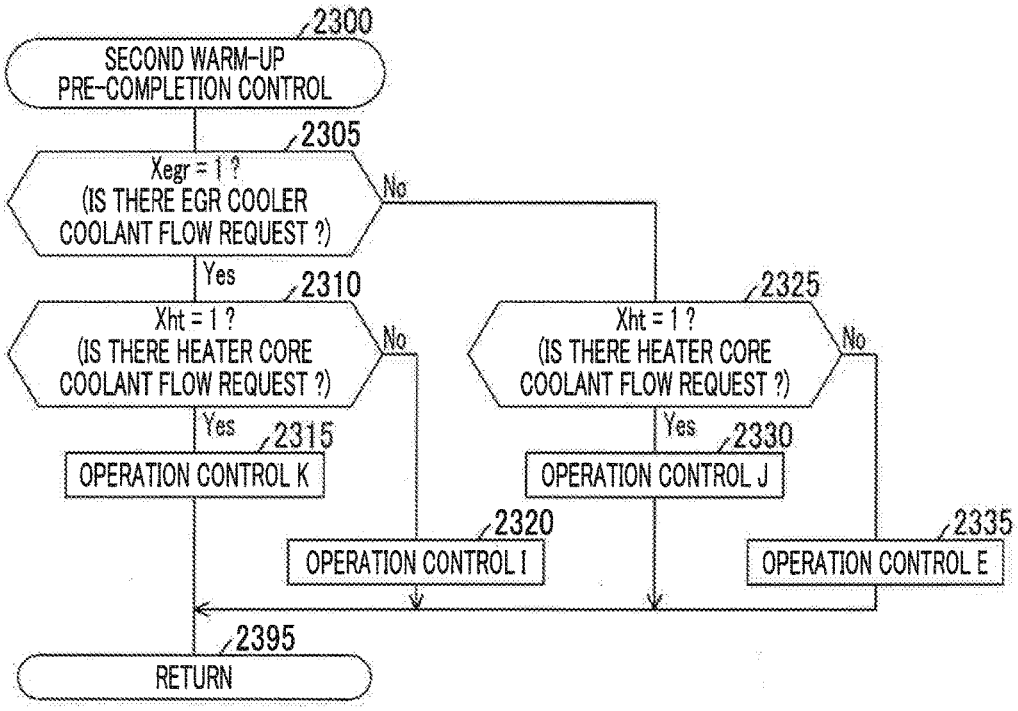
FIG. 23 is a flowchart that shows a routine that is executed by the CPU.

Therefore, as the CPU proceeds to step 2035, the CPU starts a process from step 2300 of FIG. 23, and proceeds to step 2305. In step 2305, the CPU determines whether the EGR cooler coolant flow request flag Xegr is "1", that is, whether there is an EGR cooler coolant flow request.

When the EGR cooler coolant flow request flag Xegr is "1", the CPU makes affirmative determination in step 2305, and proceeds to step 2310. In step 2310, the CPU determines whether the heater core coolant flow request flag Xht is "1", that is, whether there is a heater core coolant flow request.

When the heater core coolant flow request flag Xht is "1", the CPU makes affirmative determination in step 2310, and proceeds to step 2315. In step 2315, the CPU controls the operation statuses of the pump 70, and the like, by executing the operation control K (see FIG. 15). After that, the CPU proceeds to step 2095 of FIG. 20 by way of step 2395. In step 2095, the CPU once ends the routine.

In contrast, when the heater core coolant flow request flag Xht is "0" at the time when the CPU executes the process of step 2310, the CPU makes negative determination in step 2310, and proceeds to step 2320. In step 2320, the CPU controls the operation statuses of the pump 70, and the like, by executing the operation control I (see FIG. 13). After that, the CPU proceeds to step 2095 of FIG. 20 by way of step 2395. In step 2095, the CPU once ends the routine.

On the other hand, when the EGR cooler coolant flow request flag Xegr is "0" at the time when the CPU executes the process of step 2305, the CPU makes negative determination in step 2305, and proceeds to step 2325. In step 2325, the CPU determines whether the heater core coolant flow request flag Xht is "1".

When the heater core coolant flow request flag Xht is "1", the CPU makes affirmative determination in step 2325, and proceeds to step 2330. In step 2330, the CPU controls the operation statuses of the pump 70, and the like, by executing the operation control J (see FIG. 14). After that, the CPU proceeds to step 2095 of FIG. 20 by way of step 2395. In step 2095, the CPU one ends the routine.

In contrast, when the heater core coolant flow request flag Xht is "0" at the time when the CPU executes the process of step 2325, the CPU makes negative determination in step 2325, and proceeds to step 2335. In step 2335, the CPU controls the operation statuses of the pump 70, and the like, by executing the operation control E (see FIG. 9). After that, the CPU proceeds to step 2095 of FIG. 20 by way of step 2395. In step 2095, the CPU once ends the routine.

When the engine coolant temperature TWeng is higher than or equal to the third engine coolant temperature TWeng3 at the time when the CPU executes the process of step 2030 of FIG. 20, the CPU makes negative determination in step 2030, and proceeds to step 2040. In step 2040, the CPU executes a warm-up post-completion control routine shown by the flowchart in FIG. 24.

Figure 24:
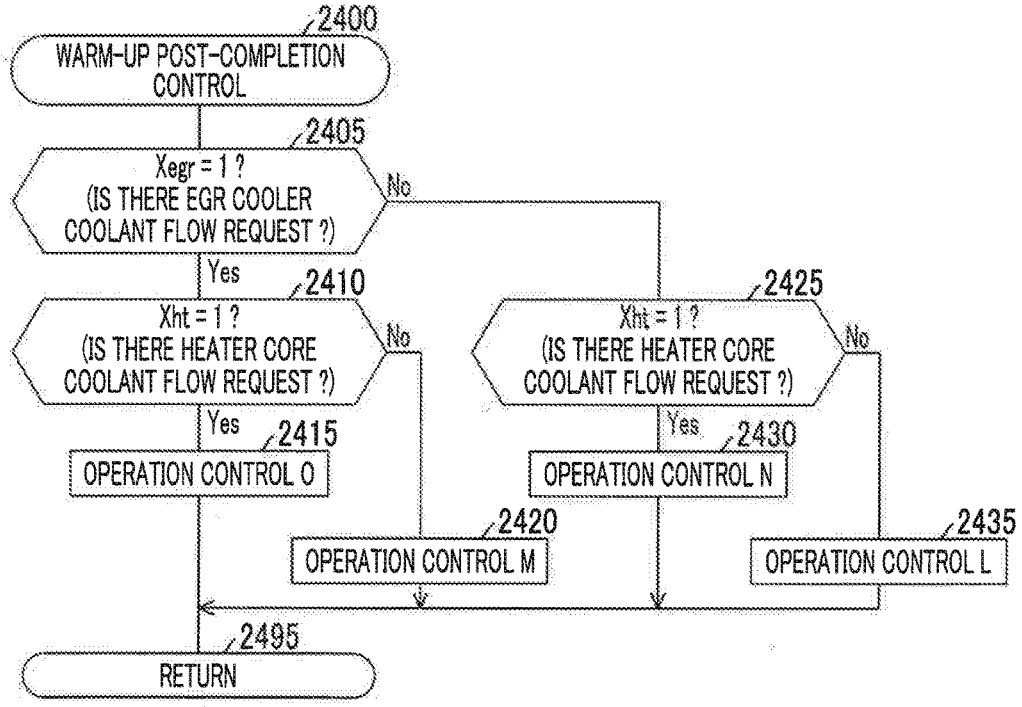
FIG. 24 is a flowchart that shows a routine that is executed by the CPU.

Therefore, as the CPU proceeds to step 2040, the CPU starts a process from step 2400 of FIG. 24, and proceeds to step 2405. In step 2405, the CPU determines whether the EGR cooler coolant flow request flag Xegr is "1", that is, whether there is an EGR cooler coolant flow request.

When the EGR cooler coolant flow request flag Xegr is "1", the CPU makes affirmative determination in step 2405, and proceeds to step 2410. In step 2410, the CPU determines whether the heater core coolant flow request flag Xht is "1", that is, whether there is a heater core coolant flow request.

When the heater core coolant flow request flag Xht is "1", the CPU makes affirmative determination in step 2410, and proceeds to step 2415. In step 2415, the CPU controls the operation statuses of the pump 70, and the like, by executing the operation control O (see FIG. 19). After that, the CPU proceeds to step 2095 of FIG. 20 by way of step 2495. In step 2095, the CPU once ends the routine.

In contrast, when the heater core coolant flow request flag Xht is "0" at the time when the CPU executes the process of step 2410, the CPU makes negative determination in step 2410, and proceeds to step 2420. In step 2420, the CPU controls the operation statuses of the pump 70, and the like, by executing the operation control M (see FIG. 17). After that, the CPU proceeds to step 2095 of FIG. 20 by way of step 2495. In step 2095, the CPU once ends the routine.

On the other hand, when the EGR cooler coolant flow request flag Xegr is "0" at the time when the CPU executes the process of step 2405, the CPU makes negative determination in step 2405, and proceeds to step 2425. In step 2425, the CPU determines whether the heater core coolant flow request flag Xht is "1".

When the heater core coolant flow request flag Xht is "1", the CPU makes affirmative determination in step 2425, and proceeds to step 2430. In step 2430, the CPU controls the operation statuses of the pump 70, and the like, by executing the operation control N (see FIG. 18). After that, the CPU proceeds to step 2095 of FIG. 20 by way of step 2495. In step 2095, the CPU once ends the routine.

In contrast, when the heater core coolant flow request flag Xht is "0" at the time when the CPU executes the process of step 2425, the CPU makes negative determination in step 2425, and proceeds to step 2435. In step 2435, the CPU controls the operation statuses of the pump 70, and the like, by executing the operation control L (see FIG. 16). After that, the CPU proceeds to step 2095 of FIG. 20 by way of step 2495. In step 2095, the CPU once ends the routine.

Figure 25:
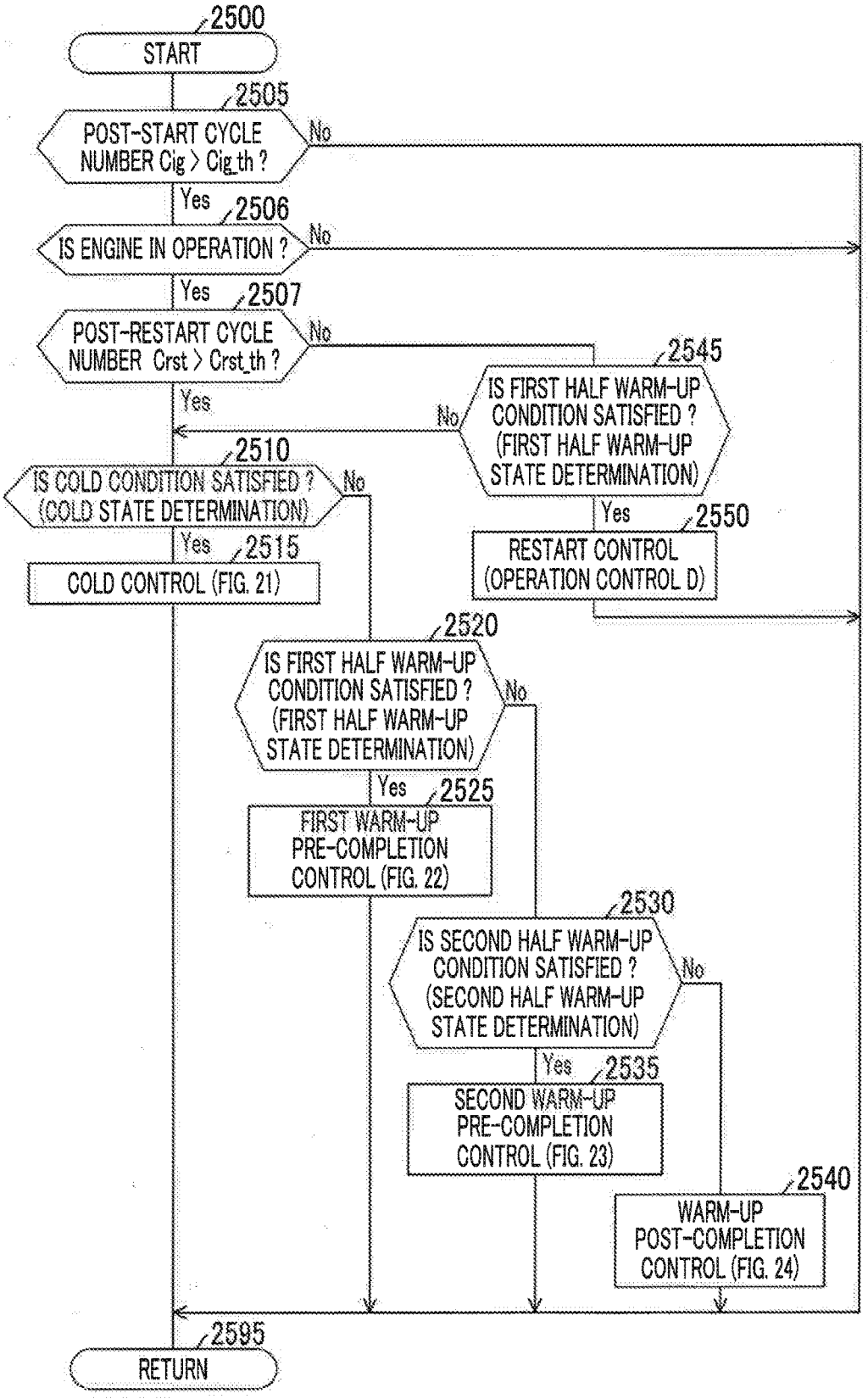
FIG. 25 is a flowchart that shows a routine that is executed by the CPU.

The CPU is configured to execute a routine shown by the flowchart in FIG. 25 at predetermined time intervals. Therefore, as predetermined timing comes, the CPU starts a process from step 2500 of FIG. 25, and proceeds to step 2505. In step 2505, the CPU determines whether the cycle number (post-start engine cycle number) Cig after a start of the engine 10 resulting from the ignition on operation is larger than the predetermined post-start engine cycle number Cig_th.

When the post-start engine cycle number Cig is smaller than or equal to the predetermined post-start engine cycle number Cig_th, the CPU makes negative determination in step 2505, and proceeds to step 2595. In step 2595, the CPU once ends the routine.

In contrast, when the post-start engine cycle number Cig is larger than the predetermined post-start engine cycle number Cig_th, the CPU makes affirmative determination in step 2505, and proceeds to step 2506. In step 2506, the CPU determines whether the engine is in operation. When the engine is not in operation, the CPU makes negative determination in step 2506, and proceeds to step 2595. In step 2595, the CPU once ends the routine.

In contrast, when the engine is in operation, the CPU makes affirmative determination in step 2506, and proceeds to step 2507. In step 2507, the CPU determines whether the cycle number (post-restart engine cycle number) Crst after a restart of the engine 10 is larger than the predetermined post-restart engine cycle number Crst_th.

When the post-restart engine cycle number Crst is larger than the predetermined post-restart engine cycle number Crst_th, the CPU makes affirmative determination in step 2507, and proceeds to step 2510. In step 2510, the CPU determines whether the cold condition is satisfied. When the cold condition is satisfied, the CPU makes affirmative determination in step 2510, and proceeds to step 2515. In step 2515, the CPU executes the cold control routine shown in FIG. 21, and, after that, proceeds to step 2595. In step 2595, the CPU once ends the routine.

In contrast when the cold condition is not satisfied at the time when the CPU executes the process of step 2510, the CPU makes negative determination in step 2510, and proceeds to step 2520. In step 2520, the CPU determines whether the first half warm-up condition is satisfied. When the first half warm-up condition is satisfied, the CPU makes affirmative determination in step 2520, and proceeds to step 2525. In step 2525, the CPU executes the first warm-up pre-completion control routine shown in FIG. 22, and, after that, proceeds to step 2595. In step 2595, the CPU once ends the routine.

In contrast, when the first half warm-up condition is not satisfied at the time when the CPU executes the process of step 2520, the CPU makes negative determination in step 2520, and proceeds to step 2530. In step 2530, the CPU determines whether the second half warm-up condition is satisfied. When the second half warm-up condition is satisfied, the CPU makes affirmative determination in step 2530, and proceeds to step 2535. In step 2535, the CPU executes the second warm-up pre-completion control routine shown in FIG. 23, and, after that, proceeds to step 2595. In step 2595, the CPU once ends the routine.

In contrast, when the second half warm-up condition is not satisfied at the time when the CPU executes the process of step 2530, the CPU makes negative determination in step 2530, and proceeds to step 2540. In step 2540, the CPU executes the warm-up post-completion control routine shown in FIG. 24, and, after that, proceeds to step 2595. In step 2595, the CPU once ends the routine.

On the other hand, when the post-restart engine cycle number Crst is smaller than or equal to the predetermined post-restart engine cycle number Crst_th at the time when the CPU executes the process of step 2507, the CPU makes negative determination in step 2507, and proceeds to step 2545. In step 2545, the CPU determines whether the first half warm-up condition is satisfied.

When the first half warm-up condition is satisfied, the CPU makes affirmative determination in step 2545, and proceeds to step 2550. In step 2550, the CPU controls the operation statuses of the pump 70, and the like, by executing restart control (operation control D). After that, the CPU proceeds to step 2595. In step 2595, the CPU once ends the routine.

In contrast, when the first half warm-up condition is not satisfied at the time when the CPU executes the process of step 2545, the CPU makes negative determination in step 2545, and proceeds to step 2510. As described above, the CPU executes processes in step 2510 and the following steps.

When the CPU makes negative determination in step 2545 and proceeds to step 2510 and further makes negative determination in step 2510 and proceeds to step 2520, the CPU has already determined in step 2545 that the first half warm-up condition is not satisfied, so the CPU also determines that the first half warm-up condition is not satisfied, that is, the CPU makes negative determination, in step 2520.

Figure 26:
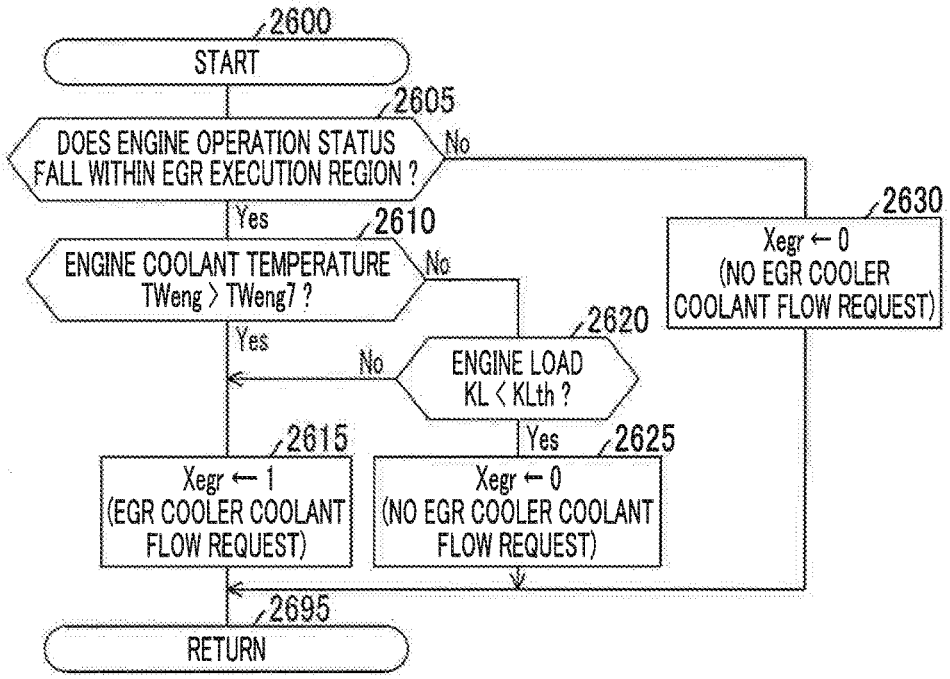
FIG. 26 is a flowchart that shows a routine that is executed by the CPU.

The CPU is configured to execute a routine shown by the flowchart in FIG. 26 at predetermined time intervals. Therefore, as predetermined timing comes, the CPU starts a process from step 2600 of FIG. 26, and proceeds to step 2605. In step 2605, the CPU determines whether the engine operation status falls within the EGR execution region Rb.

When the engine operation status falls within the EGR execution region Rb, the CPU makes affirmative determination in step 2605, and proceeds to step 2610. In step 2610, the CPU determines whether the engine coolant temperature TWeng is higher than the seventh engine coolant temperature TWeng7.

When the engine coolant temperature TWeng is higher than the seventh engine coolant temperature TWeng7, the CPU makes affirmative determination in step 2610, and proceeds to step 2615. In step 2615, the CPU sets the EGR cooler coolant flow request flag Xegr to "1". After that, the CPU proceeds to step 2695. In step 2695, the CPU once ends the routine.

In contrast, when the engine coolant temperature TWeng is lower than or equal to the seventh engine coolant temperature TWeng7, the CPU makes negative determination in step 2610, and proceeds to step 2620. In step 2620, the CPU determines whether the engine load KL is smaller than the threshold load KLth.

When the engine load KL is smaller than the threshold load KLth, the CPU makes affirmative determination in step 2620, and proceeds to step 2625. In step 2625, the CPU sets the EGR cooler coolant flow request flag Xegr to "0". After that, the CPU proceeds to step 2695. In step 2695, the CPU once ends the routine.

In contrast, when the engine load KL is larger than or equal to the threshold load KLth, the CPU makes negative determination in step 2620, and proceeds to step 2615. In step 2615, the CPU sets the EGR cooler coolant flow request flag Xegr to "1". After that, the CPU proceeds to step 2695. In step 2695, the CPU once ends the routine.

On the other hand, when the engine operation status falls outside the EGR execution region Rb at the time when the CPU executes the process of step 2605, the CPU makes negative determination in step 2605, and proceeds to step 2630. In step 2630, the CPU sets the EGR cooler coolant flow request flag Xegr to "0". After that, the CPU proceeds to step 2695. In step 2695, the CPU once ends the routine.

Figure 27:
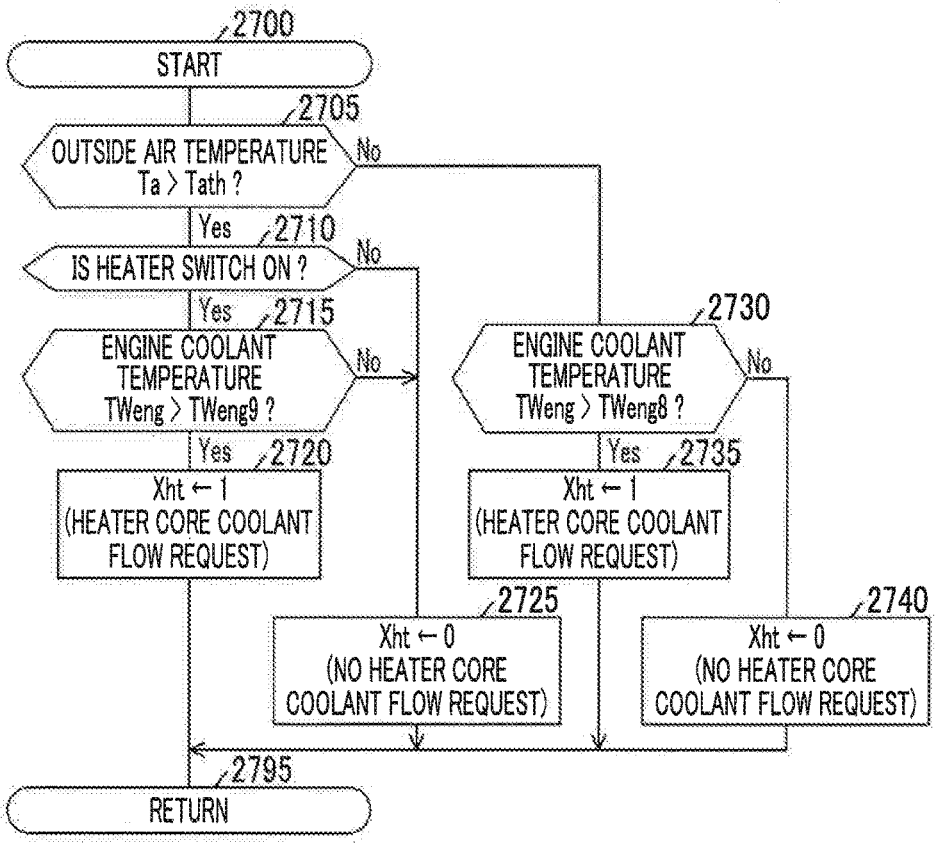
FIG. 27 is a flowchart that shows a routine that is executed by the CPU.

The CPU is configured to execute a routine shown by the flowchart in FIG. 27 at predetermined time intervals. Therefore, as predetermined timing comes, the CPU starts a process from step 2700 of FIG. 27, and proceeds to step 2705. In step 2705, the CPU determines whether the outside air temperature Ta is higher than the threshold temperature Tath.

When the outside air temperature Ta is higher than the threshold temperature Tath, the CPU makes affirmative determination in step 2705, and proceeds to step 2710. In step 2710, the CPU determines whether the heater switch 88 is set in the on position.

When the heater switch 88 is set in the on position, the CPU makes affirmative determination in step 2710, and proceeds to step 2715. In step 2715, the CPU determines whether the engine coolant temperature TWeng is higher than the ninth engine coolant temperature TWeng9.

When the engine coolant temperature TWeng is higher than the ninth engine coolant temperature TWeng9, the CPU makes affirmative determination in step 2715, and proceeds to step 2720. In step 2720, the CPU sets the heater core coolant flow request flag Xht to "1". After that, the CPU proceeds to step 2795. In step 2795, the CPU once ends the routine.

In contrast, when the engine coolant temperature TWeng is lower than or equal to the ninth engine coolant temperature TWeng9, the CPU makes negative determination in step 2715, and proceeds to step 2725. In step 2725, the CPU sets the heater core coolant flow request flag Xht to "0". After that, the CPU proceeds to step 2795. In step 2795, the CPU once ends the routine.

On the other hand, when the heater switch 88 is set in the off position at the time when the CPU executes the process of step 2710, the CPU makes negative determination in step 2710, and proceeds to step 2725. In step 2725, the CPU sets the heater core coolant flow request flag Xht to "0". After that, the CPU proceeds to step 2795. In step 2795, the CPU once ends the routine.

When the outside air temperature Ta is lower than or equal to the threshold temperature Tath at the time when the CPU executes the process of step 2705, the CPU makes negative determination in step 2705, and proceeds to step 2730. In step 2730, the CPU determines whether the engine coolant temperature TWeng is higher than the eighth engine coolant temperature TWeng8.

When the engine coolant temperature TWeng is higher than the eighth engine coolant temperature TWeng8, the CPU makes affirmative determination in step 2730, and proceeds to step 2735. In step 2735, the CPU sets the heater core coolant flow request flag Xht to "1". After that, the CPU proceeds to step 2795. In step 2795, the CPU once ends the routine.

In contrast, when the engine coolant temperature TWeng is lower than or equal to the eighth engine coolant temperature TWeng8, the CPU makes negative determination in step 2730, and proceeds to step 2740. In step 2740, the CPU sets the heater core coolant flow request flag Xht to "0". After that, the CPU proceeds to step 2795. In step 2795, the CPU once ends the routine.

Figure 28:
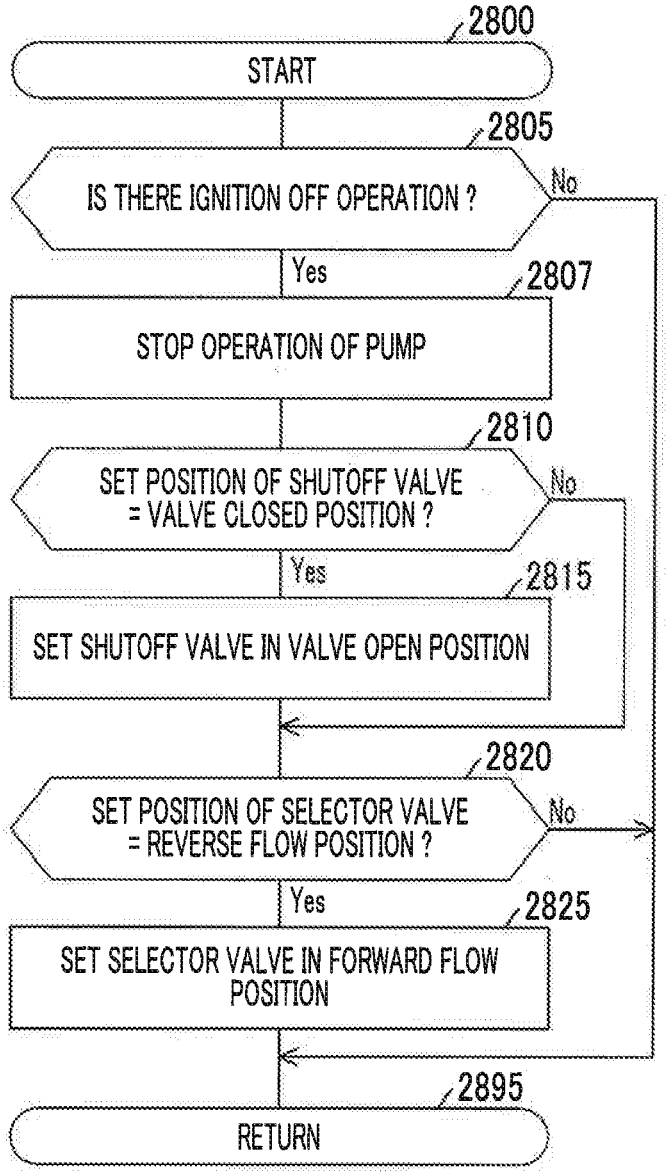
FIG. 28 is a flowchart that shows a routine that is executed by the CPU.

The CPU is configured to execute a routine shown by the flowchart in FIG. 28 at predetermined time intervals. Therefore, as predetermined timing comes, the CPU starts a process from step 2800 of FIG. 28, and proceeds to step 2805. In step 2805, the CPU determines whether the ignition off operation has been performed.

When the ignition off operation has been performed, the CPU makes affirmative determination in step 2805, and proceeds to step 2807. In step 2807, the CPU stops the operation of the pump 70, and, after that, proceeds to step 2810. In step 2810, the CPU determines whether the shutoff valve 75 is set in the valve closed position.

When the shutoff valve 75 is set in the valve closed position, the CPU makes affirmative determination in step 2810, and proceeds to step 2815. In step 2815, the CPU sets the shutoff valve 75 in the valve open position. After that, the CPU proceeds to step 2820.

In contrast; when the shutoff valve 75 is set in the valve open position, the CPU makes negative determination in step 2810, and directly proceeds to step 2820.

As the CPU proceeds to step 2820, the CPU determines whether the selector valve 78 is set in the reverse flow position. When the selector valve 78 is set in the reverse flow position, the CPU makes affirmative determination in step 2820, and proceeds to step 2825. In step 2825, the CPU sets the selector valve 78 in the forward flow position. After that, the CPU proceeds to step 2895. In step 2895, the CPU once ends the routine.

In contrast, when the selector valve 78 is set in the forward flow position at the time when the CPU executes the process of step 2820, the CPU makes negative determination in step 2820, and directly proceeds to step 2895. In step 2895, the CPU once ends the routine.

When the ignition off operation has not been performed at the time when the CPU executes the process of step 2805, the CPU makes negative determination in step 2805, and directly proceeds to step 2895. In step 2895, the CPU once ends the routine.

The specific operation of the cooling system is described above. With this configuration, during a period until warm-up of the engine 10 completes, it is possible to achieve supply of coolant in response to the EGR cooler coolant flow request and the heater core coolant flow request and also to increase the engine temperature Teng at a high rate.

The disclosure is not limited to the above-described embodiment. Various alternative embodiments may be employed within the scope of the disclosure.

First Alternative Embodiment

Figure 29:
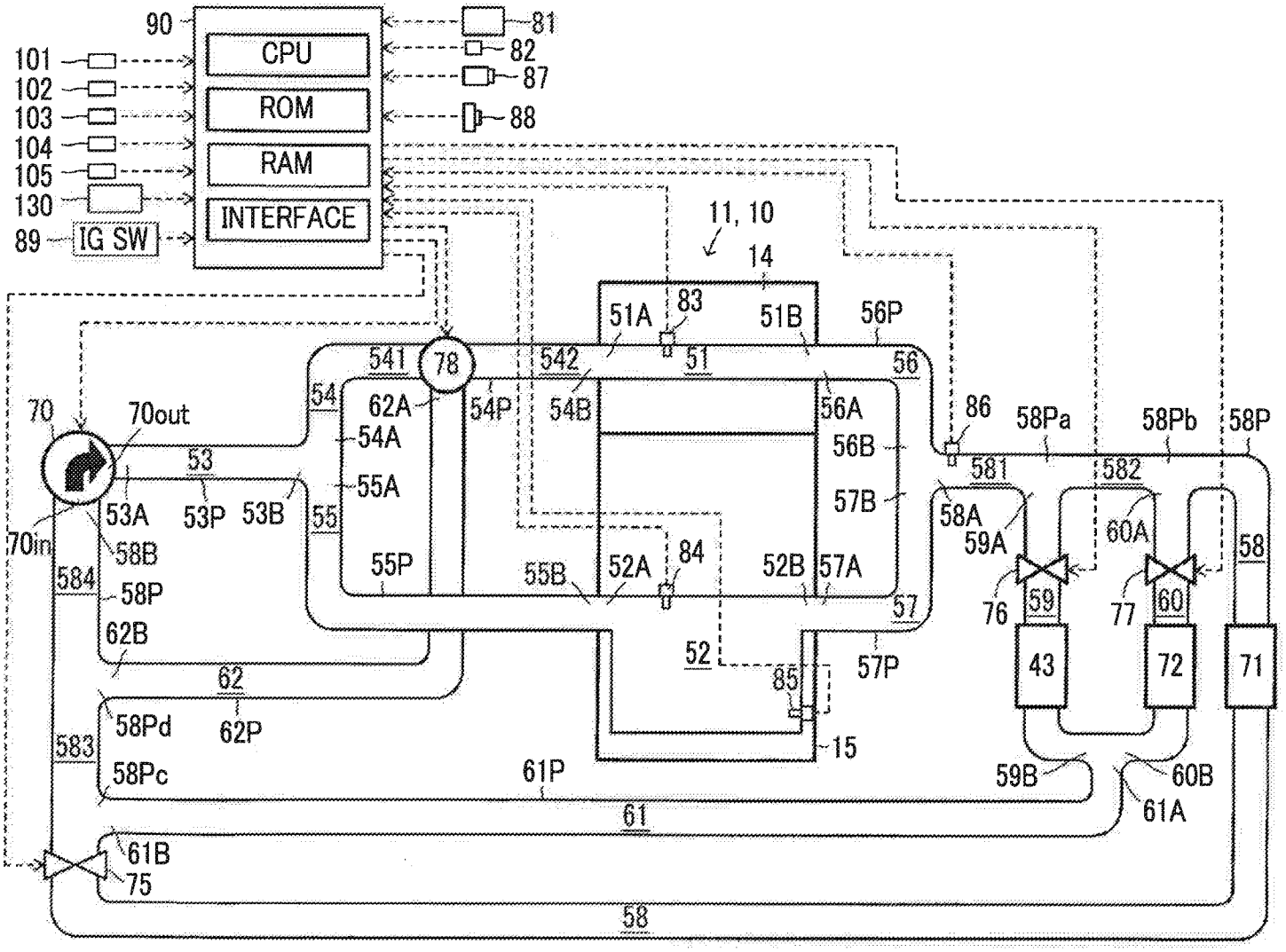
FIG. 29 is a diagram that shows a cooling system according to a first alternative embodiment to the embodiment.

For example, the disclosure is also applicable to a cooling system according to a first alternative embodiment to the embodiment of the disclosure as shown in FIG. 29. In the cooling system according to the first alternative embodiment, the selector valve 78 is not disposed in the coolant pipe 55P, and the selector valve 78 is disposed in the coolant pipe 54P. The first end 61A of the coolant pipe 62P is connected to the selector valve 78.

When the selector valve 78 is set in the forward flow position, the selector valve 78 permits passage of coolant between a portion 541 of the coolant passage 54 (hereinafter, referred to as the first portion 541 of the coolant passage 54) between the selector valve 78 and the first end 54A of the coolant pipe 54P and a portion 542 of the coolant passage 54 (hereinafter, referred to as the second portion 542 of the coolant passage 54) between the selector valve 78 and the second end 54B of the coolant pipe 54P, while the selector valve 78 shuts off passage of coolant between the first portion 541 of the coolant passage 54 and the coolant passage 62 and passage of coolant between the second portion 542 of the coolant passage 54 and the coolant passage 62.

On the other hand, when the selector valve 78 is set in the reverse flow position, the selector valve 78 permits passage of coolant between the second portion 542 of the coolant passage 54 and the coolant passage 62, while the selector valve 78 shuts off passage of coolant between the first portion 541 of the coolant passage 54 and the coolant passage 62 and passage of coolant between the first portion 541 of the coolant passage 54 and the second portion 542.

When the selector valve 78 is set in the shutoff position, the selector valve 78 shuts off passage of coolant between the first portion 541 and second portion 542 of the coolant passage 54, passage of coolant between the first portion 541 of the coolant passage 54 and the coolant passage 62 and passage of coolant between the second portion 542 of the coolant passage 54 and the coolant passage 62.

Operation of Cooling System According to First Alternative Embodiment

The cooling system according to the first alternative embodiment executes any one of the operation controls A, B, C, D, E, F, G, H, I, J, K, J, M, N, O under the same condition as the condition that the cooling system according to the embodiment executes each of the operation controls A, B, C, D, E, F, G, H, I, J, K, L, M, N, O. Hereinafter, among the operation controls A, B, C, D, E, F, G, H, I, J, K, L, M, N, O that the cooling system according to the first alternative embodiment executes, the operation control E and the operation control L that are typical operation controls will be described.

Operation Control E

Figure 30:
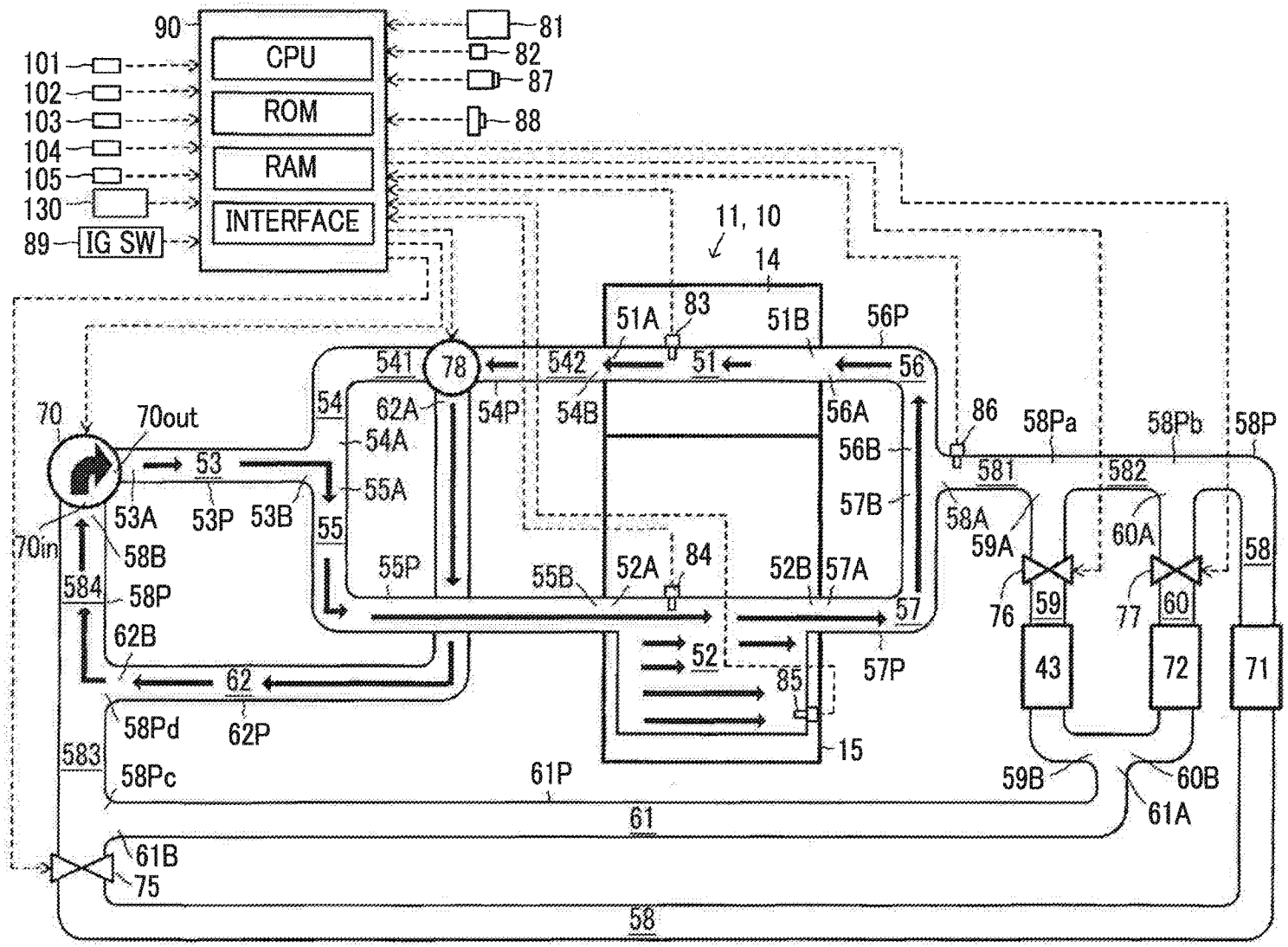
FIG. 30 is a diagram similar to that of FIG. 29 and is a diagram that shows a flow of coolant when the cooling system according to the first alternative embodiment executes operation control E.

When the condition that the cooling system according to the first alternative embodiment executes the operation control E is satisfied, the cooling system according to the first alternative embodiment executes the operation control E. In the operation control E, the pump 70 is operated, and the shutoff valves 75, 76, 77 each are set in the valve closed position and the selector valve 78 is set in the reverse flow position such that coolant circulates as indicated by the arrows in FIG. 30.

Thus, coolant discharged from the pump outlet port 70out to the coolant passage 53 flows into the block coolant passage 52 via the coolant passage 55. The coolant flows through the block coolant passage 52 and then flows into the head coolant passage 51 via the coolant passage 57 and the coolant passage 56. The coolant flows through the head coolant passage 51, then flows through the second portion 542 of the coolant passage 54, the coolant passage 62 and the fourth portion 584 of the radiator coolant passage 58 sequentially, and is introduced into the pump 70 from the pump inlet port 70in.

With the operation control E that is executed by the cooling system according to the first alternative embodiment, coolant flowing through the head coolant passage 51 and having a high temperature flows through the second portion 542 of the coolant passage 54 the selector valve 78, the coolant passage 62, the fourth portion 584 of the radiator coolant passage 58, the pump 70, the coolant passage 53 and the coolant passage 55, and then flows into the block coolant passage 52 without passing through any of the radiator 71, and the like. For this reason, in comparison with the case where coolant that has passed through any of the radiator 71, and the like, is supplied to the block coolant passage 52, it is possible to increase the block temperature Tbr at a high rate.

Since coolant that has not passed through any of the radiator 71, and the like, is supplied also to the head coolant passage 51, it is possible to increase the head temperature Thd at a high rate in comparison with the case where coolant that has passed through any of the radiator 71, and the like, is supplied to the head coolant passage 51.

In addition, since coolant flows through the head coolant passage 51 and the block coolant passage 52, it is possible to prevent the temperature of coolant from becoming partially extremely high in the head coolant passage 51 or the block coolant passage 52. As a result, it is possible to prevent a boil of coolant in the head coolant passage 51 or the block coolant passage 52.

Operation Control L

Figure 31:
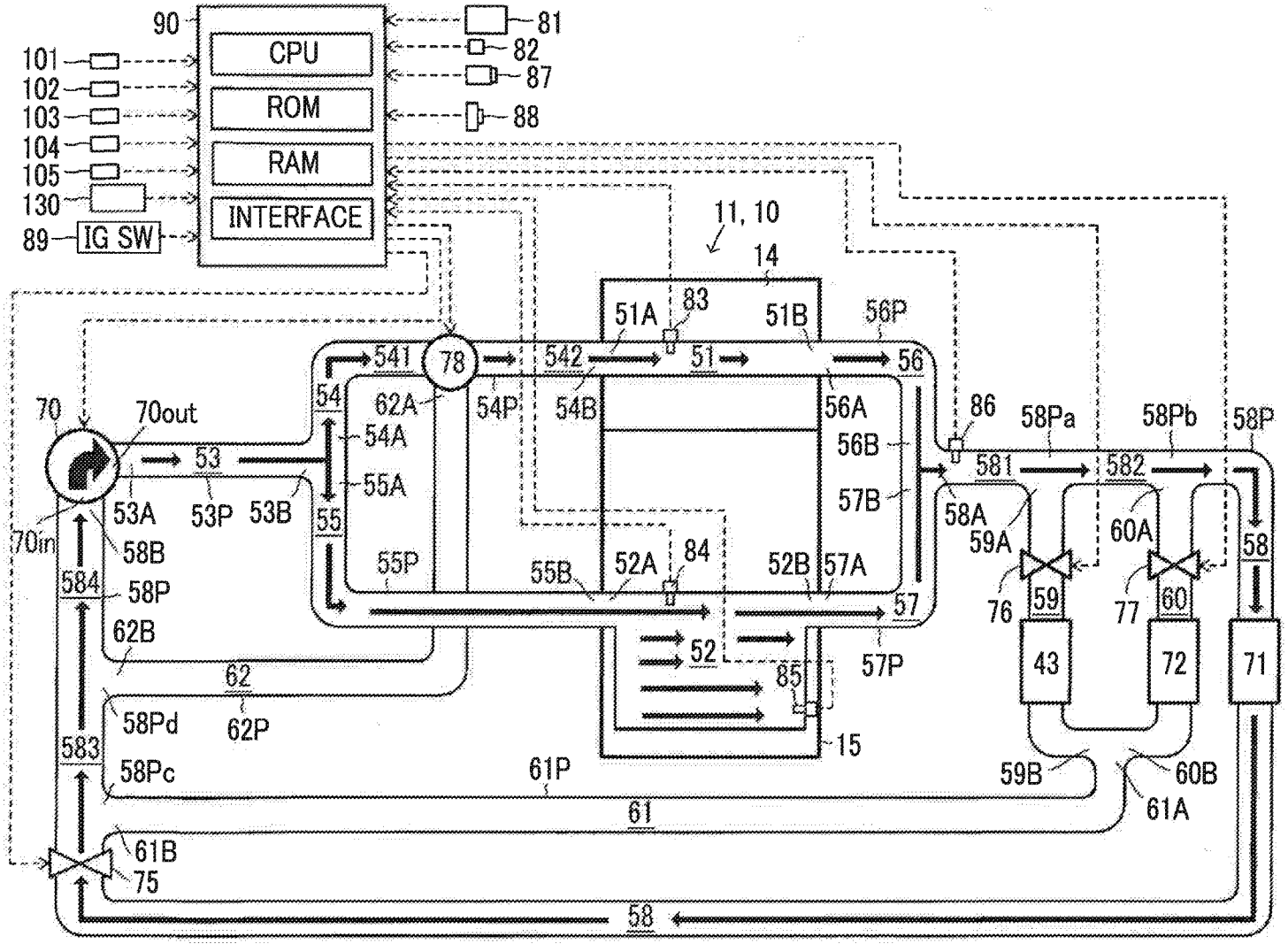
FIG. 31 is a diagram similar to that of FIG. 29 and is a diagram that shows a flow of coolant when the cooling system according to the first alternative embodiment executes operation control L.

On the other hand, when the condition that the cooling system according to the first alternative embodiment executes the operation control L is satisfied, the cooling system according to the first alternative embodiment executes the operation control L. In the operation control L, the pump 70 is operated, and the shutoff valves 76, 77 each are set in the valve closed position, the shutoff valve 75 is set in the valve open position and the selector valve 78 is set in the forward flow position such that coolant circulates as indicated by the arrows in FIG. 31.

Thus, part of coolant discharged from the pump outlet port 70out to the coolant passage 53 flows into the head coolant passage 51 via the coolant passage 54. On the other hand, the remaining part of coolant discharged to the coolant passage 53 flows into the block coolant passage 52 via the coolant passage 55.

Coolant flowing into the head coolant passage 51 flows through the head coolant passage 51 and then flows into the radiator coolant passage 58 via the coolant passage 56. On the other hand, coolant flowing into the block coolant passage 52 flows through the block coolant passage 52 and then flows into the radiator coolant passage 58 via the coolant passage 57. Coolant flowing into the radiator coolant passage 58 passes through the radiator 71, and is then introduced into the pump 70 from the pump inlet port 70in.

With the operation control L that is executed by the cooling system according to the first alternative embodiment, since coolant that has passed through the radiator 71 is supplied to the head coolant passage 51 and the block coolant passage 52, it is possible to cool the cylinder head 14 and the cylinder block 15 with the use of coolant having a low temperature.

Second Alternative Embodiment

Figure 32:
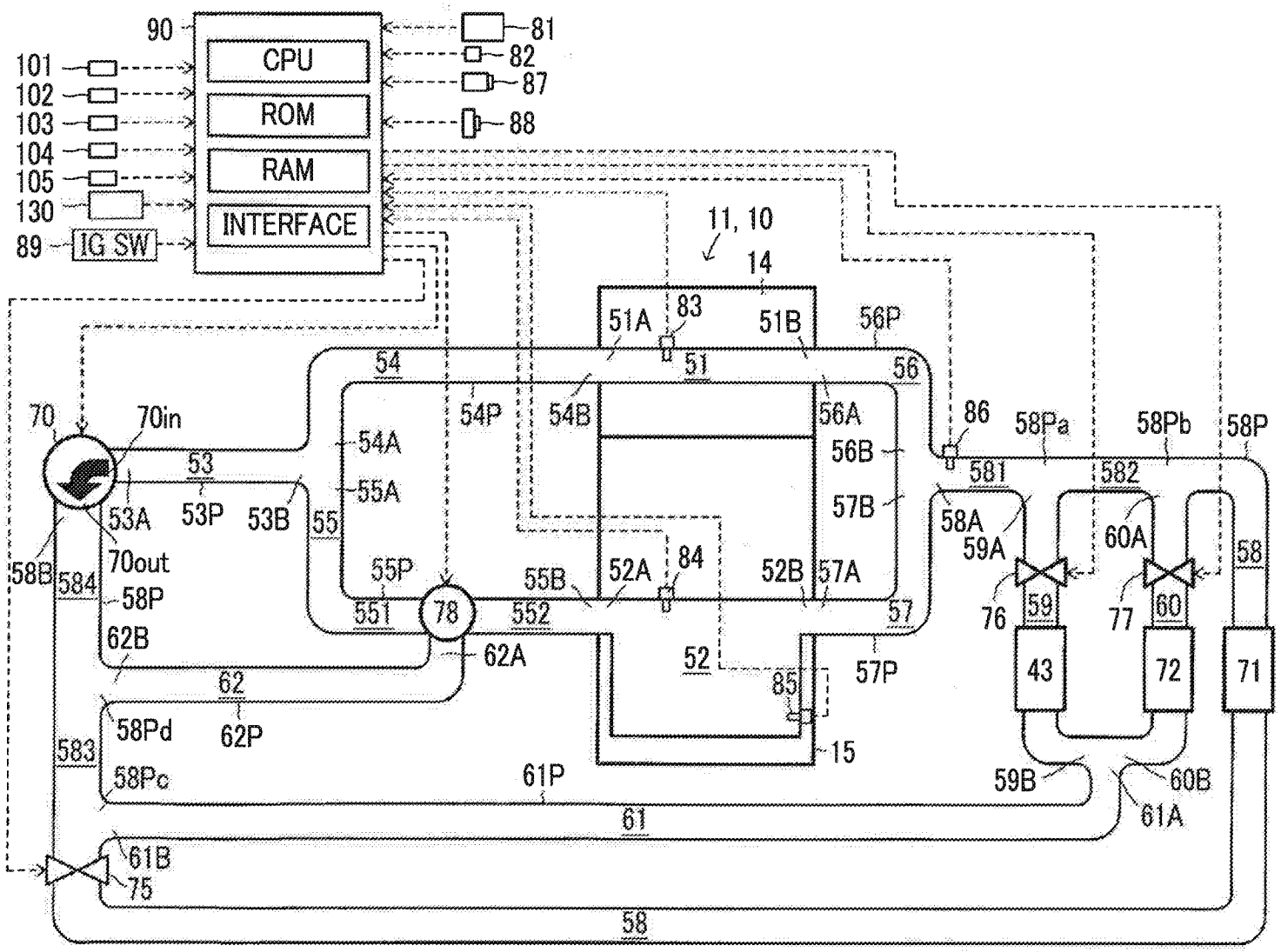
FIG. 32 is a diagram that shows a cooling system according to a second alternative embodiment to the embodiment.

The disclosure is also applicable to a cooling system according to a second alternative embodiment to the embodiment of the disclosure as shown in FIG. 32. In the cooling system according to the second alternative embodiment, the pump 70 is disposed such that the pump inlet port 70in is connected to the coolant passage 53 and the pump outlet port 70out is connected to the radiator coolant passage 58.

Operation of Cooling System According to Second Alternative Embodiment

The cooling system according to the second alternative embodiment executes each one of the operation controls A, B, C, D, E, F, G, H, I, J, K, L, M, N, O under the same condition as the condition that the cooling system according to the embodiment executes a corresponding one of the operation controls A, B, C, D, E, F, G, H, I, J, K, L, M, N, O. Hereinafter, among the operation controls A, B, C, D, E, F, G, H, I, J, K, M, N, O that the cooling system according to the second alternative embodiment executes, the operation control E and the operation control L that are typical operation controls will be described.

Operation Control E

Figure 33:
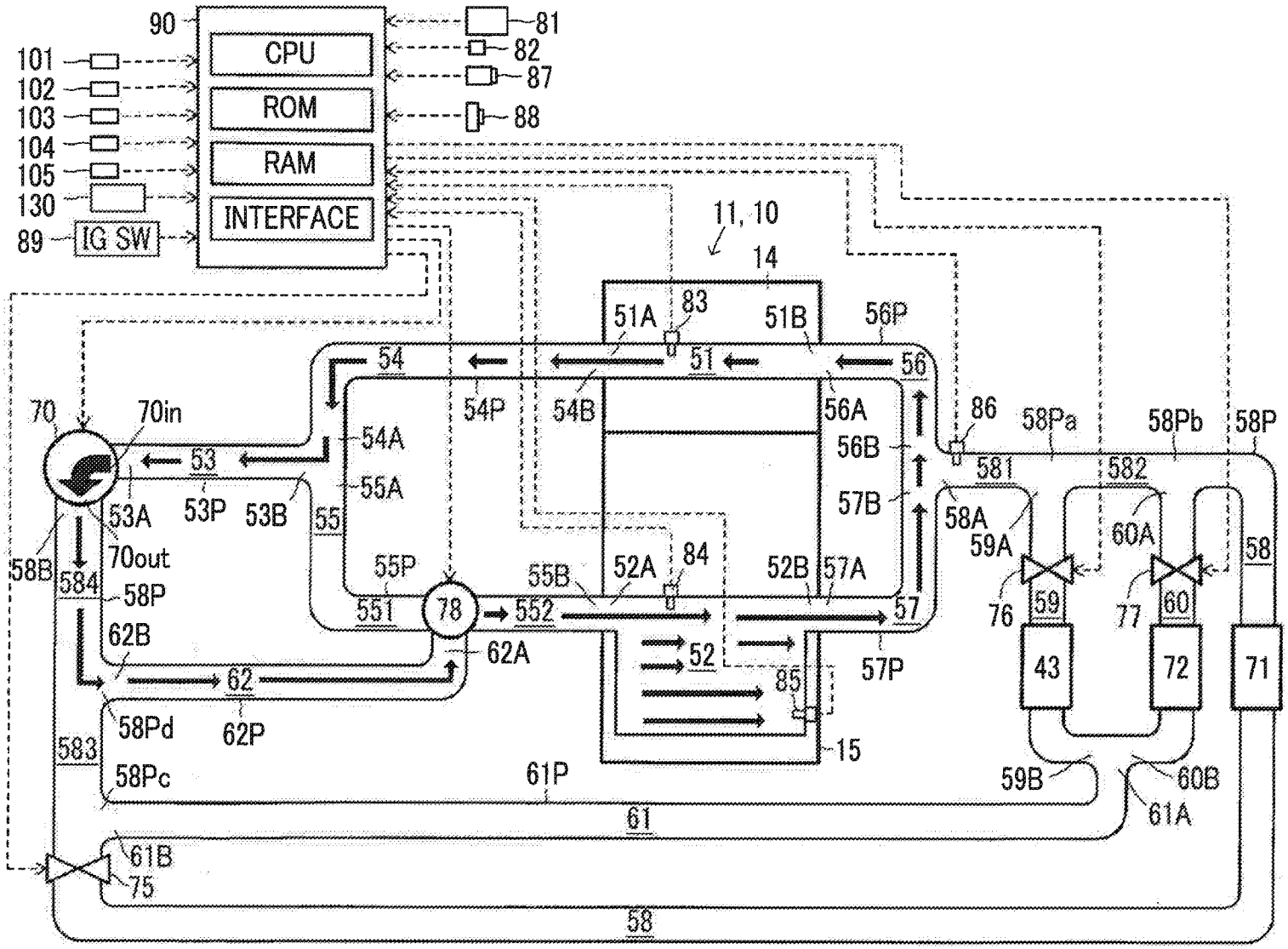
FIG. 33 is a diagram similar to that of FIG. 32 and is a diagram that shows a flow of coolant when the cooling system according to the second alternative embodiment executes operation control E.

When the condition that the cooling system according to the second alternative embodiment executes the operation control E is satisfied, the cooling system according to the second alternative embodiment executes the operation control E. In the operation control E, the pump 70 is operated, and the shutoff valves 75, 76, 77 each are set in the valve closed position and the selector valve 78 is set in the reverse flow position such that coolant circulates as indicated by the arrows in FIG. 33.

Thus, coolant discharged from the pump outlet port 70out to the radiator coolant passage 58 flows into the block coolant passage 52 via the coolant passage 62 and the second portion 552 of the coolant passage 55. The coolant flows through the block coolant passage 52 and then flows into the head coolant passage 51 via the coolant passage 57 and the coolant passage 56. The coolant flows through the head coolant passage 51, then flows through the coolant passage 54 and the coolant passage 53 sequentially, and is introduced into the pump 70 from the pump inlet port 70in.

With the operation control E that is executed by the cooling system according to the second alternative embodiment, coolant flowing through the head coolant passage 51 and having a high temperature flows through the coolant passage 54, the coolant passage 53, the pump 70, the fourth portion 584 of the radiator coolant passage 58, the coolant passage 62, the selector valve 78 and the second portion 552 of the coolant passage 55 and then flows into the block coolant passage 52 without passing through any of the radiator 71, and the like. For this reason, in comparison with the case where coolant that has passed through any of the radiator 71, and the like, is supplied to the block coolant passage 52, it is possible to increase the block temperature Tbr at a high rate.

Since coolant that has not passed through any of the radiator 71, and the like, is supplied also to the head coolant passage 51, it is possible to increase the head temperature Thd at a high rate in comparison with the case where coolant that has passed through any of the radiator 71, and the like, is supplied to the head coolant passage 51.

In addition, since coolant flows through the head coolant passage 51 and the block coolant passage 52, it is possible to prevent the temperature of coolant from becoming partially extremely high in the head coolant passage 51 or the block coolant passage 52. As a result, it is possible to prevent a boil of coolant in the head coolant passage 51 or the block coolant passage 52.

Operation Control L

Figure 34:
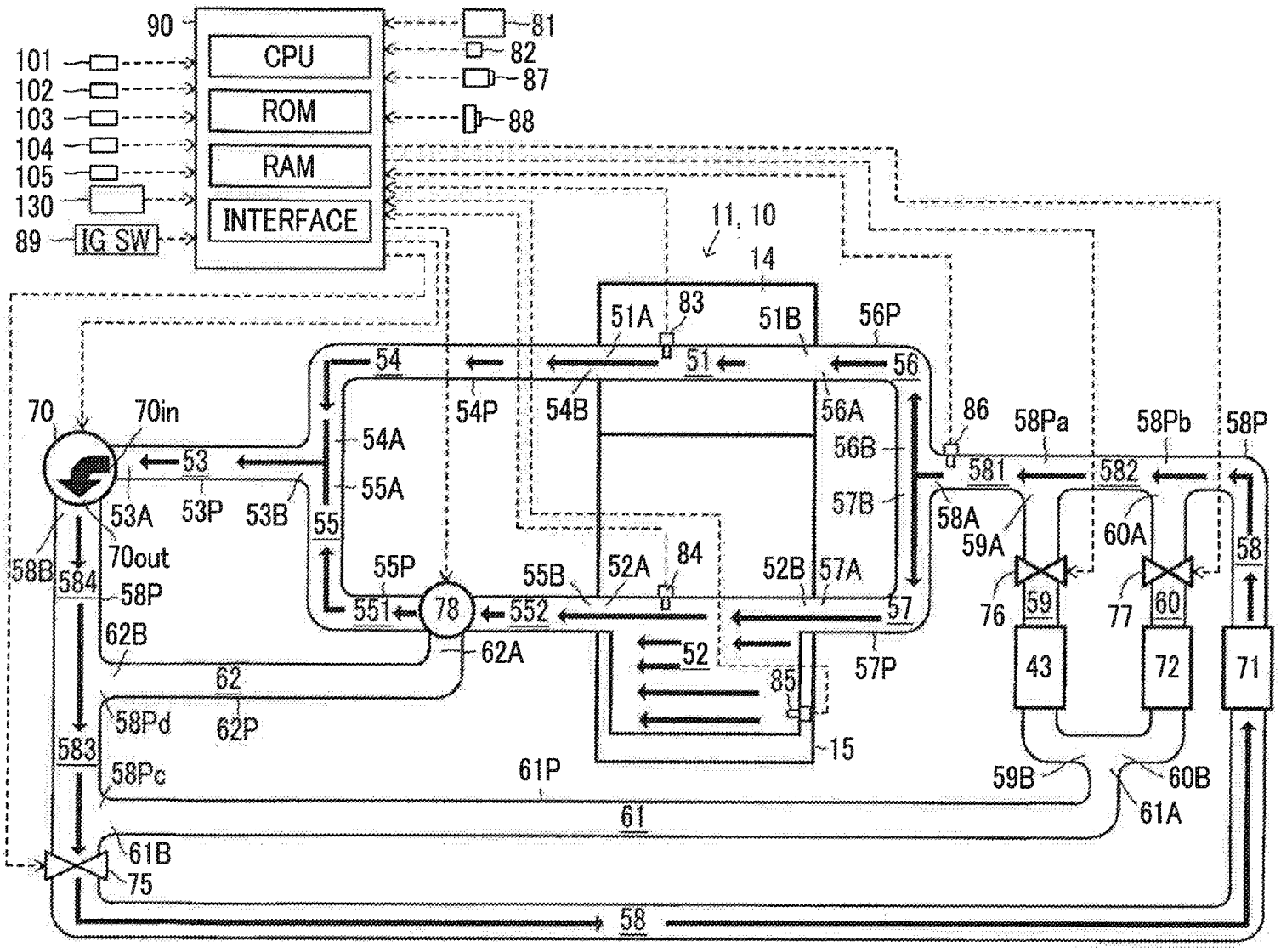
FIG. 34 is a diagram similar to that of FIG. 32 and is a diagram that shows a flow of coolant when the cooling system according to the second alternative embodiment executes operation control L.

On the other hand, when the condition that the cooling system according to the second alternative embodiment executes the operation control L is satisfied, the control system according to the second alternative embodiment executes the operation control L. In the operation control L, the pump 70 is operated, and the shutoff valves 76, 77 each are set in the valve closed position, the shutoff valve 75 is set in the valve open position and the selector valve 78 is set in the forward flow position such that coolant circulates as indicated by the arrows in FIG. 34.

Thus, part of coolant discharged from the pump outlet port 70out to the radiator coolant passage 58 flows into the head coolant passage 51 via the coolant passage 56. On the other hand, the remaining part of coolant discharged to the radiator coolant passage 58 flows into the block coolant passage 52 via the coolant passage 57.

Coolant flowing into the head coolant passage 51 flows through the head coolant passage 51, flows through the coolant passage 54 and the coolant passage 53 sequentially, and is introduced into the pump 70 from the pump inlet port 70in. On the other hand, coolant flowing into the block coolant passage 52 flows through the block coolant passage 52, then flows through the coolant passage 55 and the coolant passage 53 sequentially, and is introduced into the pump 70 from the pump inlet port 70in.

With the operation control L that is executed by the cooling system according to the second alternative embodiment, since coolant that has passed through the radiator 71 is supplied to the head coolant passage 51 and the block coolant passage 52, it is possible to cool the cylinder head 14 and the cylinder block 15 with the use of coolant having a low temperature.

Third Alternative Embodiment

Figure 35:
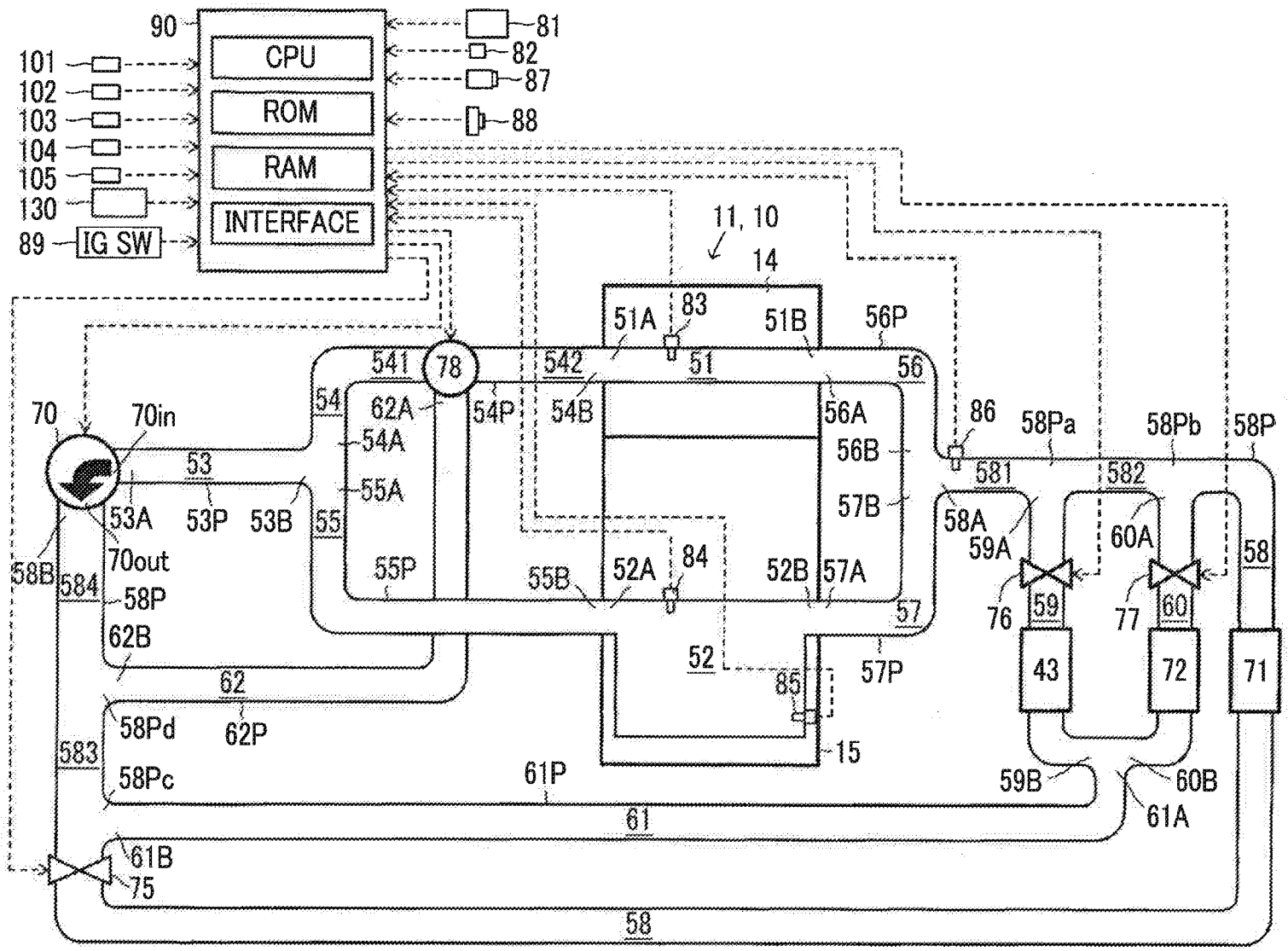
FIG. 35 is a diagram that shows a cooling system according to a third alternative embodiment to the embodiment.

The disclosure is also applicable to a cooling system according to a third alternative embodiment to the embodiment of the disclosure as shown in FIG. 35. In the cooling system according to the third alternative embodiment, as well as the cooling system according to the first alternative embodiment, the selector valve 78 is not disposed in the coolant pipe 55P, and the selector valve 78 is disposed in the coolant pipe 54P. The first end 61A of the coolant pipe 62P is connected to the selector valve 78.

In the cooling system according to the third alternative embodiment, as well as the cooling system according to the second alternative embodiment, the pump 70 is disposed such that the pump inlet port 70in is connected to the coolant passage 53 and the pump outlet port 70out is connected to the radiator coolant passage 58.

The working of the selector valve 78 in the case where the selector valve 78 of the cooling system according to the third alternative embodiment is set in each of the forward flow position and the reverse flow position is the same as the working of the selector valve 78 of the cooling system according to the first alternative embodiment.

Operation of Cooling System According to Third Alternative Embodiment

The cooling system according to the third alternative embodiment executes each one of the operation controls A, B, C, D, E, F, G, H, I, J, K, L, M, N, O under the same condition as the condition that the cooling system according to the embodiment executes a corresponding one of the operation controls A, B, C, D, E, F, G, H, I, J, K, L, M, N, O. Hereinafter, among the operation controls A, B, C, D, E, F, G, H, I, J, K, L, N, O that the cooling system according to the third alternative embodiment executes, the operation control F and the operation control L that are typical operation controls will be described.

Operation Control E

Figure 36:
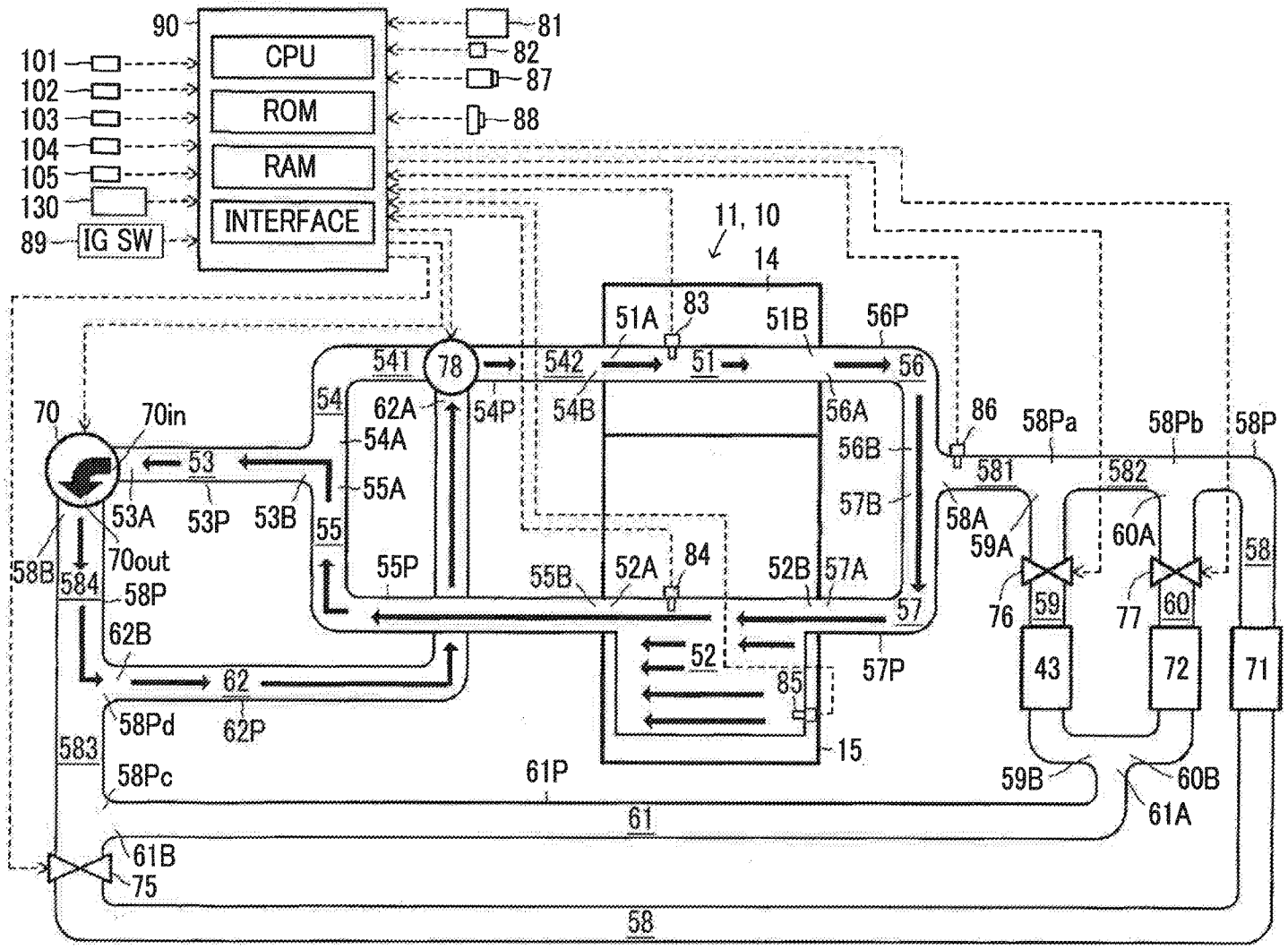
FIG. 36 is a diagram similar to that of FIG. 35 and is a diagram that shows a flow of coolant when the cooling system according to the third alternative embodiment executes operation control E.

When the condition that the cooling system according to the third alternative embodiment executes the operation control E is satisfied, the cooling system according to the third alternative embodiment executes the operation control E. In the operation control E, the pump 70 is operated, and the shutoff valves 75, 76, 77 each are set in the valve closed position and the selector valve 78 is set in the reverse flow position such that coolant circulates as indicated by the arrows in FIG. 36.

Thus, coolant discharged from the pump outlet port 70out to the radiator coolant passage 58 flows into the head coolant passage 51 via the coolant passage 62 and the second portion 542 of the coolant passage 54. The coolant flows through the head coolant passage 51 and then flows into the block coolant passage 52 via the coolant passage 56 and the coolant passage 57. The coolant flows through the block coolant passage 52, then flows through the coolant passage 55 and the coolant passage 53 sequentially, and is introduced into the pump 70 from the pump inlet port 70in.

With the operation control E that is executed by the cooling system according to the third alternative embodiment, coolant flowing through the head coolant passage 51 and having a high temperature directly flows into the block coolant passage 52 without passing through any of the radiator 71, and the like. For this reason, in comparison with the case where coolant that has passed through any of the radiator 71, and the like, is supplied to the block coolant passage 52, it is possible to increase the block temperature Tbr at a high rate.

Since coolant that has not passed through any of the radiator 71, and the like, is supplied also to the head coolant passage 51, it is possible to increase the head temperature Thd at a high rate in comparison with the case where coolant that has passed through any of the radiator 71, and the like, is supplied to the head coolant passage 51.

In addition, since coolant flows through the head coolant passage 51 and the block coolant passage 52, it is possible to prevent the temperature of coolant from becoming partially extremely high in the head coolant passage 51 or the block coolant passage 52. As a result, it is possible to prevent a boil of coolant in the head coolant passage 51 or the block coolant passage 52.

Operation Control L

Figure 37:
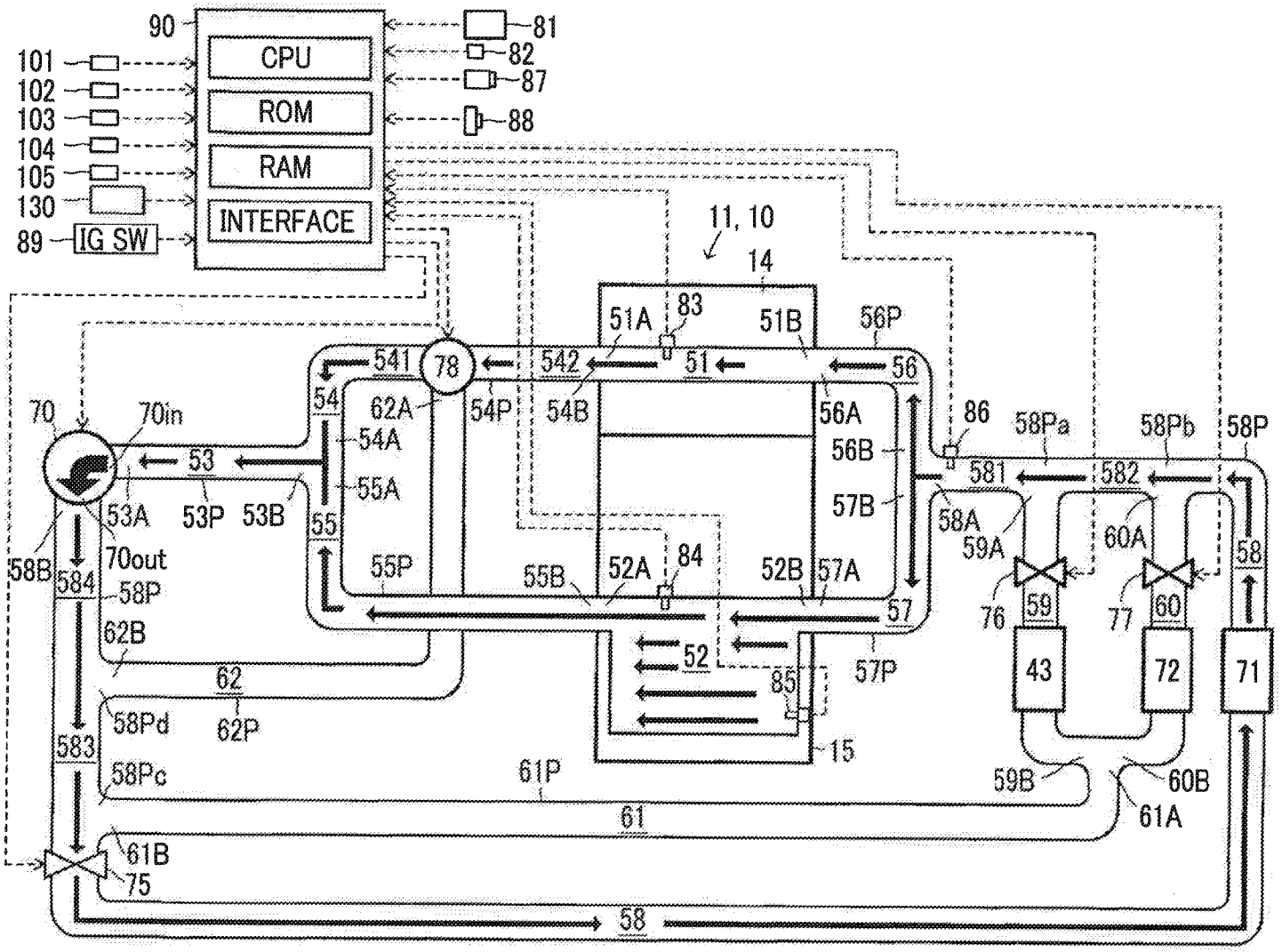
FIG. 37 is a diagram similar to that of FIG. 35 and is a diagram that shows a flow of coolant when the cooling system according to the third alternative embodiment executes operation control L.

On the other hand, when the condition that the cooling system according to the third alternative embodiment executes the operation control L is satisfied, the control system according to the third alternative embodiment executes the operation control L. In the operation control L, the pump 70 is operated, and the shutoff valves 76, 77 each are set in the valve closed position, the shutoff valve 75 is set in the valve open position and the selector valve 78 is set in the forward flow position such that coolant circulates as indicated by the arrows in FIG. 37.

Thus, part of coolant discharged from the pump outlet port 70out to the radiator coolant passage 58 flows into the head coolant passage 51 via the coolant passage 56. On the other hand, the remaining part of coolant discharged to the radiator coolant passage 58 flows into the block coolant passage 52 via the coolant passage 57.

Coolant flowing into the head coolant passage 51 flows through the head coolant passage 51, flows through the coolant passage 54 and the coolant passage 53 sequentially, and is introduced into the pump 70 from the pump inlet port 70in. On the other hand, coolant flowing into the block coolant passage 52 flows through the block coolant passage 52, then flows through the coolant passage 55 and the coolant passage 53 sequentially, and is introduced into the pump 70 from the pump inlet port 70in.

With the operation control L that is executed by the cooling system according to the third alternative embodiment, since coolant that has passed through the radiator 71 is supplied to the head coolant passage 51 and the block coolant passage 52, it is possible to cool the cylinder head 14 and the cylinder block 15 with the use of coolant having a low temperature.

Fourth Alternative Embodiment

Figure 38:
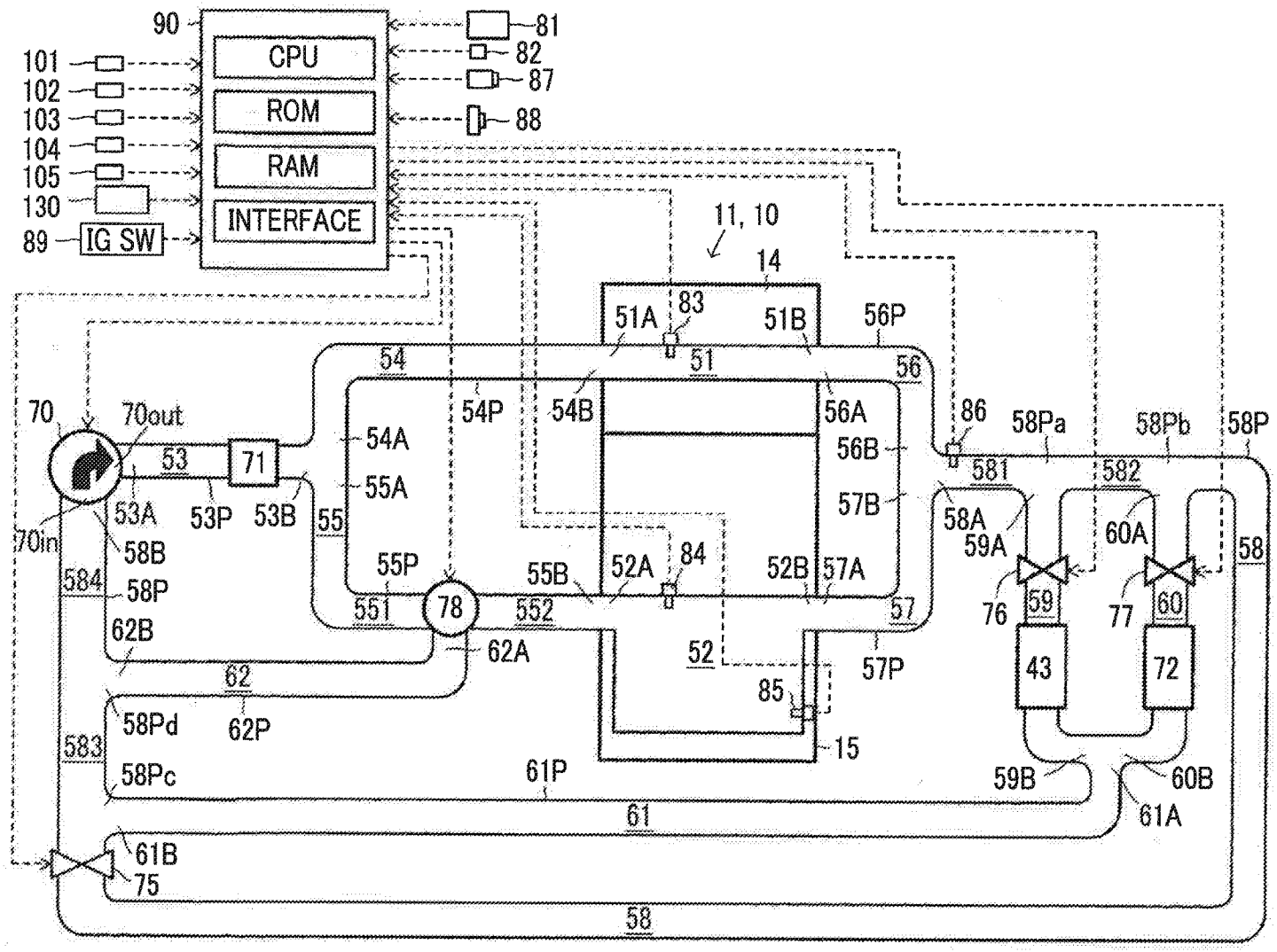
FIG. 38 is a diagram that shows a cooling system according to a fourth alternative embodiment to the embodiment.

The disclosure is also applicable to a cooling system according to a fourth alternative embodiment to the embodiment of the disclosure as shown in FIG. 38. In the cooling system according to the fourth alternative embodiment, the radiator 71 is not disposed in the coolant passage 58 that connects the second end 56B of the coolant passage 56 and the second end 57B of the coolant passage 57 to the pump 70, and the radiator 71 is disposed in the coolant passage 53.

Operation of Cooling System According to Fourth Alternative Embodiment

When the condition that the cooling system according to the embodiment executes any one of the operation controls I, J, K is satisfied, the cooling system according to the fourth alternative embodiment executes any one of the operation controls F, G, H, different from the cooling system according to the embodiment. On the other hand, when the condition that the cooling system according to the embodiment executes any one of the operation controls A, B, C, D, E, F, G, H and the operation controls L, M, N, O is satisfied, the cooling system according to the fourth alternative embodiment executes a corresponding one of the operation controls A, B, C, D, E, F, G, H and the operation controls L, M, N, O as well as the cooling system according to the embodiment.

When the cooling system according to the fourth alternative embodiment executes the operation controls A, B, C, D and the operation controls L, M, N, O, similar advantageous effects to those in the case where the cooling system according to the embodiment executes the operation controls A, L, M, N, O are obtained.

When the cooling system according to the fourth alternative embodiment executes any one of the operation controls E, F, G, H, I, J, K, coolant cooled by the radiator 71 and having a low temperature is supplied to the head coolant passage 51; however, coolant flowing through the head coolant passage 51 having a high temperature is directly supplied to the block coolant passage 52. For this reason, in comparison with at least the case where coolant cooled by the radiator 71 and having a low temperature is directly supplied to the block coolant passage 52, it is possible to increase the block temperature Thr at a high rate.

In the cooling system according to the embodiment and the cooling systems according to the alternative embodiments, the EGR system 40 may be configured to include a bypass pipe that connects the exhaust gas recirculation pipe 41 upstream of the EGR cooler 43 to the exhaust gas recirculation pipe 41 downstream of the EGR cooler 43 such that EGR gas bypasses the EGR cooler 43.

In this case, when the engine operation status falls within the EGR stop region Ra (see FIG. 4), the cooling system according to the embodiment and the cooling systems according to the alternative embodiments may be configured not to stop supply of EGR gas to the cylinders 12 and may be configured to supply EGR gas to the cylinders 12 via the bypass pipe. In this case, since EGR gas bypasses the EGR cooler 43, EGR gas having a relatively high temperature is supplied to the cylinders 12.

Alternatively, when the engine operation status falls within the EGR stop region Ra, the cooling system according to the embodiment and the cooling systems according to the alternative embodiments may be configured to selectively execute any one of a stop of supply of EGR gas to the cylinders 12 and supply of EGR gas to the cylinders 12 via the bypass pipe in response to conditions regarding parameters including the engine operation status.

When a temperature sensor that detects the temperature of the cylinder block 15 itself (particularly, the temperature of a portion of the cylinder block 15 near the cylinder bores that define the combustion chambers) is disposed in the cylinder block 15, the cooling system according to the embodiment and the cooling systems according to the alternative embodiments may be configured to use the temperature of the cylinder block 15 itself instead of the upper block coolant temperature TWbr_up. When a temperature sensor that detects the temperature of the cylinder head 14 itself (particularly, the temperature of a portion near the wall surfaces of the cylinder head 14, which define the combustion chambers) is disposed in the cylinder head 14, the cooling system according to the embodiment and the cooling systems according to the alternative embodiments may be configured to use the temperature of the cylinder head 14 itself instead of the head coolant temperature TWhd.

The cooling system according to the embodiment and the cooling systems according to the alternative embodiments may be configured to use a post-start accumulated fuel amount ΣQ that is the total amount of fuel supplied from the fuel injection valves 13 to the cylinders 12*a*, 12*b*, 12*c*, 12*d* from a start of the engine 10 for the first time after the ignition switch 89 is set in the on position, instead of or in addition to the post-start accumulated air amount ΣGa.

In this case, the cooling system according to the embodiment and the cooling systems according to the alternative embodiments determine that the engine warm-up status is the cold state when the post-start accumulated fuel amount ΣQ is smaller than or equal to a first threshold fuel amount ΣQ1, and determine that the engine warm-up status is the first half warm-up state when the post-start accumulated fuel amount ΣQ is larger than the first threshold fuel amount ΣQ1 and smaller than or equal to a second threshold fuel amount ΣQ2. The cooling system according to the embodiment and the cooling systems according to the alternative embodiments determine that the engine warm-up status is the second half warm-up state when the post-start accumulated fuel amount ΣQ is larger than the second threshold fuel amount ΣQ2 and smaller than or equal to a third threshold fuel amount ΣQ3, and determine that the engine warm-up status is the warm-up completion state when the post-start accumulated fuel amount Q is larger than a third threshold fuel amount ΣQ3.

When the engine coolant temperature TWeng is higher than or equal to the seventh engine coolant temperature TWeng7, the cooling system according to the embodiment and the cooling systems according to the alternative embodiments may be configured to determine that there is an EGR cooler coolant flow request even when the engine operation status falls within the EGR stop region Ra shown in FIG. 4 or the EGR stop region Rc shown in FIG. 4. In this case, the processes of step 2605 and step 2630 of FIG. 26 are omitted. Thus, coolant has been already supplied to the EGR cooler coolant passage 59 at the time when the engine operation status shifts from the EGR stop region Ra or the EGR stop region Rc to the FOR execution region Rb. For this reason, it is possible to cool EGR gas at the same time as the start of supply of EGR gas to the cylinders 12.

When the engine coolant temperature TWeng is higher than the ninth engine coolant temperature TWeng9 while the Outside air temperature Ta is higher than the threshold temperature Tath, the cooling system according to the embodiment and the cooling systems according to the alternative embodiments may be configured to determine that there is a heater core coolant flow request irrespective of the set position of the heater switch 88. In this case, the process of step 2710 of FIG. 27 is omitted.

When the post-restart engine cycle number Crst is smaller than or equal to the predetermined post-restart engine cycle number Crst_th and the first half warm-up condition is satisfied, the cooling system according to the embodiment and the cooling systems according to the alternative embodiments may be configured not to execute the operation control D and may be configured to execute the operation control B or the operation control C as the restart operation control.

The disclosure is also applicable to, in the cooling system according to the embodiment and the cooling systems according to the alternative embodiments, a cooling system that does not include the coolant passage 59 and the shutoff valve 76, a cooling system that does not include the coolant passage 60 and the shutoff valve 77, or a cooling system that does not include any of the coolant passages 59, 60, 61 and the shutoff valves 76, 77.

What is claimed:

1. A cooling system for an internal combustion engine, the cooling system being applied to the internal combustion engine including a cylinder head and a cylinder block, the cooling system being configured to cool the cylinder head and the cylinder block with the use of coolant, the cooling system comprising:

a first coolant passage provided in the cylinder head;

a second coolant passage provided in the cylinder block;

a pump configured to circulate the coolant;

a radiator configured to cool the coolant;

a third coolant passage connecting a first end of the first coolant passage to a first pump port, the first pump port being one of a pump outlet port and a pump inlet port, the pump outlet port being a coolant outlet port of the pump, the pump inlet port being a coolant inlet port of the pump;

a connection switching mechanism configured to switch a status of pump connection between a forward flow connection state and a reverse flow connection state, the status of pump connection being a status of connection of the pump to a third end of the second coolant passage, the forward flow connection state being a state where the third end of the second coolant passage is connected to the first pump port, the reverse flow connection state being a state where the third end of the second coolant passage is connected to a second pump port, the second pump port being the other one of the pump outlet port and the pump inlet port;

a fourth coolant passage connecting a second end of the first coolant passage to a fourth end of the second coolant passage;

a fifth coolant passage connecting the fourth coolant passage to the second pump port; and a shutoff valve configured to be set in a valve open position in which the fifth coolant passage is open when the forward flow connection state is established, and the shutoff valve being configured to be set in a valve closed position in which the fifth coolant passage is shut off when the reverse flow connection state is established, wherein:

when coolant flowing out from the second end of the first coolant passage flows into the fourth end of the second coolant passage via the fourth coolant passage at the time when the reverse flow connection state is established, the radiator is disposed at a location at which coolant that flows out from the second end of the first coolant passage and that flows into the fourth end of the second coolant passage via the fourth coolant passage is not cooled, and at a location at which coolant that flows out from the second end of the first coolant passage and the fourth end of the second coolant passage is cooled at the time when the forward flow connection state is established; and when coolant flowing out from the first end of the first coolant passage flows into the third end of the second coolant passage via the connection switching mechanism at the time when the reverse flow connection state is established, the radiator is disposed at a location at which coolant that flows out from the first end of the first coolant passage and that flows into the third end of the second coolant passage via the connection switching mechanism is not cooled, and at a location at which coolant that flows out from the first end of the first coolant passage and the third end of the second coolant passage is cooled at the time when the forward flow connection state is established.

2. The cooling system according to claim 1, wherein:

the connection switching mechanism includes a sixth coolant passage connecting the third end of the second coolant passage to the first pump port, a seventh coolant passage connecting the third end of the second coolant passage to the second pump port, and a selector valve configured to be selectively set in any one of a forward flow position and a reverse flow position, the forward flow position being a position in which the third end of the second coolant passage is connected to the first pump port via the sixth coolant passage, the reverse flow position being a position in which the third end of the second coolant passage is connected to the second pump port via the seventh coolant passage;

the connection switching mechanism is configured to establish the forward flow connection state by setting the selector valve in the forward flow position; and the connection switching mechanism is configured to establish the reverse flow connection state by setting the selector valve in the reverse flow position.

3. The cooling system according to claim 1, wherein the connection switching mechanism is configured to establish the reverse flow connection state when a temperature of the internal combustion engine is higher than or equal to a first threshold temperature and lower than a second threshold temperature, the first threshold temperature and the second threshold temperature are set in advance, the first threshold temperature is lower than a warm-up completion temperature set in advance as the temperature of the internal combustion engine, at or above which an electronic control unit determines that warm-up of the internal combustion engine is complete, and the second threshold temperature is lower than the warm-up completion temperature and higher than the first threshold temperature.

4. The cooling system according to claim 3, wherein the shutoff valve is configured to be set in the valve closed position when the temperature of the internal combustion engine is higher than or equal to the first threshold temperature and lower than the second threshold temperature.

5. The cooling system according to claim 1, wherein when the connection switching mechanism switches the status of pump connection from the reverse flow connection state to the forward flow connection state, the connection switching mechanism is configured to switch the status of pump connection from the reverse flow connection state to the forward flow connection state after a set position of the shutoff valve is switched from the valve closed position to the valve open position.

6. The cooling system according to claim 1, wherein:

the internal combustion engine includes an ignition switch; and when the internal combustion engine is stopped with an operation of the ignition switch, the connection switching mechanism is actuated so as to establish the forward flow connection state, and the shutoff valve is set in the valve open position.

7. A cooling system for an internal combustion engine, the cooling system being applied to the internal combustion engine including a cylinder head and a cylinder block, the cooling system being configured to cool the cylinder head and the cylinder block with the use of coolant, the cooling system comprising:

a first coolant passage provided in the cylinder head;

a second coolant passage provided in the cylinder block;

a pump configured to circulate the coolant;

a radiator configured to cool the coolant;

a third coolant passage connecting a third end of the second coolant passage to a first pump port, the first pump port being one of a pump outlet port and a pump inlet port, the pump outlet port being a coolant outlet port of the pump, the pump inlet port being a coolant inlet port of the pump;

a connection switching mechanism configured to switch a status of pump connection between a forward flow connection state and a reverse flow connection state, the status of pump connection being a status of connection of the pump to a first end of the first coolant passage, the forward flow connection state being a state where the first end of the first coolant passage is connected to the first pump port, the reverse flow connection state being a state where the first end of the first coolant passage is connected to a second pump port, the second pump port being the other one of the pump outlet port and the pump inlet port;

a fourth coolant passage connecting a second end of the first coolant passage to a fourth end of the second coolant passage;

a fifth coolant passage connecting the fourth coolant passage to the second pump port; and a shutoff valve configured to be set in a valve open position in which the fifth coolant passage is open when the forward flow connection state is established, and the shutoff valve being configured to be set in a valve closed position in which the fifth coolant passage is shut off when the reverse flow connection state is established, wherein:

when coolant flowing out from the second end of the first coolant passage flows into the fourth end of the second coolant passage via the fourth coolant passage at the time when the reverse flow connection state is established, the radiator is disposed at a location at which coolant that flows out from the second end of the first coolant passage and that flows into the fourth end of the second coolant passage via the fourth coolant passage is not cooled, and at a location at which coolant that flows out from the first end of the first coolant passage and the third end of the second coolant passage is cooled at the time when the forward flow connection state is established; and when coolant flowing out from the first end of the first coolant passage flows into the third end of the second coolant passage via the connection switching mechanism at the time when the reverse flow connection state is established, the radiator is disposed at a location at which coolant that flows out from the first end of the first coolant passage and that flows into the third end of the second coolant passage via the connection switching mechanism is not cooled, and at a location at which coolant that flows out from the second end of the first coolant passage and the fourth end of the second coolant passage is cooled at the time when the forward flow connection state is established.

8. The cooling system according to claim 7, wherein:

the connection switching mechanism includes a sixth coolant passage connecting the first end of the first coolant passage to the first pump port, a seventh coolant passage connecting the first end of the first coolant passage to the second pump port, and a selector valve configured to be selectively set in any one of a forward flow position and a reverse flow position, the forward flow position being a position in which the first end of the first coolant passage is connected to the first pump port via the sixth coolant passage, the reverse flow position being a position in which the first end of the first coolant passage is connected to the second pump port via the seventh coolant passage;

the connection switching mechanism is configured to establish the forward flow connection state by setting the selector valve in the forward flow position; and the connection switching mechanism is configured to establish the reverse flow connection state by setting the selector valve in the reverse flow position.

9. The cooling system according to claim 7, wherein the connection switching mechanism is configured to establish the reverse flow connection state when a temperature of the internal combustion engine is higher than or equal to a first threshold temperature and lower than a second threshold temperature, the first threshold temperature and the second threshold temperature are set in advance, the first threshold temperature is lower than a warm-up completion temperature set in advance as the temperature of the internal combustion engine, at or above which an electronic control unit determines that warm-up of the internal combustion engine is complete, and the second threshold temperature is lower than the warm-up completion temperature and higher than the first threshold temperature.

10. The cooling system according to claim 9, wherein the shutoff valve is configured to be set in the valve closed position when the temperature of the internal combustion engine is higher than or equal to the first threshold temperature and lower than the second threshold temperature.

11. The cooling system according to claim 7, wherein when the connection switching mechanism switches the status of pump connection from the reverse flow connection state to the forward flow connection state, the connection switching mechanism is configured to switch the status of pump connection from the reverse flow connection state to the forward flow connection state after a set position of the shutoff valve is switched from the valve closed position to the valve open position.

12. The cooling system according to claim 7, wherein:

the internal combustion engine includes an ignition switch; and when the internal combustion engine is stopped with an operation of the ignition switch, the connection switching mechanism is actuated so as to establish the forward flow connection state, and the shutoff valve is set in the valve open position.

* * * * *